US012097405B2

(12) United States Patent
Sands et al.

(10) Patent No.: US 12,097,405 B2
(45) Date of Patent: Sep. 24, 2024

(54) DATA-COLLECTING EXERCISE DEVICE

(71) Applicant: Disruptive Force LLC, Campbell, CA (US)

(72) Inventors: Nicholas P. Sands, Sausalito, CA (US); Justin Andrews, Felton, CA (US); Krista S. Jacobsen, Campbell, CA (US); Daniel K. Harden, Carmel by the Sea, CA (US); Cole Derby, San Francisco, CA (US); Britt Jensen, San Francisco, CA (US)

(73) Assignees: Nicholas Sands, Sausalito, CA (US); Krista Jacobsen, Campbell, CA (US)

( * ) Notice: Subject to any disclaimer, the term of this patent is extended or adjusted under 35 U.S.C. 154(b) by 52 days.

(21) Appl. No.: 18/164,807

(22) Filed: Feb. 6, 2023

(65) Prior Publication Data

US 2023/0191200 A1 Jun. 22, 2023

Related U.S. Application Data

(63) Continuation of application No. 17/031,808, filed on Sep. 24, 2020, now Pat. No. 11,571,608, which is a (Continued)

(51) Int. Cl.
*A63B 24/00* (2006.01)
*A63B 21/00* (2006.01)

(Continued)

(52) U.S. Cl.
CPC ..... *A63B 24/0062* (2013.01); *A63B 21/0004* (2013.01); *A63B 21/0023* (2013.01);

(Continued)

(58) Field of Classification Search
CPC ..... A63B 21/068; A63B 21/0004; A63B 21/0023; A63B 21/164035;

(Continued)

(56) References Cited

U.S. PATENT DOCUMENTS 4,023,796 A 5/1977 Kusmer
4,487,413 A 12/1984 Fall (Continued)

FOREIGN PATENT DOCUMENTS

CN 100342934 C 10/2007
CN 202199067 U 4/2012

(Continued)

OTHER PUBLICATIONS

China National Intellectual Property Administration, First Office Action from Chinese patent application No. 201680077556.8, mailed Jul. 26, 2019.

(Continued)

*Primary Examiner* — Megan Anderson
(74) *Attorney, Agent, or Firm* — Jacobson IP Law; Krista S. Jacobsen

(57) ABSTRACT

A system may include an exercise device and an external device. The exercise device may include a rigid rod, a plurality of light sources, at least one load sensor for detecting an applied longitudinal force, and a first processor coupled to the at least one load sensor and to the plurality of light sources and configured to obtain a signal indicating a magnitude of the applied longitudinal force, and cause a subset of the plurality of light sources to emit light. The external device may comprise a communication interface, a display, and a second processor coupled to the communication interface and to the display and configured to establish a communication link with the exercise device using the communication interface, obtain data over the communication link, and cause the display to present information associated with the exercise device.

20 Claims, 29 Drawing Sheets

Related U.S. Application Data continuation of application No. 15/990,368, filed on May 25, 2018, now Pat. No. 10,835,781, which is a continuation of application No. PCT/US2016/064333, filed on Dec. 1, 2016.

(60) Provisional application No. 62/262,343, filed on Dec. 2, 2015.

(51) Int. Cl.

| | |
|---|---|
| ***A63B 21/002*** | (2006.01) |
| ***A63B 21/068*** | (2006.01) |
| ***A63B 21/16*** | (2006.01) |
| ***A63B 23/035*** | (2006.01) |
| ***A63B 23/12*** | (2006.01) |
| ***A63B 71/06*** | (2006.01) |

(52) U.S. Cl.

CPC ..... *A63B 21/068* (2013.01); *A63B 21/16* (2013.01); *A63B 21/4035* (2015.10); *A63B 23/03525* (2013.01); *A63B 23/12* (2013.01); *A63B 24/0075* (2013.01); *A63B 24/0087* (2013.01); *A63B 71/0622* (2013.01); *A63B 2024/0068* (2013.01); *A63B 2024/0078* (2013.01); *A63B 2071/0625* (2013.01); *A63B 2071/065* (2013.01); *A63B 2071/0655* (2013.01); *A63B 2071/0694* (2013.01); *A63B 2209/02* (2013.01); *A63B 2220/17* (2013.01); *A63B 2220/51* (2013.01); *A63B 2220/62* (2013.01); *A63B 2225/50* (2013.01)

(58) Field of Classification Search

CPC ..... A63B 23/03525; A63B 23/12; A63B 24/0062; A63B 24/0075; A63B 24/0087; A63B 71/0622; A63B 71/0694; A63B 71/0625; A63B 71/065; A63B 71/0655; A63B 2024/0068; A63B 2024/0078; A63B 2225/50; A63B 2225/62; A63B 2225/17; A63B 2225/51; A63B 2209/02

See application file for complete search history.

(56) References Cited

U.S. PATENT DOCUMENTS

| | | | | |
|---|---|---|---|---|
| 4,607,841 | A | 8/1986 | Gala | |
| 4,645,200 | A | 2/1987 | Hix | |
| 4,705,271 | A | 11/1987 | Mondloch et al. | |
| 4,824,103 | A | 4/1989 | Smidt | |
| 4,882,677 | A | 11/1989 | Curran | |
| 5,004,226 | A | 4/1991 | Brown | |
| 5,176,601 | A | 1/1993 | Reynolds | |
| 5,261,821 | A | 11/1993 | Shic | |
| 5,490,825 | A * | 2/1996 | Wilkinson | A63B 21/072 482/109 |
| 5,522,783 | A | 6/1996 | Gordon | |
| 5,653,664 | A | 8/1997 | Jennings | |
| 5,674,166 | A | 10/1997 | Gordon | |
| 5,776,037 | A | 7/1998 | Millington | |
| 6,597,347 | B1 | 7/2003 | Yasutake | |
| 6,689,030 | B1 | 2/2004 | Leslie | |
| 7,066,864 | B2 | 6/2006 | Olkkonen | |
| 7,121,982 | B2 | 10/2006 | Feldman | |
| 7,303,193 | B2 | 12/2007 | Miletich | |
| 7,429,236 | B2 | 9/2008 | Dalebout et al. | |
| 7,557,286 | B2 | 7/2009 | Capotosto | |
| 8,029,410 | B2 | 10/2011 | Shea | |
| 8,033,958 | B2 | 10/2011 | Beyzavi-Armani | |
| 8,172,723 | B1 | 5/2012 | Yanev et al. | |
| 8,343,013 | B1 | 1/2013 | Yanev et al. | |
| 8,562,490 | B2 | 10/2013 | Dibenedetto et al. | |
| 8,574,129 | B2 | 11/2013 | Lannon et al. | |
| 8,821,323 | B2 | 9/2014 | Liu et al. | |
| 8,905,054 | B2 | 12/2014 | Yanev et al. | |
| 9,168,418 | B2 * | 10/2015 | Adamchick | A63B 21/015 |
| 9,229,476 | B2 | 1/2016 | Yanev et al. | |
| 9,230,064 | B2 | 1/2016 | Yanev et al. | |
| 9,262,064 | B2 | 2/2016 | Yanev et al. | |
| 9,360,343 | B2 | 6/2016 | Stevens et al. | |
| 9,826,806 | B2 * | 11/2017 | Challa | A45B 3/02 |
| 10,092,817 | B2 * | 10/2018 | Muuli | A63B 69/18 |
| D842,940 | S | 3/2019 | Harden et al. | |
| 2002/0155925 | A1 | 10/2002 | Smith | |
| 2003/0045405 | A1 | 3/2003 | Lin | |
| 2003/0069108 | A1 | 4/2003 | Kaiserman et al. | |
| 2003/0190999 | A1 | 10/2003 | Liu | |
| 2005/0014607 | A1 | 1/2005 | Olkkonen | |
| 2006/0135325 | A1 | 6/2006 | Holness | |
| 2006/0217243 | A1 | 9/2006 | Feldman et al. | |
| 2008/0090703 | A1 | 4/2008 | Rosenberg | |
| 2009/0149304 | A1 | 6/2009 | Smith | |
| 2009/0264267 | A1 | 10/2009 | Ballif | |
| 2010/0041518 | A1 | 2/2010 | Beyzavi-Armani et al. | |
| 2011/0319232 | A1 | 12/2011 | Thorpe | |
| 2012/0322632 | A1 | 12/2012 | Kezer | |
| 2013/0005535 | A1 | 1/2013 | Duchovne | |
| 2013/0172155 | A1 | 7/2013 | Adamchick et al. | |
| 2013/0178344 | A1 | 7/2013 | Walsh et al. | |
| 2013/0267394 | A1 | 10/2013 | Duke | |
| 2013/0337974 | A1 | 12/2013 | Yanev et al. | |
| 2013/0337975 | A1 | 12/2013 | Yanev et al. | |
| 2013/0337976 | A1 | 12/2013 | Yanev et al. | |
| 2013/0346021 | A1 | 12/2013 | Stevens et al. | |
| 2014/0076074 | A1 | 3/2014 | Yanev et al. | |
| 2014/0100085 | A1 | 4/2014 | Hao | |
| 2014/0229349 | A1 | 8/2014 | Yanev et al. | |
| 2014/0333543 | A1 | 11/2014 | Yanev et al. | |
| 2014/0335494 | A1 | 11/2014 | Yanev et al. | |
| 2015/0015476 | A1 | 1/2015 | Yanev | |
| 2015/0018722 | A1 | 1/2015 | Yanev | |
| 2015/0195930 | A1 | 7/2015 | Yanev et al. | |
| 2015/0301613 | A1 | 10/2015 | Yanev et al. | |
| 2015/0362389 | A1 | 12/2015 | Yanev et al. | |
| 2016/0184634 | A1 | 6/2016 | Yanev et al. | |
| 2018/0008855 | A1 | 1/2018 | Yanev et al. | |
| 2018/0036624 | A1 | 2/2018 | Muuli et al. | |
| 2018/0064991 | A1 | 3/2018 | Yanev et al. | |
| 2018/0264323 | A1 | 9/2018 | Laakkonen | |

FOREIGN PATENT DOCUMENTS

| | | | |
|---|---|---|---|
| WO | 2012078718 | A1 | 6/2012 |
| WO | 2013192071 | A1 | 12/2013 |
| WO | 2013192079 | A1 | 12/2013 |
| WO | 2014123651 | A1 | 8/2014 |
| WO | 2014182735 | A2 | 11/2014 |
| WO | 2015006413 | A2 | 1/2015 |
| WO | 2014182729 | A3 | 5/2015 |
| WO | 2015006411 | A3 | 7/2015 |
| WO | 2015105725 | A1 | 7/2015 |
| WO | 2015164375 | A1 | 10/2015 |
| WO | 2015195346 | A1 | 12/2015 |
| WO | 2016109719 | A1 | 7/2016 |
| WO | 2016135386 | A1 | 9/2016 |

OTHER PUBLICATIONS

European Patent Office, Communication Pursuant to Article 94(3) EPC European patent application No. 16 813 270.2, mailed Oct. 6, 2020.

European Patent Office, Communication pursuant to Article 94(3) EPC in European patent application No. 16 813 270.2, mailed Jan. 30, 2020.

International Search Report and Written Opinion in Application No. PCT/US2016/064333 (filed Dec. 1, 2016), mailed Jun. 12, 2017.

* cited by examiner

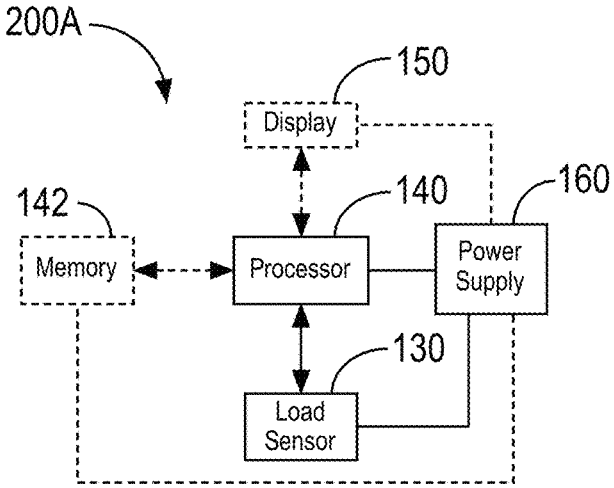
FIG. 6A
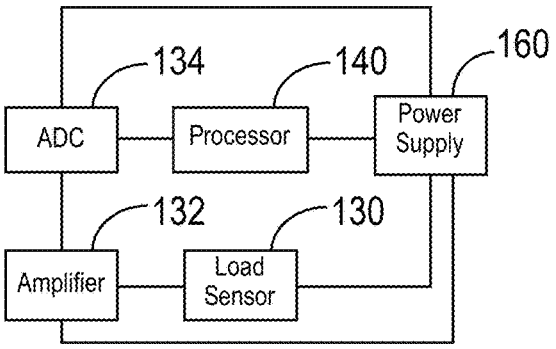
FIG. 6B
FIG. 7A
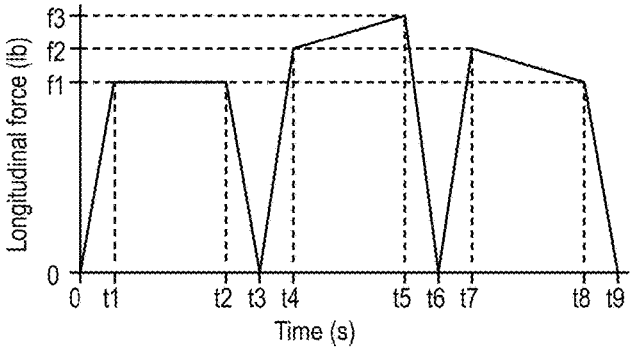
FIG. 7B
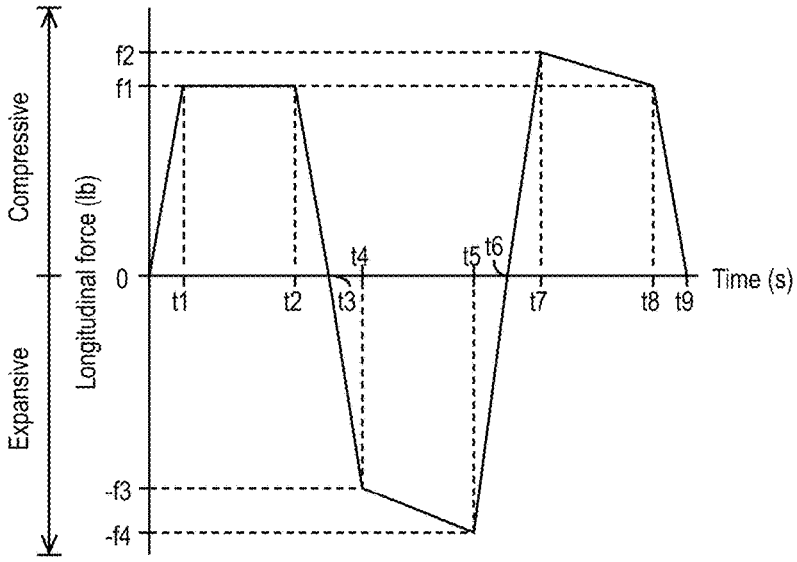

DATA-COLLECTING EXERCISE DEVICE

CROSS-REFERENCE TO RELATED APPLICATIONS

This application is a continuation of U.S. patent application Ser. No. 17/031,808, filed Sep. 24, 2020 and entitled "DATA-COLLECTING EXERCISE DEVICE," which issued on Feb. 7, 2023 as U.S. Pat. No. 11,571,608. U.S. patent application Ser. No. 17/031,808 is a continuation of U.S. patent application Ser. No. 15/990,368, filed May 25, 2018 and entitled "DATA-COLLECTING EXERCISE DEVICE," which issued on Nov. 17, 2020 as U.S. Pat. No. 10,835,781. U.S. patent application Ser. No. 15/990,368 is a continuation of PCT Application No. PCT/US2016/064333, filed Dec. 1, 2016 and entitled "Data-Collecting Exercise Device," designating the United States and published in English, which claims priority to U.S. Provisional Application No. 62/262,343, filed Dec. 2, 2015 and entitled "Data-Collecting Exercise Device." All of the above-referenced applications are hereby incorporated by reference in their entireties for all purposes.

BACKGROUND

Exercise is important to maintain and improve a person's physical fitness and overall health and wellness. One way to motivate people to exercise is to provide feedback regarding their workouts. Today, there are many ways for people engaged in cardiovascular exercise to obtain feedback about their performances. For example, the so-called "cardio" machines, such as treadmills, exercise bicycles, rowing machines, stair-climbing equipment, and elliptical machines, commonly found in commercial gyms or in users' homes often provide information to users about (virtual) distance traveled, speed, estimated number of calories burned, and the like. Similarly, smart phones and wearable devices, such as smart watches and fitness trackers, may provide information about or estimates of the number of steps walked, distance traveled, flights of stairs climbed, calories burned, or time spent running, walking, or biking. The feedback provided by cardio machines, smart phones, and wearable devices tends to encourage users to establish and meet goals (e.g., to walk at least 10,000 steps per day, to run at a pace of at least six miles per hour for thirty minutes, to burn 300 calories, etc.).

In addition to cardiovascular exercise, many people also include weight lifting and weight training in their workout routines. Tracking the amount of weight lifted and the number of repetitions performed can also help users to establish and meet goals. Typically, however, users must track such information by hand, such as by recording information about the workout during the workout by writing it on paper or by entering the information into an electronic application (e.g., a smart phone application). The need for user involvement in the tracking process is inconvenient because it requires the user to stop the workout to record the tracked information, and it may also require the user to carry a mobile device or paper and a writing implement in the gym, or the user may need to remember all of the pertinent information about the workout. Moreover, there may be information about the workout that would be useful for the user to know but that is inconvenient, difficult, or impossible for the user to track while working out. For instance, the user may want to know how quickly or slowly he or she performed each repetition in a set of ten repetitions of bench press. Because the user's hands are in use holding the barbell during the set, the user cannot easily start or stop a timer for each repetition. Although a second person could time each repetition, such a process is likely to be inaccurate because the second person would need to determine when each repetition starts and finishes, and then would need to record the time of each repetition during the time between repetitions, which might not be feasible. Furthermore, the person performing bench press may be relying on the second person as a spotter (i.e., a person who stands by to assist the exerciser if the exerciser's muscles fatigue to the point that the exerciser cannot complete a repetition). If the second person is too engrossed in determining the timing of each repetition, he or she may not be an effective spotter.

Therefore, there is a need for innovations that allow people engaged in strength training exercises to obtain useful information about their workouts.

BRIEF DESCRIPTION OF THE DRAWINGS

Objects, features, and advantages of the disclosure will be readily apparent from the following description of certain embodiments taken in conjunction with the accompanying drawings, in which:

FIGS. 6A and 6B are block diagrams of some components of an exemplary exercise device in accordance with some embodiments.

FIGS. 7A and 7B are plots of longitudinal force as a function of time.

DETAILED DESCRIPTION

Figure 1A:
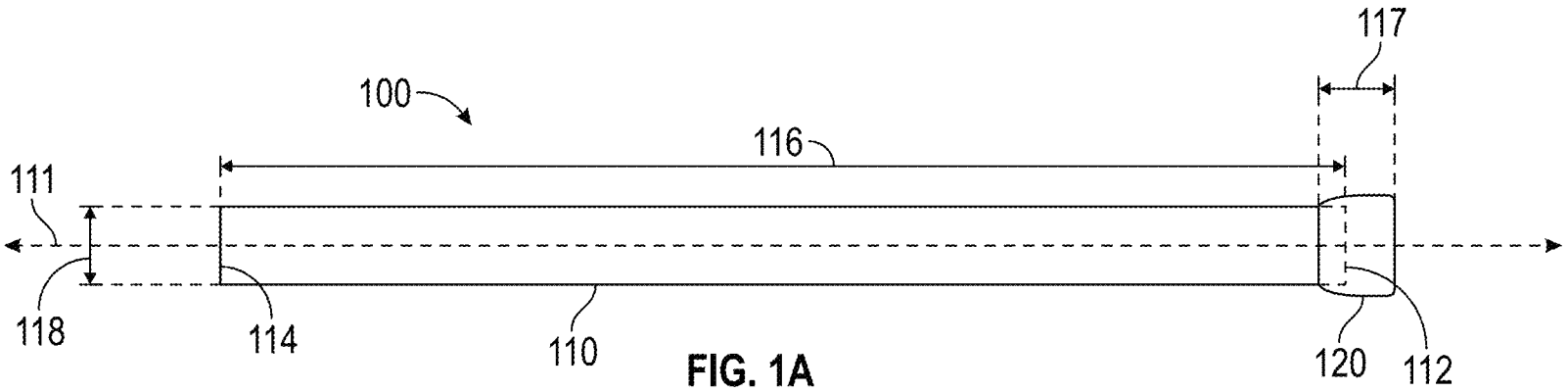
FIGS. 1A, 1B, and 1C illustrate an exemplary embodiment of an exercise device in accordance with some embodiments.

Exercises may be classified into two general categories: isotonic and isometric. Isotonic exercises move a joint through some range of motion against a resistance, typically provided by weights, gravity, or both. The resistance during an isotonic exercise may be from a person's own body weight. For example, a person may perform lunges, push-ups, or pull-ups using only his or her body weight. Alternatively, a person may perform isotonic exercises using weights, such as dumbbells, kettle bells, barbells, or other types of weights. For example, a person performing lunges may hold dumbbells, a person performing push-ups may do so with a weight plate on his or her back, or a person performing pull-ups may do so while wearing a weight vest.

Isotonic exercises may also be performed using exercise machines, which typically use springs, pistons, or weights to resist or oppose the user's movements. Many exercise machines, such as those found in commercial gyms, have been developed to allow users to perform isotonic exercises. Because isotonic exercise machines typically exercise only a specified muscle or group of muscles, a variety of different exercise machines may be needed to enable a person to exercise different muscle groups throughout the body and thereby obtain a complete body workout. Purchasing such a variety of equipment may require a sizable monetary investment. In addition, commercial exercise machines may be large or bulky, and a substantial amount of floor space may be required to house such exercise machines. These factors may make the inclusion of isotonic exercise machines in a home gym infeasible for many people. Moreover, isotonic exercise machines provide either no feedback at all about a user's workout or only limited feedback about a user's workout.

Isometric exercises require a person to tense a specific muscle without appreciably moving a joint or changing the length of the muscle being tensed. Isometric exercises are static exercises that target specific muscle groups to help build or maintain muscular strength and stability. To perform an isometric exercise, a person typically pushes or pulls against an immovable object, such as a wall, a floor, a pipe, or a heavy piece of furniture. The exerciser tenses a muscle or group of muscles and holds a fixed position while maintaining tension in the muscle or muscle group for an extended period of time. The exerciser assumes different positions to exercise different muscles or muscle groups.

Isometric exercises enable people to adjust the load on their muscles to match their physical conditions or abilities. Because isometric exercises do not require joint movement, isometric exercises may be particularly helpful to people who have limited mobility or are recovering from an injury. Isometric exercises may also be more inviting to those who are new to exercising and might be intimidated by the difficulty or variety of available isotonic exercises or the equipment required to perform many isotonic exercises.

An exercise may be purely isotonic or purely isometric, or it may have both isotonic and isometric components or phases. Disclosed herein are embodiments of an exercise device enabling users to perform isotonic, isometric, or combination exercises to improve strength and cardiovascular fitness. The exercise device measures and provides information about users' workouts, thus enabling users to track their progress and/or set goals for their exercise programs. Also disclosed herein are methods of using the exercise device.

Figure 1B:
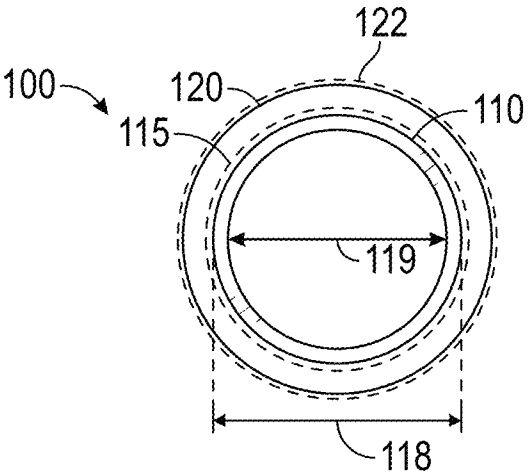
Figure 1C:
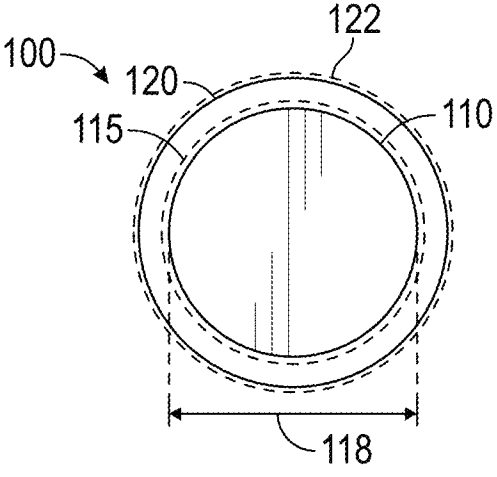

FIGS. 1A, 1B, and 1C illustrate exemplary exercise devices 100 in accordance with some embodiments. The exercise device 100 comprises a rigid rod 110 and a base 120. FIG. 1A illustrates a side view of the exercise device 100, and FIGS. 1B and 1C are cross-sectional views of two embodiments of the exercise device 100 looking toward the base 120. As described in more detail below, the exercise device 100 comprises one or more electronic components, and these electronic components may reside inside the rigid rod 110, the base 120, or partially within the rigid rod 110 and partially within the base 120. FIGS. 1A, 1B, and 1C do not illustrate these one or more electronic components.

As shown in FIG. 1A, the rigid rod 110 is coupled to the base 120 and has a first end 112 near the base 120 and a second end 114 distal from the base 120. A longitudinal axis 111 extends between the first end 112 and the second end 114. Although FIG. 1A illustrates the first end 112 of the rigid rod 110 as residing within the base 120, the first end 112 of the rigid rod 110 may reside outside of the base 120 (e.g., the base 120 may be flush with or partially inside of the first end 112 of the rigid rod 110, or the base 120 may separated by some distance from the first end 112 of the rigid rod 110). Furthermore, in some embodiments, the base 120 is not in direct contact with the rigid rod 110 but instead is coupled to the rigid rod 110 through an intervening mechanism (e.g., a collar, a post, a sleeve, etc.).

As used herein, the term "longitudinal direction" refers to the direction substantially along the longitudinal axis 111 of the rigid rod 110, i.e., either in the direction from the second end 114 of the rigid rod 110 toward the first end 112 of the rigid rod 110, or from the first end 112 of the rigid rod 110 toward the second end 114 of the rigid rod 110. The term "longitudinal force" refers to a force applied substantially along the longitudinal axis 111, whether in the direction from the first end 112 to the second end 114 of the rigid rod 110, or vice versa. The longitudinal force applied substantially along the longitudinal axis 111 in the direction from the second end 114 of the rigid rod 110 toward the first end 112 of the rigid rod 110 (i.e., toward the base 120) is referred to herein as a "compressive longitudinal force," and a longitudinal force applied substantially along the longitudinal axis 111 in the direction from the first end 112 of the rigid rod 110 toward the second end 114 of the rigid rod 110 (i.e., away from the base 120) is referred to herein as an "expansive longitudinal force."

As an example of how a user might use the exercise device 100, a user may grasp the rigid rod 110, position the base 120 of the exercise device 100 against a surface (e.g., a wall, a floor, a ceiling, a door, a heavy piece of furniture, etc.), and apply a compressive longitudinal force to the exercise device 100. As another example, a user may affix the exercise device 100 to a surface or heavy object (as explained below), grasp the rigid rod 110, and apply an expansive longitudinal force to the exercise device 100. As explained below, in some embodiments, components within the exercise device 100 measure and report, among other items of information, the longitudinal forces applied by users.

In some embodiments, the exercise device 100 has a weight that allows users to maneuver and hold the exercise device 100 in various positions, including substantially horizontally with the base 120 positioned against and in contact with a substantially vertical surface (e.g., a wall, a door, the side of a door frame, etc.) or substantially vertically with the base 120 positioned against a substantially horizontal surface (e.g., a ceiling, the top of a door frame, a floor, etc.). In some embodiments, the weight of the exercise device 100 is less than fifteen pounds. It is to be understood that other weights, larger or smaller, are contemplated and are within the scope of the disclosures herein.

The rigid rod 110 should not stretch, compress, expand, or bend appreciably when subjected to longitudinal forces applied by users. It is to be understood that the rigid rod 110 is referred to as "rigid" because it does not stretch, compress, expand, or bend appreciably when subjected to longitudinal forces. Although the rigid rod 110 may also maintain its rigidity in the presence of transverse forces applied substantially perpendicular to the longitudinal axis 111, the rigid rod 110 may be less rigid or even somewhat flexible (e.g., may bow or otherwise bend) in the presence of forces applied in directions not substantially parallel to the longitudinal axis 111.

In some embodiments, the rigid rod 110 is made of a material having a high specific compressive strength (i.e., a high capacity to withstand loads tending to reduce size (e.g., to resist compression)) and a high specific tensile strength (i.e., a high capacity to withstand loads tending to elongate (e.g., to resist tension)). The rigid rod 110 may be made of any material and may have any dimensions that result in the rigid rod 110 being able to withstand a longitudinal force, whether compressive or expansive, of a magnitude a user of the exercise device 100 is expected to be capable of applying. For example, the rigid rod 110 may be capable of withstanding longitudinal forces of at least 150 pounds.

In some embodiments, the rigid rod 110 comprises a material having a specific compressive strength or a specific tensile strength similar to that of steel. In some embodiments, the rigid rod 110 comprises polyvinyl chloride (PVC). In other embodiments, the rigid rod 110 comprises aluminum. In still other embodiments, the rigid rod 110 comprises wood. In some embodiments, the rigid rod 110 comprises bamboo. For example, the rigid rod 110 may be made from engineered bamboo (e.g., a product made by gluing together bamboo material in various forms (e.g., strands or mats) to form rectangular boards, similar to lumber, though not necessarily in a cuboid shape). It is to be understood that other materials (e.g., plastic, fiberglass reinforced plastic (FRP), steel, iron, metal, aerogel, microarchitected materials, carbon fiber, Kevlar™, aramid fiber, etc.) are contemplated for the rigid rod 110 and are within the scope of the disclosures herein. Moreover, the rigid rod 110 may include multiple materials. The rigid rod 110 may be made of any material or materials that, in combination with the other selected properties of the rigid rod 110 (e.g., length, thickness, diameter (e.g., inner and outer diameters, if the rigid rod is partially or entirely hollow, as discussed below), etc.), enables the rigid rod 110 to withstand the longitudinal forces expected to be applied by a user.

The rigid rod 110 may be manufactured using any suitable process. For example, extrusion or injection molding may be a suitable manufacturing process for rigid rods 110 comprising plastic (e.g., PVC). Extrusion, casting, or machining may be suitable manufacturing processes for rigid rods 110 made of metal (e.g., aluminum). Other processes may be appropriate in embodiments in which the rigid rod 110 is wood or bamboo. For example, a rigid rod 110 made of wood may be fabricated by processing lumber into whatever shape is desired for the rigid rod 110. If the rigid rod 110 is made from engineered bamboo, and the rigid rod 110 has a cylindrical shape, the engineered bamboo may be processed into cylinders to form the rigid rod 110.

As illustrated in FIG. 1A, the distance between the first end 112 and the second end 114 of the rigid rod 110 is the length 116 of the rigid rod 110. The rigid rod 110 may have any length 116 suitable to facilitate intended users performing their desired exercise routines. In some embodiments, the length 116 of the rigid rod 110 is between approximately four and seven feet. It is to be appreciated, however, that rigid rod 110 lengths 116 outside of the range of four to seven feet are also contemplated and are within the scope of the disclosure.

In some embodiments, including the exemplary embodiments shown in FIGS. 1B and 1C, the rigid rod 110 is substantially uniform and cylindrical, and has a circumference 115. The embodiment of the exercise device 100 shown in FIG. 1B is hollow along its length 116, with an outer diameter 118 and an inner diameter 119. The thickness of the wall of the rigid rod 110 shown in FIG. 1B is equal to one-half of the difference between the outer diameter 118 and the inner diameter 119. When the rigid rod 110 is hollow as illustrated in FIG. 1B, the thickness of the rigid rod 110 wall should be selected, in conjunction with the rigid rod 110 material, so that the exercise device 100 can withstand the maximum longitudinal force, whether compressive or expansive, expected to be applied by the user. In some embodiments, the inner diameter 119 is approximately 1.6 inches, the outer diameter 118 is approximately 1.9 inches, and, therefore, the thickness of the rigid rod 110 wall is approximately 0.15 inches. In some embodiments, the outer diameter 118 is approximately 1.75 inches, and the thickness of the rigid rod 110 wall is approximately ⅛ inch. It is to be appreciated, however, that when the rigid rod 110 is partially or completely hollow along its length 116, other rigid rod 110 outer diameters 118, inner diameters 119, and wall thicknesses are contemplated and are within the scope of the disclosure.

The embodiment of the exercise device 100 illustrated in FIG. 1C includes a rigid rod 110 that is solid at the location of the cross section. It is to be appreciated that the rigid rod 110 may be solid along a first portion of its length 116 and hollow along a second portion of its length 116. Embodiments in which the rigid rod 110 is partially or completely hollow along its length 116 enable the rigid rod 110 to house some or all of the electronic components discussed in more detail below. It is to be understood that although many of the drawings herein illustrate hollow rigid rods 110, the rigid rod 110 may alternatively include a cavity 125 in which electronic components may be situated.

As illustrated in FIG. 1A, the outer diameter 118 is smaller than the length 116 of the rigid rod 110. Typically, the length 116 of the rigid rod 110 is at least 4 times the outer diameter 118 of the rigid rod 110, although the length 116 of the rigid rod 110 need not be at least 4 times the outer diameter 118 of the rigid rod 110. In some embodiments, the length 116 of the rigid rod 110 is between four and seven feet, and the outer diameter 118 of the rigid rod 110 is less than two inches.

Although FIGS. 1A through 1C illustrate the rigid rod 110 having a smaller circumference 115 than the circumference 122 of the base 120, the rigid rod 110 may have the same circumference as the base 120, or it may have a larger circumference. Furthermore, although FIGS. 1A through 1C illustrate a cylindrical rigid rod 110 having a circular cross-section, the rigid rod 110 may have any convenient shape that enables a user to grasp the rigid rod 110 to perform a desired exercise or exercise routine. For example, the rigid rod 110 may have an oval cross-section rather than a circular cross-section, or it may have any other desired regular or irregular shape that facilitates a user applying a compressive or expansive longitudinal force. In such cases, the outer diameter 118 is an average, minimum, or maximum outer diameter of a cross-section of the rigid rod 110. In addition, the rigid rod 110 may not have a uniform shape along its length 116 (i.e., the rigid rod 110 dimensions, such as, for example, its outer diameter 118 and, if applicable, inner diameter 119 may change along the length 116). Also, as shown in FIG. 1C, the rigid rod 110 may not be hollow (i.e., the rigid rod 110 may be solid), or it may be only partially hollow (i.e., the rigid rod 110 may be hollow for a portion of its length 116 and solid for another portion of its length 116). As explained below, in some embodiments in which the rigid rod 110 is hollow along part or all of its length, the rigid rod 110 houses some or all of the electronic components described below.

The rigid rod 110 may include at least one attachment to enable the user to grasp the rigid rod 110 more easily. If included, the at least one attachment may be located at any position(s) along the rigid rod 110 where it may be helpful to the user's workout. For example, handles may be coupled to the first end 112 and/or to the second end 114 of the rigid rod 110. As another example, a pad may be included around the rigid rod 110 for physical therapy or corrective exercise techniques. If included, the at least one attachment may be permanently attached to the rigid rod 110, or it may be temporarily coupled to, and removable from, the rigid rod 110. Likewise, if included, the position of the at least one attachment along the length of the rigid rod 110 may be adjustable.

The rigid rod 110 may include at least one feature to enable a user to grasp the rigid rod 110 more securely. For example, one or more grips (made of, e.g., rubber, grip tape, fabric, foam, wax, spray grip material, stamping, soft elastomer, Egrips® material, or a 3M™ Gripping Material product) may be attached to the outside of the rigid rod 110. As another example, one or more grips may be temporarily attached to the outside of the rigid rod 110 (e.g., to make the circumference of the rigid rod 110 larger temporarily, such as to help a user improve his or her grip strength). As another example, the rigid rod 110 may include knurls or other texturing along part or all of its length 116. For example, if the rigid rod 110 is made of wood (e.g., bamboo), the wood may be rough-sanded to allow a user to grip the rigid rod 110 securely. As another example, if the rigid rod 110 is aluminum or another material that may be processed using knurling (i.e., a manufacturing process, performed by machine or by hand, whereby a pattern of straight, angled, or crossed lines is cut or rolled into a material), the rigid rod 110 may include knurls. If included, the at least one feature may be permanent (e.g., knurls), or it may be removable (e.g., a temporary grip), or its position along the rigid rod 110 may be adjustable. Removable features contemplated for use with the exercise device 100 include clamp-on handles, mitts, gloves, or sleeves.

Figure 2A:
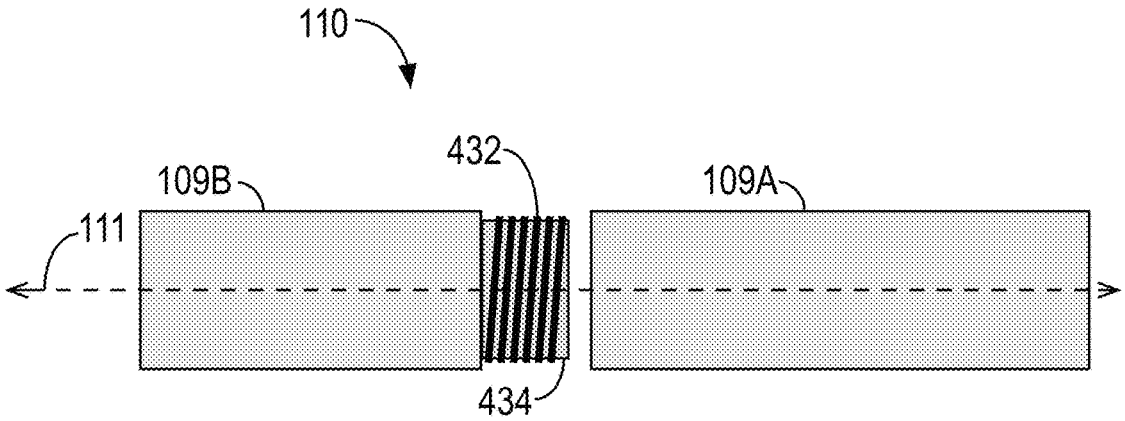
FIGS. 2A and 2B illustrate an embodiment in which the rigid rod comprises two portions.

In some embodiments, the rigid rod 110 comprises two or more pieces. FIG. 2A illustrates an example of such an embodiment in which the rigid rod 110 comprises two portions 109A and 109B, and a first portion 109A is separable from a second portion 109B. In the embodiment of FIG. 2A, the second portion 109B includes a cylinder 434 with a protruding threaded portion 432 that fits within a corresponding thread within the first portion 109A. Thus, the first portion 109A and second portion 109B of FIG. 2A may be attached together by inserting the cylinder 434 of the second portion 109B into the first portion 109A and rotating the first and second portions 109A, 109B in opposite directions about the longitudinal axis 111 so that the threaded portion 432 of the second portion 109B mates with the corresponding thread inside of the first portion 109B, thereby holding the first and second portions 109A, 109B tightly in place by a screw mechanism. Although FIG. 2A illustrates the first and second portions 109A, 109B joined by a twist screw mechanism, the first and second portions 109A, 109B may be joined together in some other way. For example, the first and second portions 109A, 109B may be held together by one or more pins, or they may snap together, or the first and second portions 109A and 109B may be affixed to each other using a press fitting or latch. Other possible joining mechanisms include at least one set screw, adhesive, a bayonet mount (i.e., a fastening mechanism comprising a cylindrical male side with one or more radial pins, and a female receptor with matching L-shaped slot(s) and with spring(s) to keep the two parts locked together), an expanding fastener, or a telescoping mechanism. Any joining or fastening mechanism that results in the rigid rod 110 being able to withstand the longitudinal forces expected to be applied by users may be used to join the first and second portions 109A, 109B together when the rigid rod 110 comprises two or more portions. Moreover, although FIG. 2A illustrates the rigid rod 110 having two portions (portions 109A and 109B), the rigid rod 110 may be separable into more than two portions.

Figure 2B:
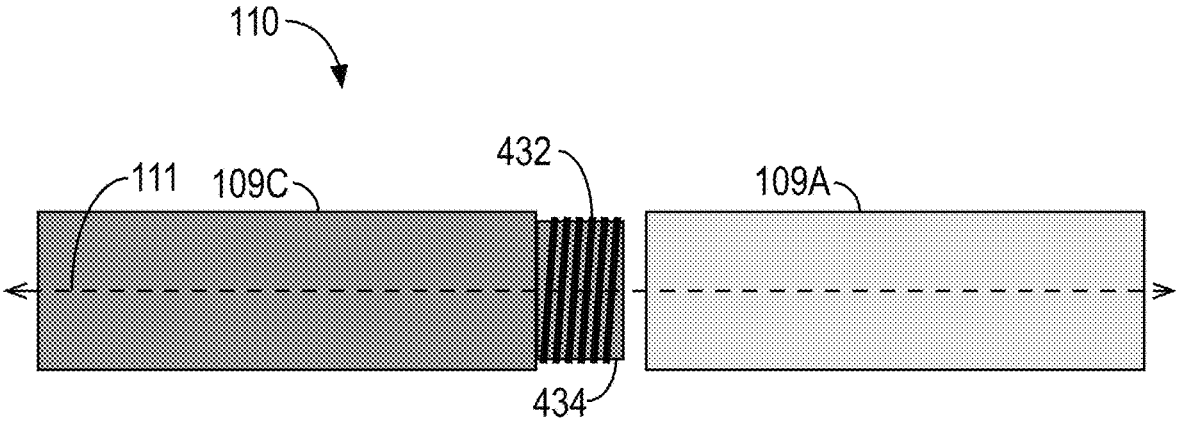

As described below, a portion of the rigid rod 110 may house certain electronic components. In some embodiments in which the rigid rod 110 comprises a first portion 109A and a second portion 109B, such as the rigid rod 110 embodiment illustrated in FIG. 2A, the electronic components of in the rigid rod 110 are housed entirely in the first portion 109A or entirely in the second portion 109B. Without loss of generality, assume that the rigid rod 110 is separable into two portions, and all electronic components housed in the rigid rod 110 are housed in the first portion 109A. In such embodiments, a user may exchange the original second portion 109B for a different second portion 109C, as illustrated in FIG. 2B. The different second portion 109C may have one or more characteristics that differ from the respective characteristics of the original second portion 109B. For example, the different second portion 109C may have a different length, a different circumference 115, or a different weight, or it may be made of a different material than the original second portion 109B, or it may include different grips, attachments, or grip material than the original second portion 109B, etc. Alternatively, or in addition, the different second portion 109C may differ from the original second portion 109B in some cosmetic way (e.g., it may be a different color or include different branding (e.g., a logo, printing, etc.)).

Referring again to FIG. 1A, the base 120 has a nominal length 117 in the absence of a longitudinal force. The length 117 of the base 120 may remain constant in the presence of longitudinal forces, or it may decrease temporarily in the presence of a compressive longitudinal force and/or increase temporarily in the presence of an expansive longitudinal force. In some embodiments, the base 120 is made of or comprises a flexible or compressible material (e.g., silicone, a soft rubber, thermoplastic polyurethane (TPU), a thermoplastic elastomer (TPE), foam, a low-durometer plastic or rubber, felt, a spring, etc.), and the length 117 of the base 120 temporarily increases or decreases while the exercise device 100 is subjected to, respectively, expansive or compressive longitudinal forces. In other embodiments, the base 120 is made of a rigid, inflexible, hardened, or substantially incompressible material (e.g., hardened rubber, a strong elastomer, ebonite, polycarbonate acrylonitrile butadiene styrene (PC-ABS), nylon, Delrin, glass-reinforced plastic, carbon-reinforced plastic, high-impact resin, polycarbonate, acrylic, polypropylene, PVC, cork, wood, bamboo, metal, aluminum, steel, etc.), and the length 117 of the base 120 does not change substantially in the presence of compressive or expansive longitudinal forces. In some embodiments, such as the exemplary embodiment illustrated in FIGS. 15A-15C below, the length 117 of the base 120 (shown as an end cap 300) decreases in the presence of compressive longitudinal forces but does not change in the presence of expansive longitudinal forces.

The base 120 may have any size and shape conducive to a user performing exercises using the exercise device 100. In some embodiments, the base 120 has a circumference 122 that is larger than the circumference 115 of the rigid rod 110. FIGS. 1A-1C, among others, illustrate such an embodiment. In other embodiments, the base 120 has a circumference 122 that is smaller than the circumference 115 of the rigid rod 110. In still other embodiments, the base 120 has a circumference 122 that is equal to the circumference 115 of the rigid rod 110. In some embodiments, the base 120 does not have a uniform circumference 122 along its entire length 117.

Figure 3A:
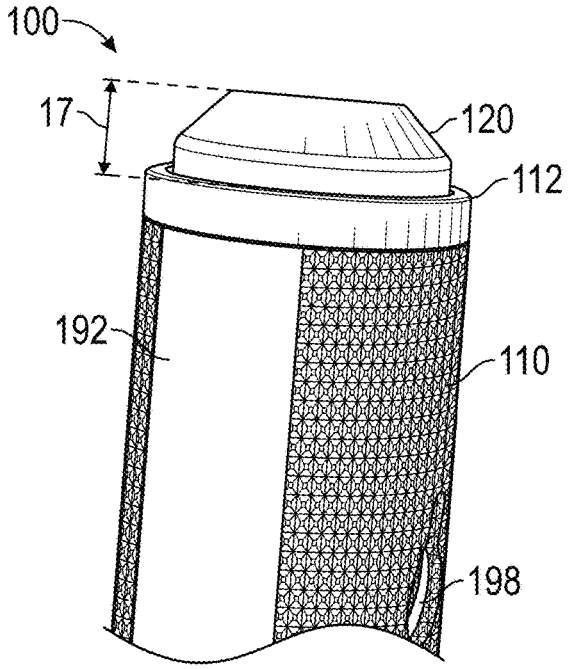
FIGS. 3A, 3B, 3C, and 3D illustrate exemplary bases in accordance with some embodiments.
Figure 3B:
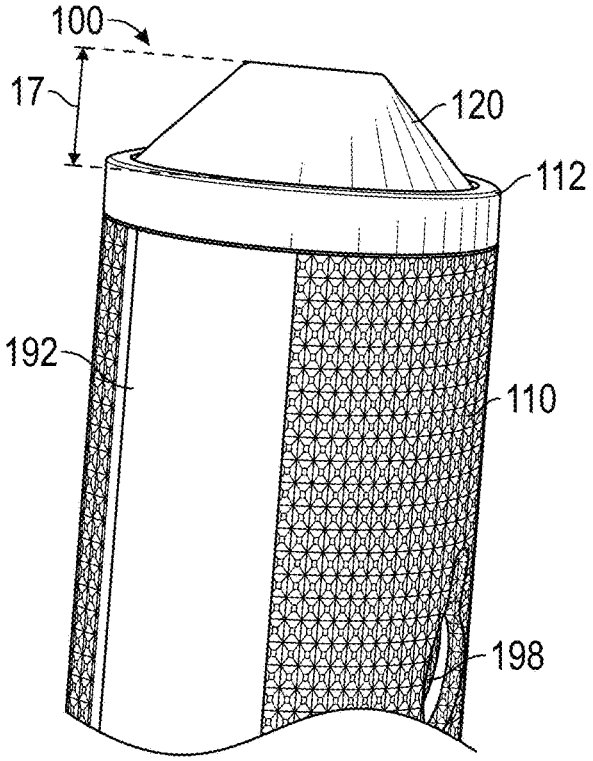
Figure 3C:
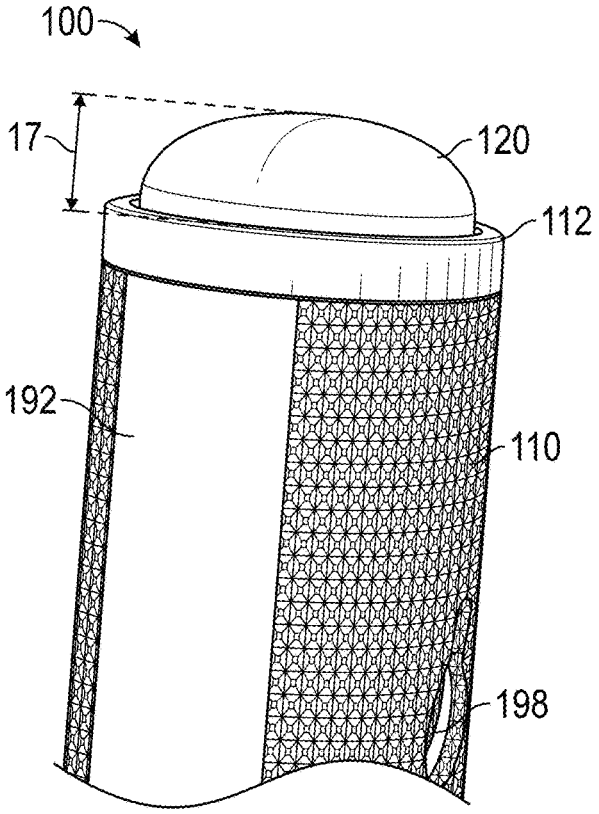
Figure 3D:
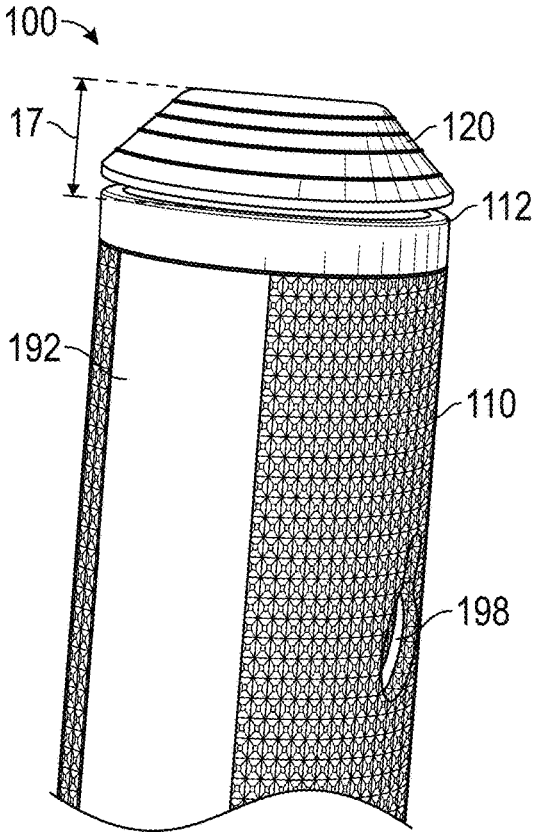

FIGS. 3A-3D illustrate several exemplary bases 120 having different shapes and sizes. In FIG. 3A, the base 120 is cylindrical along a portion of its length 117 and tapers inward along another portion of the length 117. In FIG. 3B, the base 120 is tapered along its entire length 117. In FIG. 3C, the base 120 has a hemispherical or domed shape. Each of the exemplary bases 120 shown in FIGS. 3A-3C has a maximum circumference 122 value that is smaller than the circumference 115 of the rigid rod 110 and, therefore, may be entirely outside of the rigid rod 110 or may be set within a hollow portion of the rigid rod 110 near the first end 112. FIG. 3D illustrates an embodiment in which the base 120 is tapered along its length 117 and includes rings that protrude slightly from its side surface, which may help to hold the base 120 in place when the exercise device 100 is placed in a position in which the side of the base 120 is in contact with a surface (e.g., as in FIGS. 4A and 4B). The maximum circumference 122 of the base 120 of the embodiment in FIG. 3D is approximately the same as the circumference 115 of the rigid rod 110. Although FIGS. 3A-3D illustrate bases 120 having a shapes that, in a cross-section taken perpendicular to the longitudinal axis 111, are similar to the shape of a cross-section of the rigid rod 110 taken perpendicular to the longitudinal axis 111, the base 120 need not have such similarity to the rigid rod 110. The base 120 may have any size, shape, and weight conducive to a user performing exercises with the exercise device 100.

The base 120 may be made of or coated with a material that assists a user in holding the base 120 against a surface when the user applies a compressive longitudinal force. For example, the base 120 may be made of or coated with a material that has a high coefficient of friction. Examples of such materials include, but are not limited to, rubber, grip tape, fabric, foam, wax, spray grip material, stamping, soft elastomer, Egrips® material, or a 3M™ Gripping Material product. The base 120 may also include a suction mechanism (e.g., a suction cup, etc.) to assist a user in holding the base 120 against a surface. As another example, the base 120 may include a magnet to facilitate a user holding the exercise device 100 against a metal object or surface. As another example, the base 120 or the rigid rod 110 may include a feature that enables the exercise device to be positioned within a receptacle or cup (e.g., using a fastener, strap, etc.) to hold the exercise device 100 in place while the user exercises. FIGS. 12A-12B, 13A-13C, 14A-14B, and 15A-15C, discussed below, illustrate several ways in which the exercise device 100 may be attached to a surface or object.

In some embodiments, the weight of the base 120 is less than or is not substantially greater than the weight of the rigid rod 110. In other embodiments, the weight of the base 120 is substantially greater than the weight of the rigid rod 110 to increase the effort required for a user to hold the exercise device 100 in a desired position (e.g., substantially horizontally against a vertical surface, or substantially vertically with the base 120 held against a ceiling, etc.), or to enable the user to use the exercise device 100 as a mace ball. In some embodiments, at least a portion of the exercise device 100 (e.g., the base 120) is hardened or reinforced (e.g., is surrounded by or comprises hardened rubber or the like) to allow the user to grasp the rigid rod 110 and swing the exercise device 100 with the objective of hitting other objects (e.g., the ground, a tire, a heavy bag, etc.) with the base 120 of the exercise device 100.

Figure 19A:
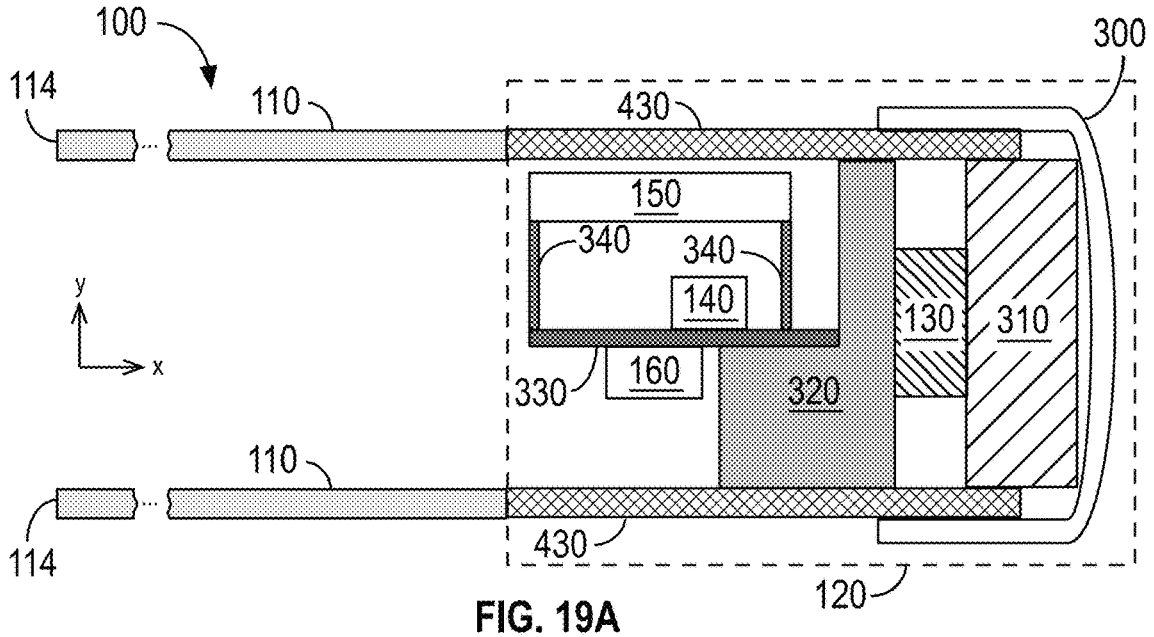
FIGS. 19A, 19B, and 19C illustrate an exemplary exercise device having a separable base and rigid rod in accordance with some embodiments.
Figure 19B:
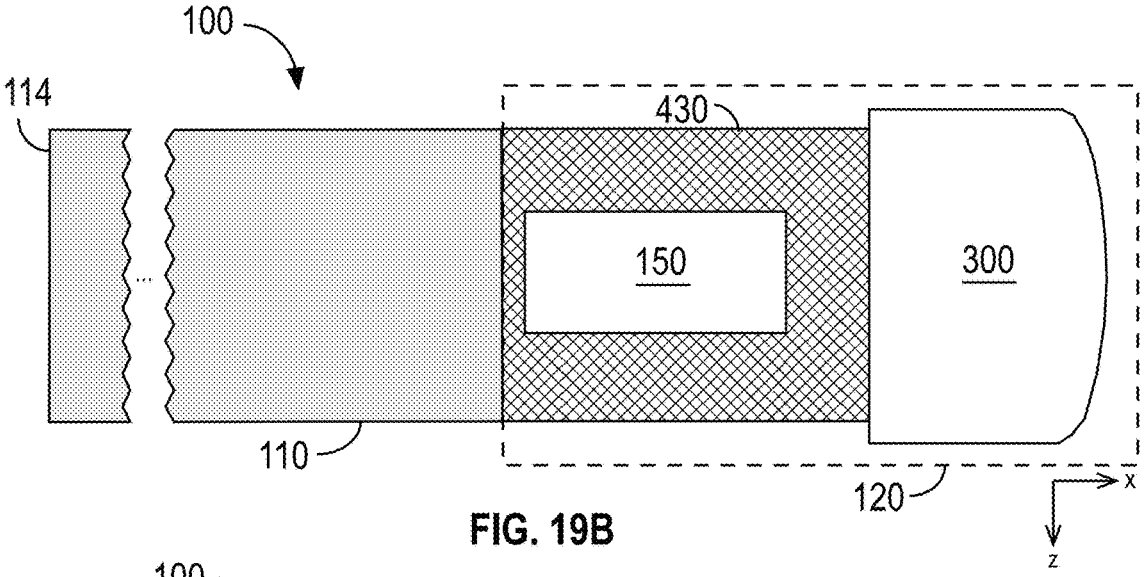
Figure 19C:
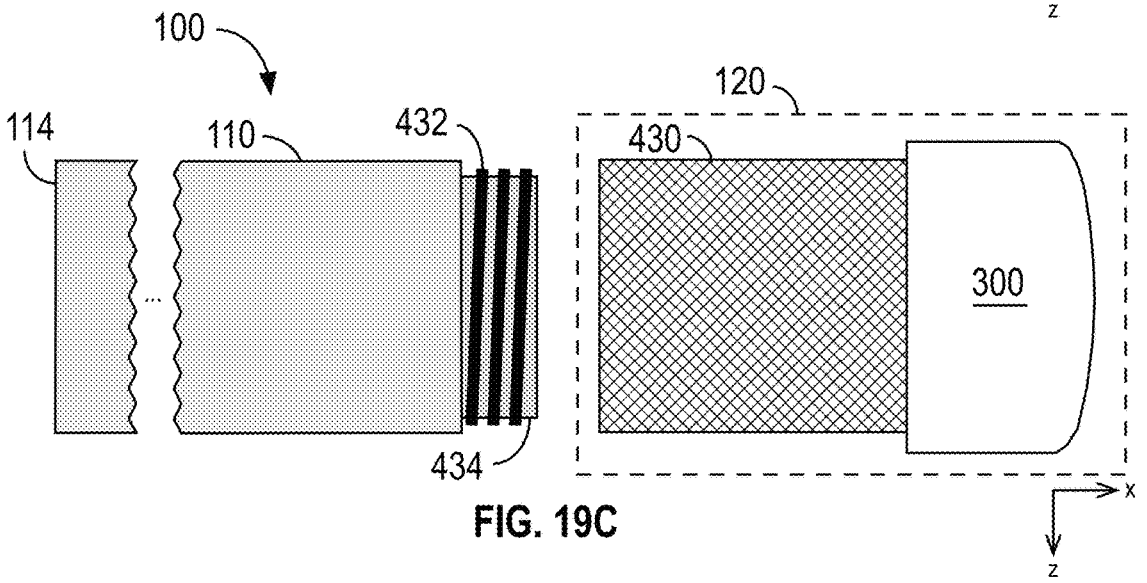

The base 120 may be permanently coupled to the rigid rod 110, or it may be separable from the rigid rod 110. In embodiments in which the base 120 is separable from the rigid rod 110, users of the exercise device 100 may interchange rigid rods 110 or bases 120. For example, a user may remove a first rigid rod 110 from the base 120 and then couple the base 120 to a second rigid rod 110 having at least one different property (e.g., a longer or shorter length 116, a different weight, a difference circumference 115, a different shape or form factor, different hand grips, a different material, different electronics, etc.). The first and second rigid rods 110 may comprise multiple portions, as described above in the context of FIGS. 2A and 2B. Alternatively, a user may remove a first base 120 from the rigid rod 110 and couple the rigid rod 110 to a second base 120 that has at least one different property (e.g., material, weight, durability, electronics, etc.) from the first base 120. FIGS. 19A through 19C, discussed below, illustrate an exemplary exercise device 100 in which the rigid rod 110 and base 120 are separable.

To enable the exercise device 100 to be secured to a surface or object so that the user may perform exercises that include expansive longitudinal forces, the base 120 or the rigid rod 110 may include one or more cavities, holes, or protrusions that facilitate securing the exercise device 100 to an attachment or to a surface (e.g., a wall, a door, a ceiling, a doorframe, a heavy piece of furniture, etc.). For example, the exercise device 100 may include at least one pin or post, SNAP™ fastener, mushroom-shaped post, T-shaped post or rod, hook and loop, ring, D-ring, eyelet, carabiner, clamp, clasp, etc. protruding from the rigid rod 110 or the base 120, to which an attachment enabling the exercise device 100 to be secured to a surface may be attached. As another example, the exercise device 100 may be configured to receive a cap that screws on or attaches to the outside of the rigid rod 110 or the base 120. As another example, the exercise device may include a pass-through channel through the rigid rod 110 or the base 120 through which a pin of an attachment may be passed. Another portion of the attachment may then secure the exercise device 100 to a surface. As yet another example, the rigid rod 110 or the base 120 may include holes into which one or more fasteners of an attachment may be positioned and secured. FIGS. 12A-12B, 13A-13C, 14A-14B, and 15A-15C, discussed below, illustrate several ways an attachment may be coupled to the exercise device 100 to enable the exercise device 100 to be secured to a surface or object so that the user may perform exercises that include expansive longitudinal forces.

Figure 4B:
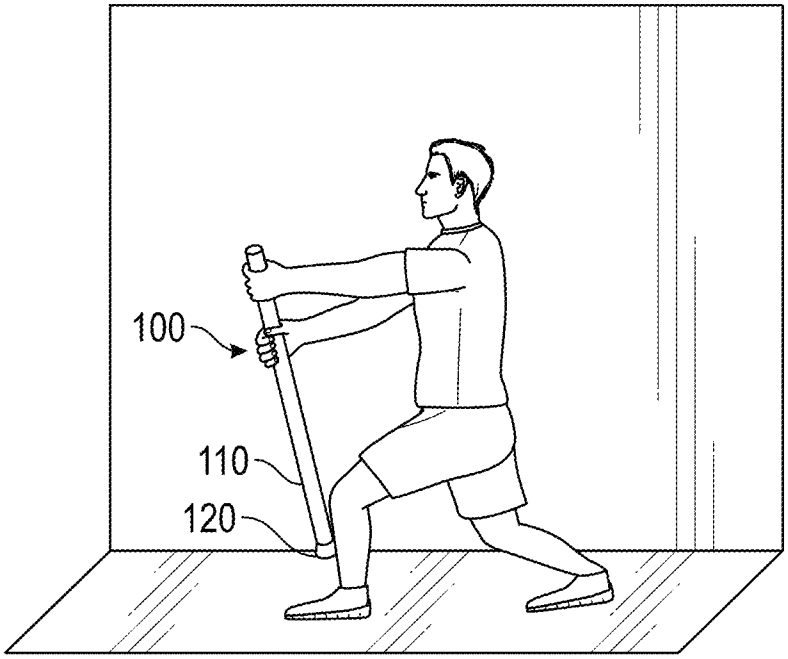
FIGS. 4A and 4B illustrate a user performing an exercise using an exemplary embodiment of an exercise device.
Figure 4A:
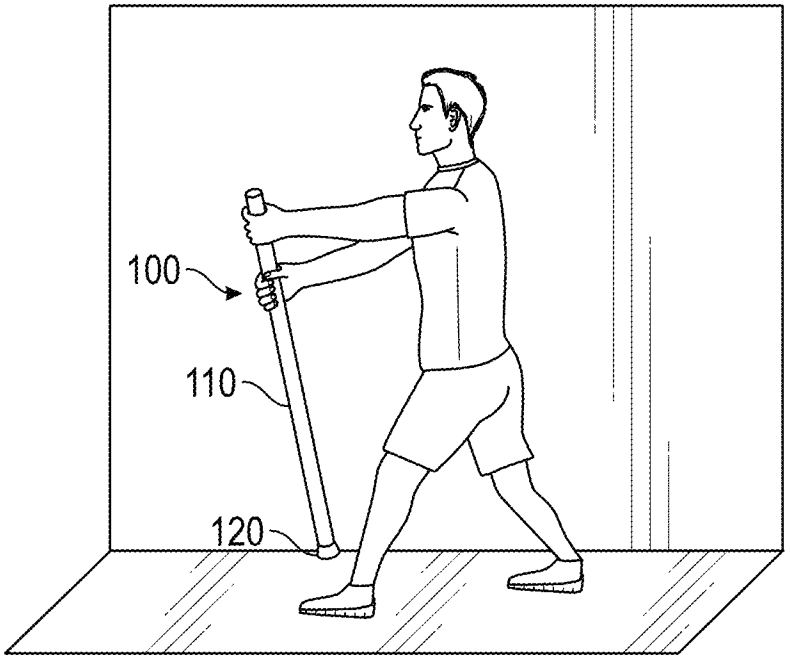

A user may perform various exercises using the exercise device 100. As just one of many possible examples, as illustrated in FIGS. 4A and 4B, a user may perform a lunge having both isotonic and isometric components using the exercise device 100. As shown in FIG. 4A, the user begins by standing on a floor adjacent to a wall while grasping the rigid rod 110 and positioning the exercise device 100 so that the base 120 is situated near where the wall and the floor meet. In FIGS. 4A and 4B, the user is shown holding the exercise device 100 so that the base 120 is wedged between the wall and the floor, but it is to be understood that the user could alternatively hold the exercise device 100 so that the base 120 is, for example, higher and in contact with only the wall (e.g., the user could hold the exercise device 100 substantially horizontally), or so that the exercise device 100 is substantially vertical and the base 120 is in contact only with the floor or the ceiling (not shown). In some embodiments, the wall and/or floor (or any other surface, such as a door, a door frame, a ceiling, a window, a piece of furniture, etc.) includes or has attached thereto a notch or receptacle into which the user may insert the base 120 to prevent the base 120 from moving appreciably while the user performs the exercise. If present, this notch or receptacle may also hold the exercise device 100 in place to enable the user to perform exercises involving expansive longitudinal forces in addition to exercises involving compressive longitudinal forces (such as the lunge exercise depicted in FIGS. 4A and 4B). In addition, or alternatively, the base 120 may be made of or coated with a material that reduces the likelihood that the exercise device 100, once placed against a surface, will slip out of position when the user applies a longitudinal force.

The user may perform an exercise having both isotonic and isometric components by performing a lunge while holding the exercise device 100 in situ, as shown in FIG. 4B, and applying a compressive longitudinal force. The user may then hold the down lunge position for some period of time as shown in FIG. 4B while simultaneously continuing to apply a compressive longitudinal force, thereby continuing to press the exercise device 100 into the wall and the floor. After a desired period of time during which the user continues to hold the down lunge position while applying a compressive longitudinal force, the user returns to the starting position shown in FIG. 4A and reduces the longitudinal force applied to the exercise device 100. The user may then repeat the sequence to perform a set of lunges having both isotonic and isometric components.

Figure 5B:
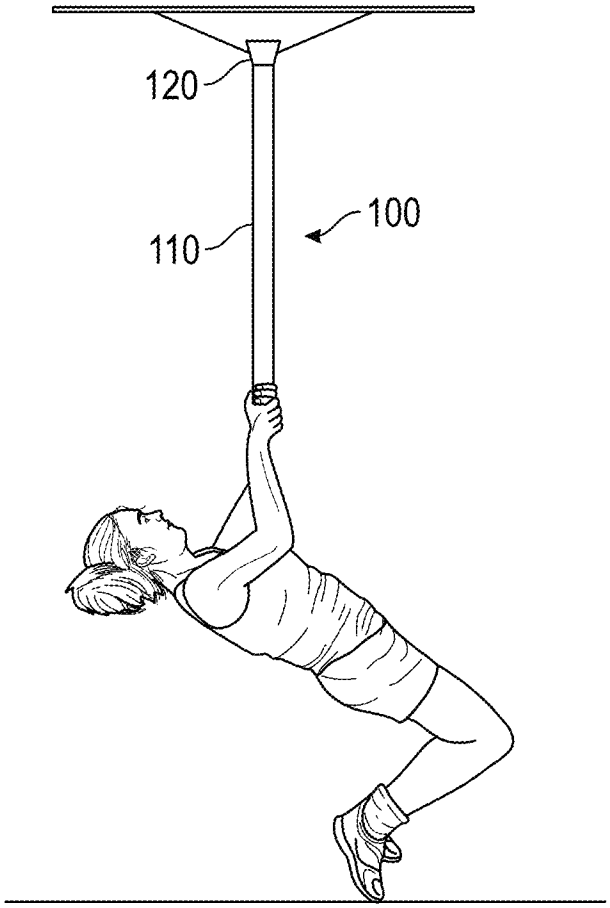
FIGS. 5A and 5B illustrate a user performing an exercise using an exemplary embodiment of an exercise device.
Figure 5A:
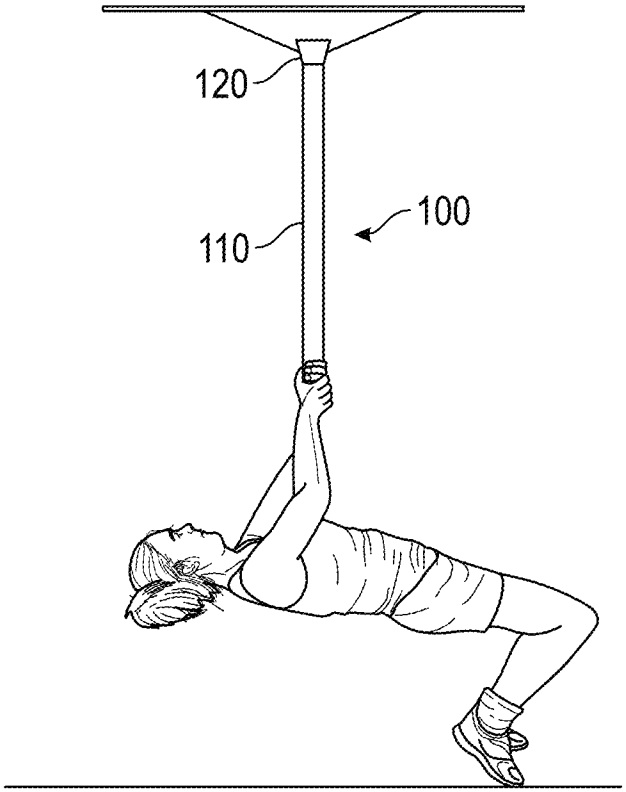

In addition to performing exercises involving compressive longitudinal forces, such as in the example presented in the discussion of FIGS. 4A and 4B, users may also perform exercises involving expansive longitudinal forces using the exercise device 100. FIGS. 5A and 5B illustrate one possible exercise in which a user applies an expansive longitudinal force to the exercise device 100 by performing a type of pull-up. As shown in FIGS. 5A and 5B, the exercise device 100 may be secured to a horizontal surface (e.g., a ceiling, a door frame, etc.) so that the exercise device 100 hangs substantially vertically from the horizontal surface. When secured to a horizontal surface as shown in FIGS. 5A and 5B, the exercise device 100 may hang so that the exercise device 100 can swing or move laterally, or the exercise device 100 may be mounted to the horizontal surface in a more secure manner to prevent or mitigate lateral movement of the exercise device 100. FIGS. 5A and 5B illustrate the exercise device 100 being secured to the horizontal surface by the base 120, but it is to be appreciated that, as explained below, the exercise device 100 may secured to the horizontal surface in any manner that enables the user to perform an exercise involving an expansive longitudinal force. For example, the exercise device 100 may be secured to the vertical surface from the rigid rod 110 close to the base 120, near the second end 114, or at any other convenient point.

The user may perform an exercise having both isotonic and isometric components by performing a pull-up while applying an expansive longitudinal force. FIG. 5A shows the user in a starting position in which the user grasps the rigid rod 110 and positions her feet so that she can lean back as shown while holding onto the rigid rod 110 of the exercise device 100 to prevent herself from falling. As shown in FIG. 5A, the user's arms are substantially straight. The user then pulls herself up to a more vertical position, as shown in FIG. 5B, by engaging, among others, her core and biceps muscles. The user may then hold the position shown in FIG. 5B for a period of time to perform an isometric phase of the exercise. After a desired period of time during which the user continues to hold the position shown in FIG. 5B while grasping the rigid rod 110 and applying an expansive longitudinal force to the exercise device 100, the user returns to the starting position shown in FIG. 5A. The user may then repeat the sequence to perform a set of pull-ups having both isotonic and isometric components.

It is to be understood that the lunge and pull-up exercises described above are only two examples of the many types of exercises that users may perform using the exercise device 100. As will be appreciated in view of the disclosures herein, there are virtually limitless exercises possible with the exercise device 100, including exercises that require users to apply, at different times, compressive or expansive longitudinal forces.

Although a user may perform effective exercises having isotonic and/or isometric phases or components using an exercise device 100 comprising only a rigid rod 110 and a base 120, users, physical therapists, and personal trainers may benefit significantly by being able to quantify and access information associated with users' workouts and/or program the exercise device 100 to assist a user to perform a workout. Therefore, as described below, in some embodiments the exercise device 100 includes one or more components that measure and provide information about an exercise. In some embodiments, these one or more components also provide guidance to assist the user to perform exercises or workouts. The exercise device 100 may have any of several exemplary hardware configurations to enable the exercise device 100 to detect compressive and/or expansive longitudinal forces.

FIG. 6A is an exemplary block diagram 200A illustrating certain electronic components of the exercise device 100 in accordance with some embodiments. As illustrated in FIG. 6A, the exercise device 100 includes at least one load sensor 130 coupled to a processor 140 and to a power supply 160. The processor 140 is also coupled to the power supply 160. The processor 140 may also be coupled to an optional display 150 and/or an optional external memory 142. The dashed lines in FIG. 6A indicate that both the display 150 and external memory 142 are optional. If present, the display 150 and external memory 142 are also coupled to the power supply 160. As explained below, the components shown in the block diagram 200A may be situated within the exercise device 100 in many different configurations.

The power supply 160 provides power to the at least one load sensor 130 and processor 140, and, if present, the display 150 and external memory 142. In some embodiments, the power supply 160 is a battery, such as, for example, a rechargeable battery. In some embodiments including a rechargeable battery as the power supply 160, the rechargeable battery may be recharged without being removed from the exercise device 100. In some such embodiments, the exercise device 100 includes a port that enables the rechargeable battery to be recharged. For example, the rechargeable battery may be charged through any suitable port, such as, for example, a USB port (e.g., USB-A, USB-C, mini-USB, micro-USB, etc.), an audio jack, a DC barrel jack (e.g., a port having a 5.5 mm barrel and a 2.1 mm center pole), a blade connector, or a proprietary type of jack (e.g., Thunderbolt™). In other embodiments in which the power supply 160 is a rechargeable battery, the battery may be recharged wirelessly or using inductive technology, without use of a physical connection (e.g., using electromagnetic fields to transfer power from a transmitting source to the rechargeable battery to charge or recharge the battery). For example, the rechargeable battery may be recharged using a contact charger (e.g., a circular contact charger) that includes pogo pins, leaf springs, etc. The charging base may include a magnetic retention mechanism to hold the exercise device 100 in place while the battery recharges.

The at least one load sensor 130 detects longitudinal forces applied to the exercise device 100. In some embodiments, as will be discussed below, a compressive longitudinal force causes at least some portion of the exercise device 100 to move or compress, and the at least load sensor 130 senses this movement or compression. In some embodiments, as will be discussed below, an expansive longitudinal force causes at least some portion of the exercise device 100 to move, stretch, or expand, and the at least one load sensor 130 senses this movement, stretching, or expansion.

The at least one load sensor 130 may include only one load sensor, or it may include multiple load sensors 130. In embodiments including only one load sensor 130, that single load sensor 130 may be capable of detecting both compressive and expansive longitudinal forces. In embodiments including multiple load sensors 130, a subset of load sensors 130 may be used to detect compressive longitudinal forces, and another subset of load sensors 130 may be used to detect expansive longitudinal forces. In some embodiments, described below, a first load sensor 130A senses compressive longitudinal forces, and a second load sensor 130B senses expansive longitudinal forces. Alternatively, when the exercise device 100 includes multiple load sensors 130, all load sensors 130 may be used to detect both compressive and expansive longitudinal forces.

In some embodiments, the at least one load sensor 130 comprises at least one strain gauge that is deformed by the longitudinal force, and the amount of deformation is measured as a change in electrical resistance. As would be understood by a person having ordinary skill in the art, a strain gauge is a device having an electrical resistance that varies in proportion to the amount of strain in the device. The strain gauge deforms, stretches, or contracts when the material of the at least one load sensor 130 deforms, and the change in resistance causes an electrical signal having a magnitude that is proportional to the force applied to the at least one load sensor 130. An example of a strain gauge is a bonded metallic strain gauge.

In some embodiments, the at least one load sensor 130 comprises at least one strain gauge in a Wheatstone bridge configuration. As would be understood by a person having ordinary skill in the art, a classic Wheatstone bridge has four resistive arms and an excitation voltage applied across the bridge. The bridge is balanced when the four resistive arms have resistance values that result in the output voltage being zero. Any change in the resistance of one of the arms causes the output voltage to be nonzero. By replacing one of the arms of the Wheatstone bridge with a strain gauge in what is known in the art as a "quarter-bridge" configuration, any change in the resistance of the strain gauge will unbalance the bridge and cause the output voltage to be nonzero.

In some embodiments, the at least one load sensor 130 comprises two or more strain gauges arranged in a Wheatstone bridge configuration. As would also be understood by a person having ordinary skill in the art, to reduce the sensitivity of the Wheatstone bridge to temperature variations, load sensors often include two strain gauges in the bridge in what is known in the art as a "half-bridge" configuration. Furthermore, the Wheatstone bridge may include four strain gauges in what is known in the art as a "full-bridge" configuration, in which first and second strain gauges are in tension, and third and fourth strain gauges are in compression. It is to be understood that the at least one load sensor 130 may include any load sensor that is capable of detecting a compressive or expansive longitudinal force applied to the exercise device 100. The examples of Wheatstone bridge configurations are not intended to be limiting.

The processor 140 may be a general-purpose processor that executes machine-executable instructions to perform specified operations. For example, the processor 140 may be a microcontroller, a microprocessor, a digital signal processor, or the like. Alternatively, the processor 140 may be an application-specific integrated circuit (ASIC) that performs the desired operations. The processor 140 may include on-board memory for storing instructions or data. The exercise device 100 may include a port through which the processor 140 may be programmed or configured, or through which software or firmware for the processor 140 may be provided. The processor 140 may also be able to send data, signals, or information out of the exercise device 100 through the port. In some embodiments in which the power supply 160 is a rechargeable battery, a single port (e.g., a USB port, a serial port, etc.) both enables access to the processor 140 (e.g., for programming, configuration, data transfer into and/or out of the exercise device 100, and/or software and/or firmware updates) and allows the rechargeable battery to be charged. In other embodiments in which the power supply 160 is a rechargeable battery, a port enables access to the processor 140, and the rechargeable battery is charged or recharged wirelessly or inductively as described above. In other embodiments, different ports are included for charging the rechargeable battery and for communicating with the processor 140. Examples of suitable data ports for communicating with the processor 140 include both wired (e.g., Ethernet, USB, serial, etc.) and wireless (e.g., infrared, near-field communication, Wi-Fi, or any other suitable wireless protocol).

If present, the external memory 142 may be any type of memory that stores instructions (e.g., for the processor 140), data (e.g., information recorded during a user's workout, information used to guide a user through a workout (such as the force profiles discussed below), etc.), or both. For example, the external memory 142 may be an EPROM, EEPROM, random-access memory (RAM), non-volatile RAM, or any other type of memory. The external memory 142 may be of a type that maintains the stored information in the absence of power supplied to the memory 142 (e.g., non-volatile memory), or the external memory 142 may be volatile and capable of storing information only when powered. The processor 140 may store data gathered during a user's workout in the external memory 142. For example, the processor 140 may store measurements of longitudinal forces detected by the at least one load sensor 130 in the external memory 142. Likewise, the processor 140 may retrieve information from the external memory 142 to generate signals to guide a user or to provide feedback to the user during the workout.

In some embodiments, before a user begins a workout or an exercise, the processor 140 performs a calibration procedure. The processor 140 may initiate the calibration procedure automatically whenever the exercise device 100 is activated, or a user may initiate the calibration procedure. In some embodiments, the processor 140 performs the calibration procedure by detecting a baseline signal from the at least one load sensor 130 when the exercise device 100 is in a particular position (e.g., such that the rigid rod 110 is vertical and the base 120 is resting on a horizontal surface but without any user-applied pressure, or such that the base 120 is not in contact with any object or surface). The processor 140 may then adjust future received force signals based on the baseline signal. For example, if, when the calibration procedure is performed, the processor 140 receives a signal representing 0.1 lb, and during an exercise the processor 140 receives a signal representing 10 lbs, the processor 140 subtracts 0.1 lb to obtain the applied force caused by the user.

Figure 8:
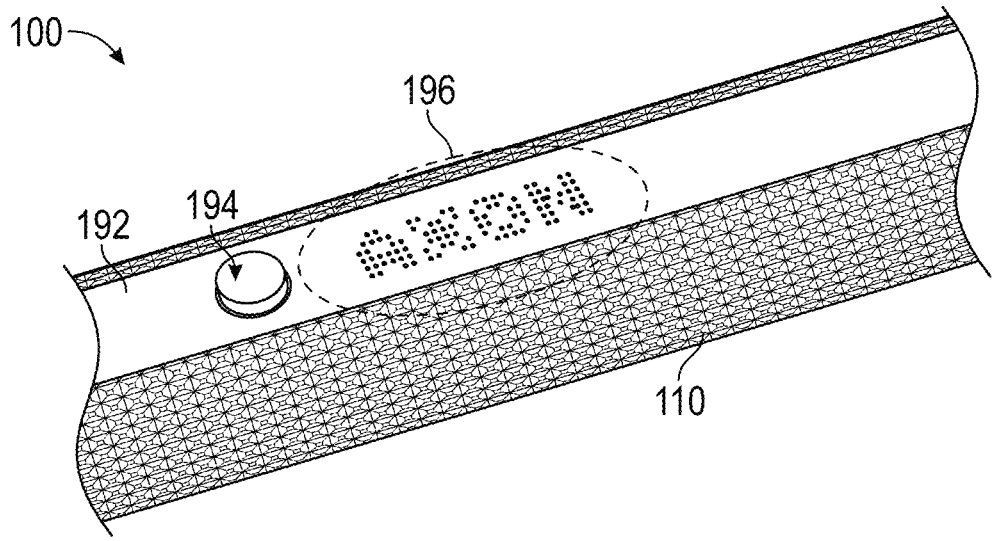
FIG. 8 shows a portion of an exercise device in accordance with some embodiments.

One of the benefits of the exercise device 100 is its ability to capture information about a user's workout, such as, by way of example and not limitation, a number of repetitions performed, an amount of time per repetition, an amount of time spent on a workout, or a measure of the compressive or expansive longitudinal force applied by the user. Thus, in some embodiments, the exercise device 100 includes an on-board display 150, which may be any hardware capable of presenting information to the user of the exercise device 100. For example, the display 150 may be a graphical display or an alphanumeric display. The display 150 may be, for example, an LCD or LED display, a touchscreen, or an LED array. FIG. 8 illustrates an embodiment of the exercise device 100 in which the display 150 comprises an array of light sources 196 (e.g., LEDs arranged in a rectangular pattern of rows and columns). The array of light sources 196 may be capable of presenting alphanumeric characters (as shown in FIG. 8) and/or graphics (e.g., icons, graphs, bars, etc.) to provide information. The information presented to the user of the exercise device 100 may include any information that might be of interest to the user. For example, the information presented to the user of the exercise device 100 may include information about a type of exercise, a number of repetitions performed, an amount of longitudinal force applied, whether the longitudinal force was compressive or expansive, an amount of time during which a longitudinal force was applied by the user, a status (e.g., battery level if the power supply 160 is a battery, amount of memory 142 used or remaining if the exercise device 100 includes the memory 142, etc.), or any other information available to the exercise device 100.

In some embodiments, the display 150 is part of a user interface that enables the user not only to view information, but also to enter information. The user interface may be capable of accepting a variety of information useful to the user or to the exercise device 100. For example, the information may include a password (e.g., for a Wi-Fi network, or to allow access to data stored in the exercise device 100, etc.) or information that allows the exercise device 100 to be configured (e.g., for a desired number of exercises or a particular type of exercise, etc.) or customized (e.g., based on the user's name, age, height, weight, gender, level of fitness, location, time since last workout, etc.). In some embodiments, the exercise device 100 is capable of accepting information that enables the user to customize at least some characteristic of a visual indicator, discussed below, that provides guidance and/or feedback to the user during a workout. This information may be entered by the user through a user interface, if present.

As indicated by the arrows shown in FIG. 6A, the processor 140 may communicate with the at least one load sensor 130, and, if present, with the display 150 and/or external memory 142. In some embodiments, the at least one load sensor 130 generates an electrical signal whenever the user applies a longitudinal force (compressive or expansive) to the exercise device 100 and provides this signal to the processor 140. As shown in FIG. 6B, an amplifier 132 and an analog-to-digital converter (ADC) 134 may be disposed between the at least one load sensor 130 and the processor 140. If present, the amplifier 132 amplifies the analog signal generated by the at least one load sensor 130 before providing it to the ADC 134. In turn, the ADC 134 converts the amplified analog signal to a digital signal and provides the digital signal to the processor 140. The processor 140 determines one or more desired metrics based on the signal generated by the at least one load sensor 130 (possibly using, as explained above, an amplified and digitized version of the signal generated by the at least one load sensor 130), which may include, by way of example and not limitation, an indication of the amount of longitudinal force applied by the user (in some embodiments, as a function of time), the amount of time a particular amount of force was applied, a number of repetitions performed, etc. If the at least one load sensor 130 includes multiple load sensors 130, the exercise device 100 may include additional amplifiers 132 and/or ADCs 134.

In some embodiments in which the exercise device 100 includes a display 150, the processor 140 causes the display 150 to present information about the applied longitudinal force and/or the exercise performed by the user. For example, the processor 140 may cause the display 150 to present an indication (e.g., text, a graphic, a chart, an icon, etc.) of a number of repetitions performed by the user, a raw or average longitudinal force applied per repetition, a total amount of longitudinal force applied for a set of repetitions, a time over which each repetition or set of repetitions was performed, an amount of time during which the longitudinal force applied exceeded some threshold force, a time under tension, or other information available to the processor 140.

As used herein, the term "time under tension" refers to a metric that is the integral of longitudinal force over a period of time. The units of time under tension are units of force multiplied by units of time (e.g., pound-seconds, pound-milliseconds, pound-hours, kilogram-seconds, kilogram-hours, etc.). To illustrate, FIG. 7A shows an exemplary plot of the longitudinal force, in pounds, applied by a user of the exercise device 100 as a function of time, in seconds. The time under tension, in pound-seconds, is the area under the piece-wise solid line.

Because the direction of a compressive longitudinal force is opposite the direction of an expansive longitudinal force, it may be desirable in plots such as the one shown in FIG. 7A to designate that one of the two types of forces is represented by positive force values, and the other by negative force values. The assignment is arbitrary; thus, without loss of generality, it is assumed herein that positive force values represent compressive longitudinal forces and negative force values represent expansive longitudinal forces. With this convention, because FIG. 7A plots only positive values of longitudinal force, it represents a workout involving only compressive longitudinal forces (e.g., a workout comprising the lunge exercise discussed in the context of FIGS. 4A and 4B, as just one example).

FIG. 7B is an exemplary plot of the longitudinal force, in pounds, applied by a user of the exercise device 100 as a function of time, in seconds, for a set of exercises that includes both compressive and expansive longitudinal forces. FIG. 7B is identical to FIG. 7A between t=0 and t3 and between t=t6 and t9. Between t=t3 and t6, however, the longitudinal force is negative, indicating (using the convention established above) that the force applied from t=t3 to t6 is an expansive longitudinal force. By inspection of FIG. 7B, one can see that if a set of exercises includes both compressive and expansive longitudinal forces, a measure of time under tension determined simply by integrating the longitudinal force over time will provide an inaccurate view of the forces applied by the user because the components of the integral corresponding to the expansive longitudinal forces will be negative and will at least partially cancel or be canceled by the components of the integral corresponding to the compressive longitudinal forces. There are at least two solutions to this problem. One solution is to determine (e.g., compute) the time under tension for an exercise, set of exercises, or workout based on the absolute value of the longitudinal force. In other words, the signs of expansive force values are changed from negative to positive, and the total time under tension is determined without regard to whether the longitudinal force is compressive or expansive. Another solution is to track time under tension separately for compressive longitudinal forces and for expansive longitudinal forces. In other words, one integral representing compressive time under tension may be determined based only on values of the longitudinal force that are greater than zero, and a second integral representing expansive time under tension may be determined based only on values of the longitudinal force that are less than zero. Using this approach, the time under tension may be presented to the user separately for compressive and expansive longitudinal forces (e.g., "Your pushing (compressive) time under tension is X, and your pulling (expansive) time under tension is Y"). If desired, the compressive and expansive time under tension components may be combined in some manner to provide the user with a total time under tension. For example, the absolute values of the compressive and expansive times under tension may be added together. As another example, the composite time under tension may be computed as the square root of the sum of the squares of the compressive and expansive times under tension.

The processor 140 may determine the time under tension using any convenient algorithm. For example, the processor 140 may use numerical integration to compute the time under tension. Numerical integration techniques are known in the art. They include, for example, methods that determine a weighted sum of evaluations of the integrand, evaluated at a finite set of integration points, to obtain an approximation of the integral. If the integrand is well-behaved (e.g., it is piecewise-continuous and of bounded variation), numerical integration may be achieved using small increments. In some embodiments, the time under tension is determined based on a sequence of longitudinal force measurements taken at discrete, known times. The time under tension may be determined by weighting each longitudinal force measurement by the time interval between it and the next or previous longitudinal force measurement.

Returning again to FIG. 7A, because the function shown is a piecewise-linear function, the time under tension may be computed using simple calculations of the areas of rectangles and triangles. The time under tension is the sum of the areas of the various rectangles and triangles into which the area under the function may be partitioned and is given by: $TUT=0.5\times[t1\times f1+(t3-t2)\times f1+(t4-t3)\times f2+(t5-t4)\times(f3-f2)+(t6-t5)\times f3+(t7-t6)\times f2+(t8-t7)\times(f2-f1)+(t9-t8)\times f1]+(t2-t1)\times f1+(t5-t4)\times f2+(t8-t7)\times f1$. The function shown in FIG. 7B is also a piecewise-linear function. Again, using the convention that compressive longitudinal forces are positive and expansive longitudinal forces are negative, the compressive time under tension is given by $TUT_c=0.5\times[t1\times f1+(t3-t2)\times f1+(t7-t6)\times f2+(t8-t7)\times(f2-f1)+(t9-t8)\times f1]+$ (t2−t1)×f1+(t8−t7)×f1. The expansive time under tension is given by TUT_e=0.5×[(t4−t3)×(—f3)+(t5−t4)×(—f4+f3)+(t6−t5)×(—f4)]+(t5−t4)×(—f3). It is easy to verify that TUT_c is a positive value, and the value of TUT_e is negative. The processor 140 may therefore present TUT_c and TUT_e separately to the user (perhaps with the sign of TUT_e flipped so that the value presented to the user is a positive number), or it may combine TUT_c and TUT_e into a total time under tension (e.g., TUT_total=|TUT_c|+|TUT_e|, or as the square root of a sum of the squares of TUT_c and TUT_e: TUT_total=sqrt(TUT_c*TUT_c+TUT_e*TUT_e)).

In embodiments in which the rigid rod 110 and/or the base 120 is hollow or includes a cavity 125, the components shown in the exemplary block diagram 200A of FIG. 6A may be arranged in a variety of different locations within the exercise device 100. FIGS. 9A through 9F illustrate some of the possible options for situating the various exemplary electronic components within the exercise device 100, assuming that the exercise device 100 includes a display 150 and optionally includes an external memory 142. In addition, the exercise device 100 may include the amplifier 132 and ADC 134 between the at least one load sensor 130 and the processor 140, as illustrated in FIG. 6B.

Figure 9A:
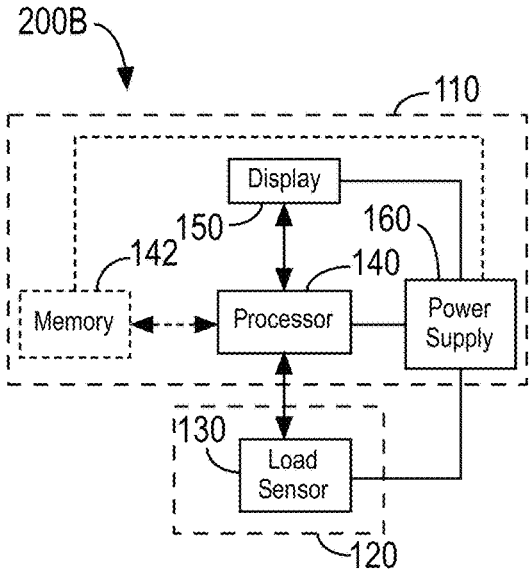
FIGS. 9A, 9B, 9C, 9D, 9E, and 9F are block diagrams of some components of an exemplary exercise device in accordance with some embodiments.
Figure 9B:
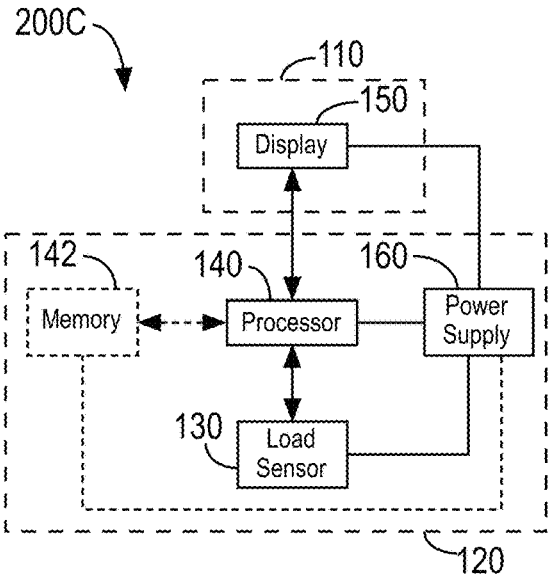
Figure 9C:
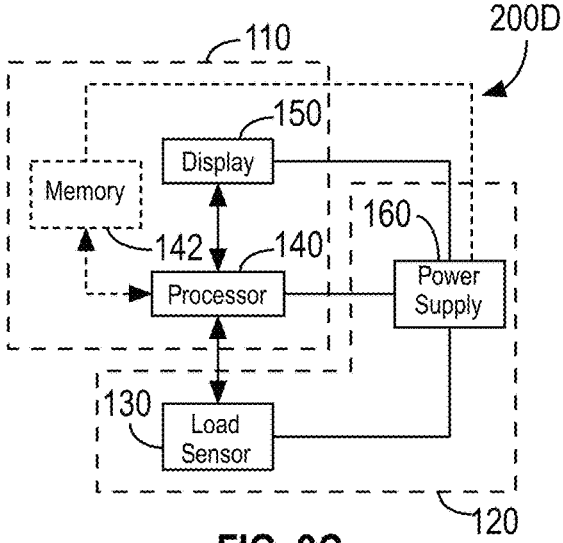
Figure 9D:
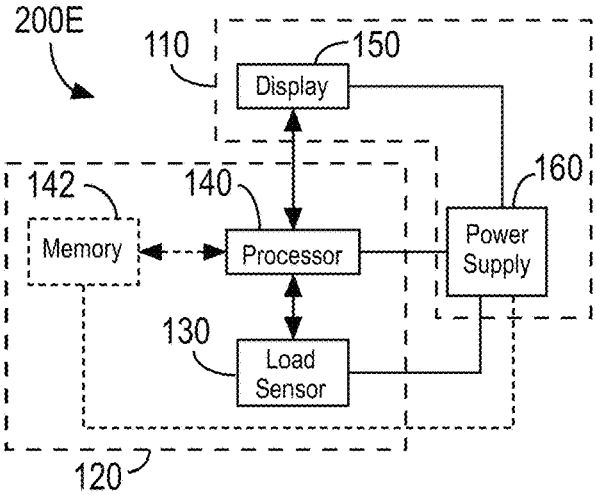

As illustrated in the exemplary block diagram 200B of FIG. 9A, the at least one load sensor 130 may reside in the base 120 while the remainder of the components (i.e., the processor 140, power supply 160, display 150, and, if present, memory 142) reside in the rigid rod 110. If present, the amplifier 132 and ADC 134 may reside in either the base 120 or the rigid rod 110. Alternatively, as shown in the exemplary block diagram 200C of FIG. 9B, the at least one load sensor 130, power supply 160, processor 140, and, if present, memory 142, amplifier 132, and ADC 134 may reside in the base 120 while the display 150 resides in the rigid rod 110. As yet another example, shown in the exemplary block diagram 200D of FIG. 9C, the at least one load sensor 130 and power supply 160 may reside in the base 120 while the processor 140, display 150, and, if present, memory 142 reside in the rigid rod 110. If present, the amplifier 132 and ADC 134 may reside in either the base 120 or the rigid rod 110 in the configuration of FIG. 9C. As yet another example, shown in the exemplary block diagram 200E of FIG. 9D, the at least one load sensor 130, processor 140, and, if present, memory 142, amplifier 132, and ADC 134 may be situated in the base 120, and the power supply 160 and display 150 may be located in the rigid rod 110.

Figure 9E:
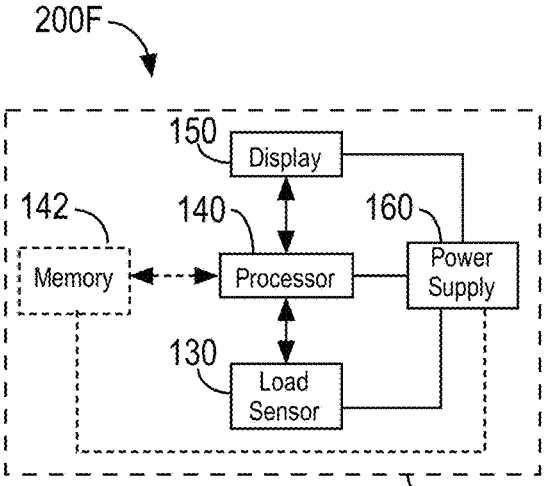

As another example, shown in the exemplary block diagram 200F of FIG. 9E, all of the electronic components (e.g., the at least one load sensor 130, processor 140, display 150, power supply 160, and, if present, memory 142, amplifier 132, and ADC 134) may be located in the base 120. Such a configuration may be used to allow users to decouple a first rigid rod 110 from the base 120 and couple the base 120 to a second rigid rod 110 that has different properties than the first rigid rod 110 (e.g., the second rigid rod 110 is made of a lighter or heavier material, has a shorter or longer length 116, has a different shape, has different hand grips or attachments, etc.).

Figure 9F:
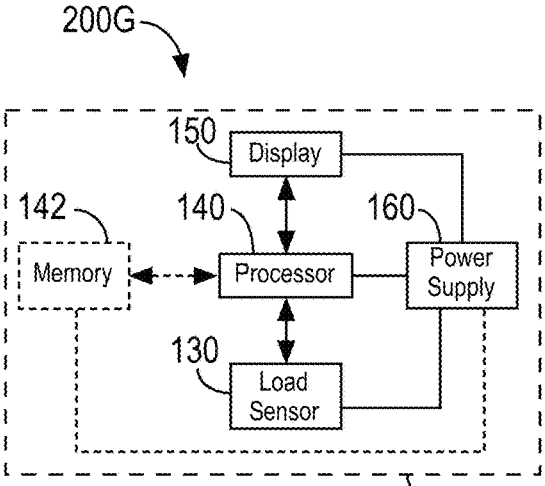

As shown in the exemplary block diagram 200G of FIG. 9F, all of the electronic components (e.g., the at least one load sensor 130, processor 140, display 150, power supply 160, and, if present, memory 142, amplifier 132, and ADC 134) may alternatively be located within the rigid rod 110. Situating all of the electronic components within the rigid rod 110 may simplify the design of the base 120. For example, when all of the electronic components are situated within the rigid rod 110, the base 120 may simply be an end cap or a solid, rigid element. Moreover, situating all of the electronic components within the rigid rod 110 may enable users to couple different bases 120 to the rigid rod 110 (e.g., heavier or lighter bases 120, bases 120 made of different materials, bases 120 having different shapes or properties to facilitate the performance of different exercises, etc.). Furthermore, as explained above in the discussion of FIG. 2A, the rigid rod 110 may comprise two or more portions (e.g., 109A and 109B), and one of those portions (e.g., 109A) may house all of the electronic components shown in the block diagram 200G. In such embodiments, those portions of the rigid rod 110 that do not house electronic components (e.g., 109B) may be removable to enable users to substitute (e.g., attach) other rigid rod 110 portions (e.g., 109C) that have different characteristics (e.g., a different length, weight, material, hand grips, branding, etc.).

Figure 10A:
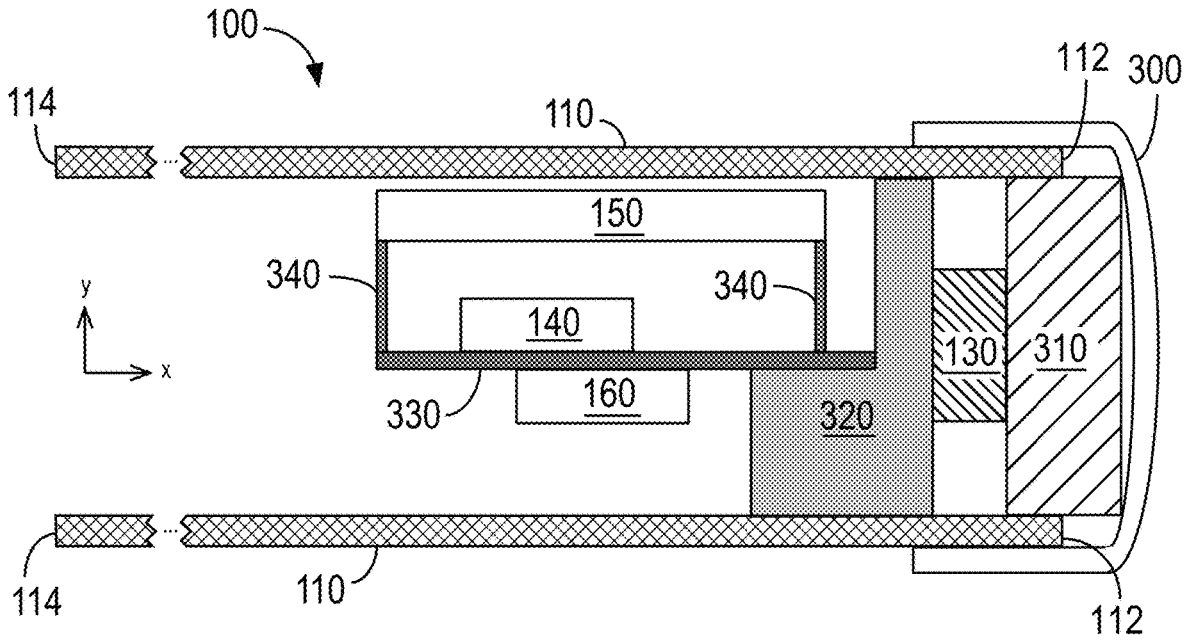
FIGS. 10A and 10B illustrate an exemplary exercise device for detecting compressive longitudinal forces in accordance with some embodiments.
Figure 10B:
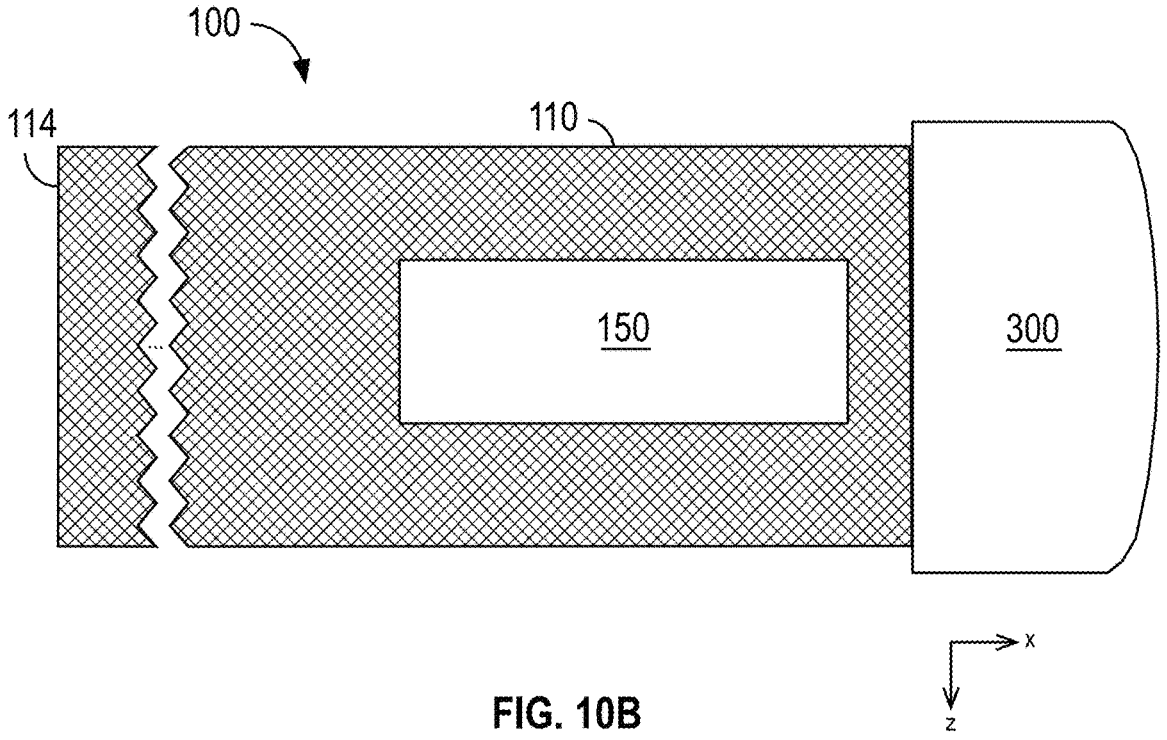

FIGS. 10A and 10B illustrate an exemplary exercise device 100 in accordance with some embodiments in which the exercise device 100 is capable of detecting a compressive longitudinal force, and the rigid rod 110 is at least partially hollow near the first end 112 and houses the electronic components as shown in FIG. 9F. FIG. 10A shows a cut-away view in the x-y plane (with the z-axis pointing out of the page toward the reader) with a break in the longitudinal direction of the (hollow) rigid rod 110 to enable the second end 114 of the rigid rod 110 to be shown, and FIG. 10B shows a side view of the exemplary exercise device 100 in the x-z plane (with the y-axis pointing out of the page toward the reader) with a similar break in the rigid rod 110. The embodiment of the exercise device 100 shown in FIGS. 10A and 10B includes at least one load sensor 130, a processor 140, a display 150, and a power supply 160 situated within the rigid rod 110. The rigid rod 110 is illustrated as being hollow, but alternatively it may contain a cavity 125 in which components may be situated. As explained in the context of FIGS. 6A and 6B, the exercise device 100 may also include an amplifier 132 and ADC 134 between the at least one load sensor 130 and the processor 140; for ease of illustration, these components are not shown in FIG. 10A. As also explained previously, the exercise device 100 may also include external memory 142, as illustrated in FIGS. 9A through 9F (not shown in FIGS. 10A and 10B). Furthermore, as explained above, the at least one load sensor 130 may include one or more strain gauges, which may be configured in a Wheatstone bridge.

In the exemplary embodiment illustrated in FIG. 10A, the power supply 160 and processor 140 are coupled to a circuit board 330 such that the power supply 160 provides power to the processor 140. In the illustrated embodiment, the display 150 is coupled to the circuit board 330 through one or more connectors 340 that enable the power supply 160 to provide power to the display 150 and enable the processor 140 to communicate with the display 150. In the exemplary embodiment of FIG. 10A, two connectors 340 connect the display 150 to the circuit board 330 and situate the display 150 near or adjacent to the inner surface of a hollow portion of the rigid rod 110. It is to be appreciated that if the rigid rod 110 includes a cutout for the display 150, the connectors 340 may situate the display 150 within that cutout. The circuit board 330 is coupled to a rigid plug 320 secured to the rigid rod 110 either directly (e.g., using screws, pins, adhesive, etc.) or through one or more intervening components within the rigid rod 110. An end cap 300, which is the base 120 in the illustrated embodiment, is coupled to the first end 112 of the rigid rod 110. The end cap 300 may be flexible (i.e., malleable) or rigid. If the end cap 300 is flexible, it may be attached to the rigid rod 110. If the end cap 300 is rigid, it may move relative to the rigid rod 110 as described below in the context of FIGS. 20A-20C. In the embodiment of FIG. 10A, the end cap 300 covers the first end 112 of the rigid rod 110, but, as explained above, the end cap 300 may reside inside or be flush with the first end 112 of the rigid rod 110. In the embodiment illustrated in FIG. 10A, a piston 310 is slidably positioned within the rigid rod 110 such that in the absence of a compressive longitudinal force, a portion of the piston 310 extends out of the first end 112 of the rigid rod 110. As illustrated in FIG. 10A, in the absence of a compressive longitudinal force, the piston 310 is in contact with or mechanically coupled to the at least one load sensor 130, which is between the rigid plug 320 and the piston 310. The end cap 300 prevents the piston 310 from sliding out of the rigid rod 110 in the absence of a compressive longitudinal force.

When a user applies a compressive longitudinal force to the embodiment of the exercise device 100 illustrated in FIG. 10A, the end cap 300 (whether flexible or rigid) allows the piston 310 to slide within the rigid rod 110 and compress the at least one load sensor 130. The at least one load sensor 130 senses the applied compressive longitudinal force and provides an electrical signal reflecting the applied compressive longitudinal force to the processor 140. As stated previously, the electrical signal output by the at least one load sensor 130 may be amplified by an amplifier 132 and converted to digital format by an ADC 134 disposed between the at least one load sensor 130 and the processor 140, as illustrated in FIG. 6B.

FIG. 10B is a side view, in the x-z plane, of the exemplary exercise device 100 shown in FIG. 10A. The rigid rod 110 has a window (e.g., a transparent region) or a cutout through which the display 150 is visible. For example, the entire rigid rod 110 may be transparent, or a portion of the rigid rod 110, including where the display 150 is situated, may be transparent, or the rigid rod 110 may have a cutout in which the display 150 is situated, as described above. The display 150 may reside entirely within the rigid rod 110, or it may be positioned so that the face of the display 150 is flush with the outer surface of the rigid rod 110. Alternatively, the display 150 may protrude from or be recessed within the rigid rod 110 so that some portion of the display 150 is not flush with the outer surface of the rigid rod 110. In some embodiments, described more fully below, the rigid rod 110 has a depression (e.g., a notch, groove, etc.) in its outer surface, and the display 150 is situated under or within a transparent or translucent cover that fits within or over the depression in the outer surface of the rigid rod 110. In some such embodiments, the visual indicators described below are also situated under or within the transparent or translucent cover.

Although FIG. 10B illustrates the display 150 mounted near the first end 112 of the rigid rod 110, the display 150, if present, may be mounted in any convenient location on or within the exercise device 100, such as, for example, near the midpoint between the first end 112 and the second end 114 of the rigid rod 110, or closer to the second end 114 than to the first end 112 of the rigid rod 110. If the display 150 is mounted further away from the processor 140, power supply 160, and/or plug 320 than shown in FIG. 10A, it may be necessary to provide additional wiring to provide power to and enable the processor 140 to communicate with the display 150. Alternatively, the size of the circuit board 330 may be modified to accommodate the desired position of the display 150 within the exercise device 100.

Figure 11A:
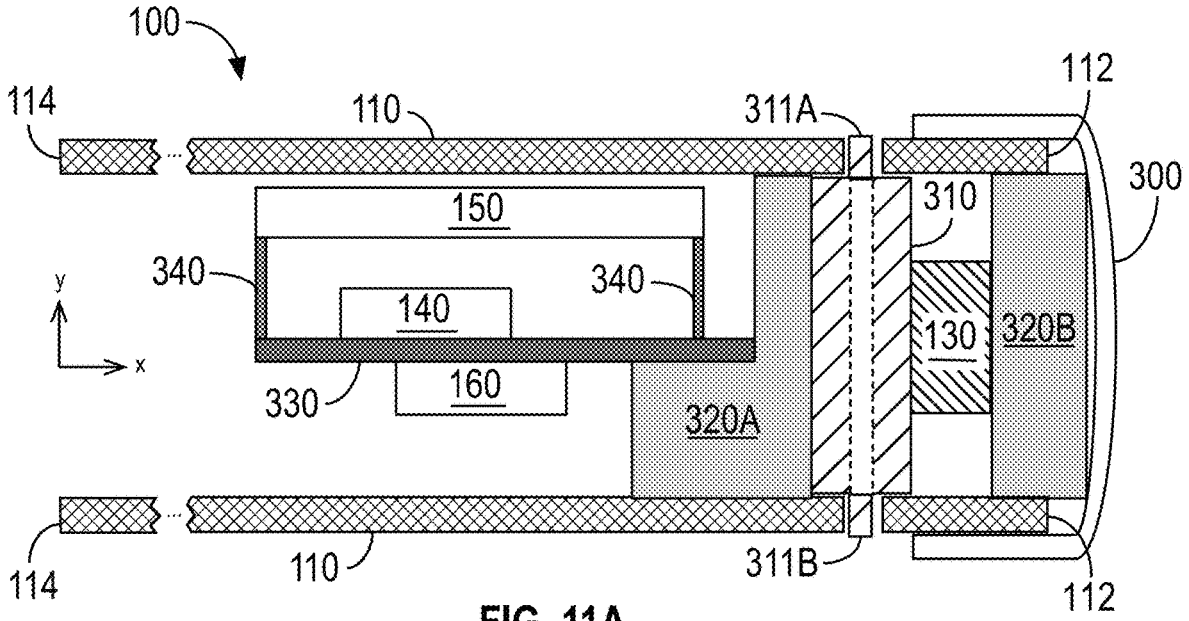
FIGS. 11A, 11B, and 11C illustrate an exemplary exercise device for detecting expansive longitudinal forces in accordance with some embodiments.
Figure 11B:
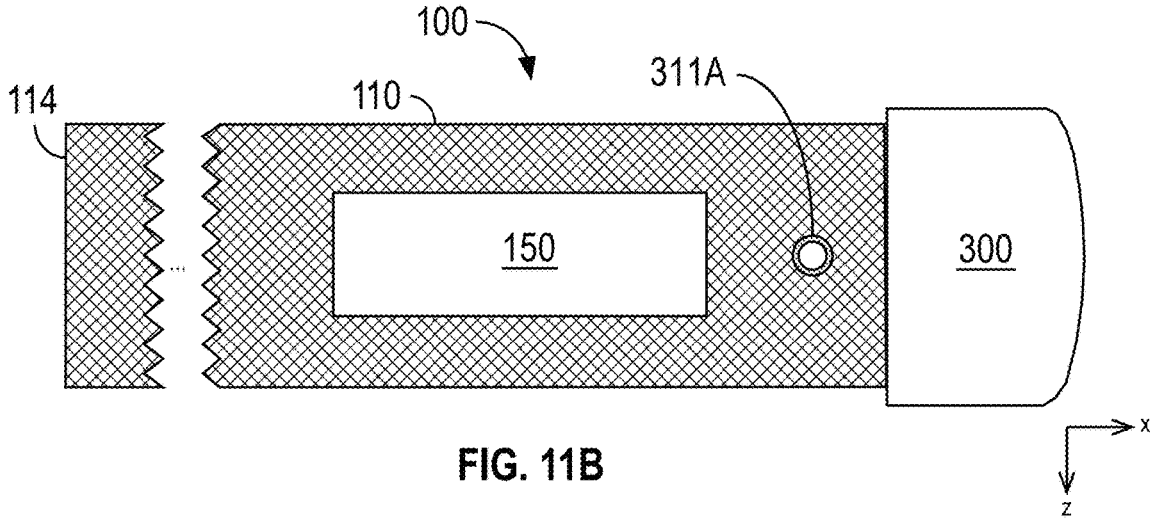
Figure 11C:
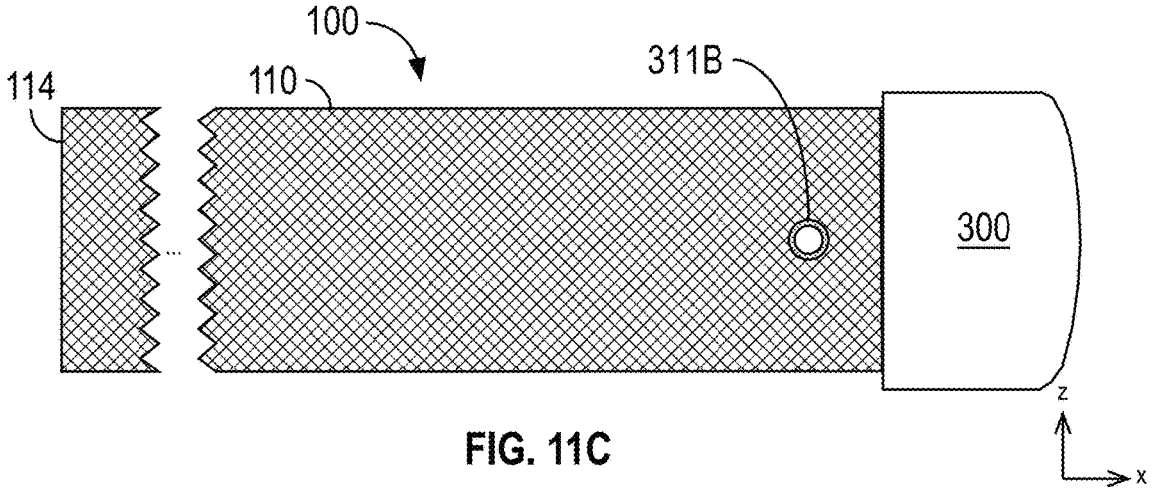

FIGS. 11A through 11C illustrate an exemplary exercise device 100 in accordance with some embodiments in which the exercise device 100 is capable of detecting an expansive longitudinal force. FIG. 11A shows a cut-away view in the x-y plane (with the z-axis pointing out of the page toward the reader) with a break in the longitudinal direction of the rigid rod 110 to enable the second end 114 of the rigid rod 110 to be shown. FIG. 11B shows a side view of the exemplary exercise device 100 in the x-z plane (with the y-axis pointing out of the page toward the reader) with a similar break in the rigid rod 110. FIG. 11C shows a side view of the exemplary exercise device 100 in the x-z plane but with the z-axis rotated 180 degrees from its orientation in FIG. 11B. In other words, FIG. 11C shows the other side of the exercise device 100 shown in FIG. 11B.

The embodiment of the exercise device 100 shown in FIGS. 11A through 11C includes several of the components already discussed, including at least one load sensor 130, a processor 140, a display 150, a power supply 160, a circuit board 330, one or more connectors 340, and an end cap 300 as the base 120 (which, as explained above, may be flexible or rigid). In the embodiment illustrated in FIG. 11A, the exercise device 100 also includes two rigid plugs, 320A and 320B. The rigid plug 320A is secured either directly (e.g., using screws, pins, adhesive, etc.) or through one or more intervening components to the rigid rod 110, and it serves the same purpose as the rigid plug 320 shown in FIG. 10A. The rigid plug 320B is secured either directly (e.g., using screws, pins, adhesive, etc.) or through one more intervening components to the rigid rod 110 near the first end 112 of the rigid rod 110. Although FIG. 10A illustrates the plug 320B extending beyond the first end 112 of the rigid rod 110, the plug 320B may reside entirely within the rigid rod 110. The at least one load sensor 130 is disposed between the rigid plug 320B and a piston 310. The piston 310 includes a hole (indicated by dashed lines) extending through the piston 310 from one side of the rigid rod 110 to the other side of the rigid rod 110 through which a pin or rod of an attachment may pass to enable the exercise device 100 to be coupled to a surface so that a user may perform exercises requiring expansive longitudinal forces. As shown in FIG. 11A, the piston 310 may also include two hollow piston collars 311A and 311B through which the pin or rod of the attachment may also pass. If present, the piston collars 311A and 311B may extend from the sides of the piston 310 through holes in the rigid rod 110 to prevent the piston 310 from rotating or being dislodged from its location within the rigid rod 110. The piston 310 is slidably positioned within the rigid rod 110, and the holes in the rigid rod 110 into which the piston collars 311A and 311B are positioned are sized so that when a user applies an expansive longitudinal force, the piston 310 compresses the at least one load sensor 130. In the embodiment illustrated in FIG. 11A, the piston 310 is in contact with the at least one load sensor 130, but, alternatively, the piston 310 and the at least one load sensor 130 may be mechanically coupled through one or more intervening components.

Although the piston 310 illustrated in FIG. 11A is shown extending from one side of the rigid rod 110 to the other, the piston 310 may be smaller than the inner diameter 119 (or inner perimeter, if the interior of the rigid rod 110 has a non-circular cross-section) of the rigid rod 110. In such embodiments, the piston collars 311A and 311B may extend further into the rigid rod 110 to prevent the piston 310 from being dislodged from its location and to enable the user to attach an attachment to the exercise device 100. Furthermore, although FIG. 11A shows the piston having a hole through it that is approximately the same diameter as the piston collars 311A and 311B, the piston 310 may have a larger-diameter single hole passing all the way through the piston 310 or two larger-diameter holes near the rigid rod 110. The user may then attach an attachment to the exercise device 100 by inserting fasteners through the piston collars 311A and 311B such that a portion of the fasteners resides within the piston 310 and prevents the attachment from detaching from the exercise device 100. It is to be appreciated that other mechanisms may be used in lieu of the piston collars 311A and 311B to enable a user to attach an attachment to the exercise device 100. For example, one or more pins emanating from the piston 310 may pass through holes in the rigid rod 110 and extend out of the exercise device 100 to enable a user to attach an attachment to the pins. Alternative attachment mechanisms are discussed below in the context of FIGS. 12A-12B, 13A-13C, 14A-14B, and 15A-15C.

When a user applies an expansive longitudinal force to the exercise device 100 with an attachment attached (or mechanically coupled) to the piston 310, the user pulls on the rigid rod 110 (moving it toward the left of the page), and the piston 310 slides within the rigid rod 110 and compresses the at least one load sensor 130. The at least one load sensor 130 senses the applied expansive longitudinal force and provides an electrical signal reflecting the applied expansive longitudinal force to the processor 140. As stated previously, the electrical signal output by the at least one load sensor 130 may be amplified by an amplifier 132 and converted to digital format by an ADC 134 disposed between the at least one load sensor 130 and the processor 140 as described in the context of FIG. 6B.

FIG. 11B is a side view, in the x-z plane, of the exemplary exercise device 100 shown in FIG. 11A. In FIG. 11B, the y-axis points out of the page, toward the reader. The piston collar 311A is visible in the x-z plane. In addition, the display 150 is visible near the first end 112 of the rigid rod 110, but, as explained above, the display 150 may be positioned at any convenient location along the rigid rod 110. As explained elsewhere, the display 150 may be omitted entirely. Moreover, the discussion above in the context of FIG. 10A regarding the positioning of the display 150 is applicable to embodiments such as the one shown in FIGS. 11A and 11B. FIG. 11C illustrates another side view of the exemplary exercise device 100 in the x-z plane, but with the z-axis rotated 180 degrees from its position in FIG. 11B. Thus, if FIG. 11B shows the "top" of the exercise device 100 of FIG. 11A, FIG. 11C shows the "bottom" of the exercise device 100 of FIG. 11A. The piston collar 311B is visible.

Figure 12B:
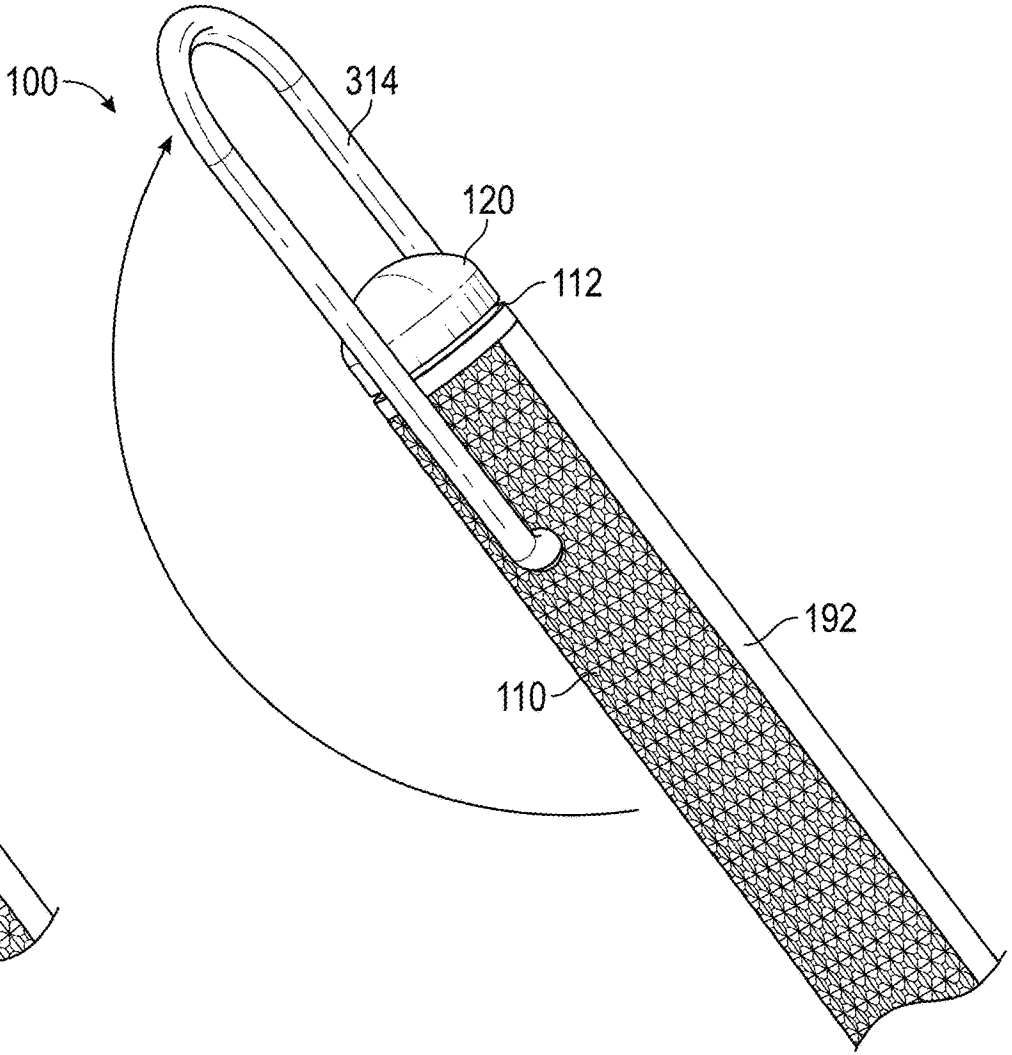
FIGS. 12A and 12B illustrate an exercise device that includes an attachment in accordance with some embodiments.
Figure 12A:
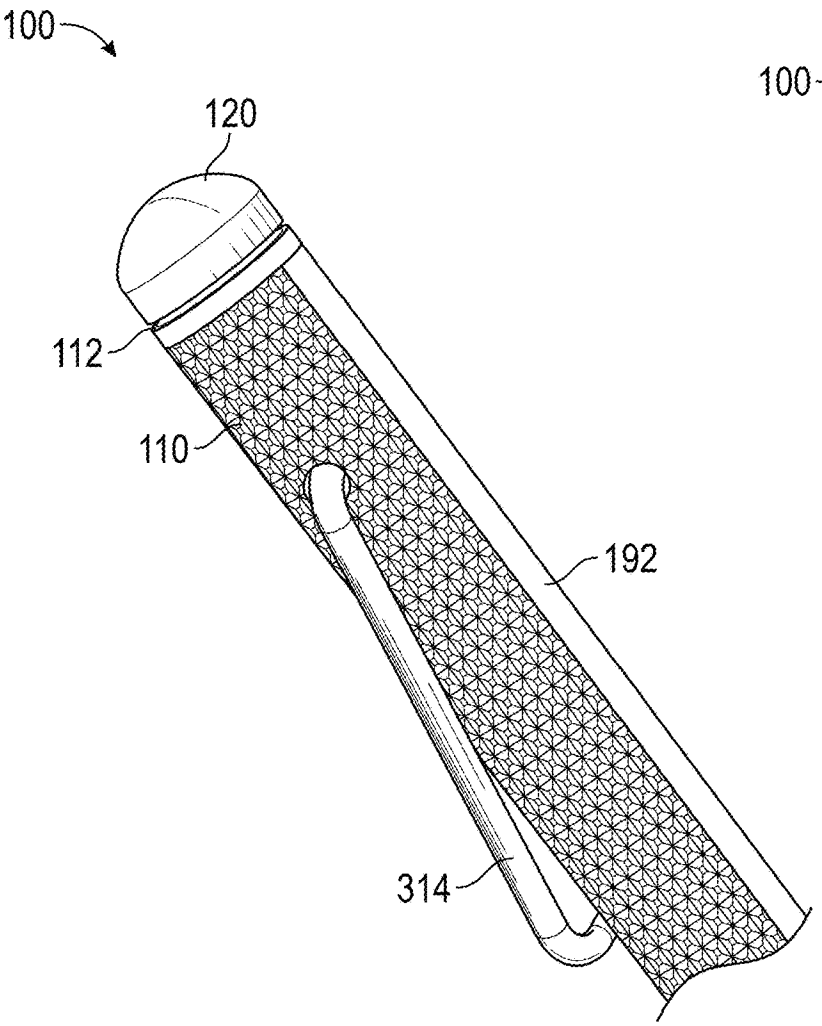

FIGS. 12A and 12B illustrate an embodiment of the exercise device 100 that includes an attachment 314 to enable a user to attach the exercise device 100 to an object for performing exercises involving expansive longitudinal forces. The attachment 314, which has a hoop shape in the exemplary embodiment of FIGS. 12A and 12B, extends through the rigid rod 110 and is coupled, either directly or mechanically, to the at least one load sensor 130 (e.g., through a piston 310). FIGS. 12A and 12B illustrate the attachment 314 permanently attached to the exercise device 100, but the attachment 314 may be partially or fully removable. FIG. 12A shows the attachment 314 in its retracted position, which enables a user to situate the base 120 against a sturdy surface or object to apply compressive longitudinal forces, and FIG. 12B shows the attachment 314 in its deployed position, which enables the user to connect the exercise device 100 to a sturdy surface or object to apply expansive longitudinal forces. For example, with the attachment 314 in its deployed position, a user may secure the exercise device 100 to a pole, post, or bar using, for example, a strap and a clip (e.g., a carabiner, etc.). As another example, the user may place the attachment 314 over a hook or other protrusion (e.g., mounted to a wall, ceiling, or floor) to perform exercises that include expansive longitudinal forces. As another example, a receptacle may be provided to facilitate a user coupling the attachment 314 to the receptacle. The receptacle may be mounted to a surface (e.g., a wall, floor, ceiling, etc.), or it may be made of a heavy material to prevent movement of the receptacle when the user applies an expansive longitudinal force. The receptacle may include, for example, a hook or protrusion around or over which the attachment 314 may be placed.

Figure 13A:
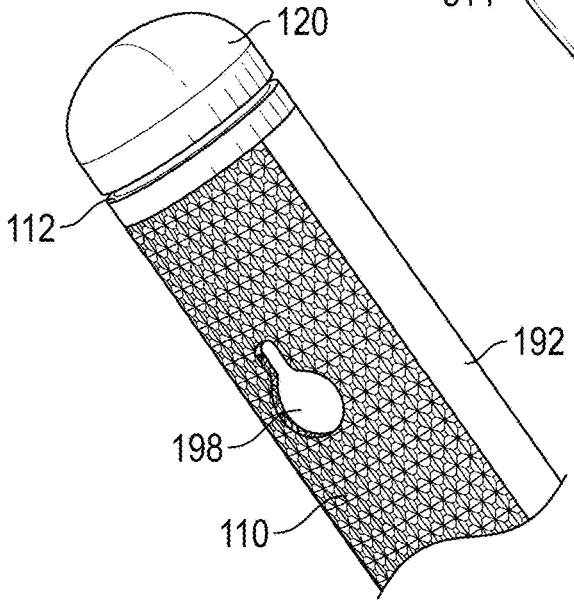
FIGS. 13A, 13B, and 13C illustrate an exercise device that facilitates the addition of an attachment in accordance with some embodiments.
Figure 13B:
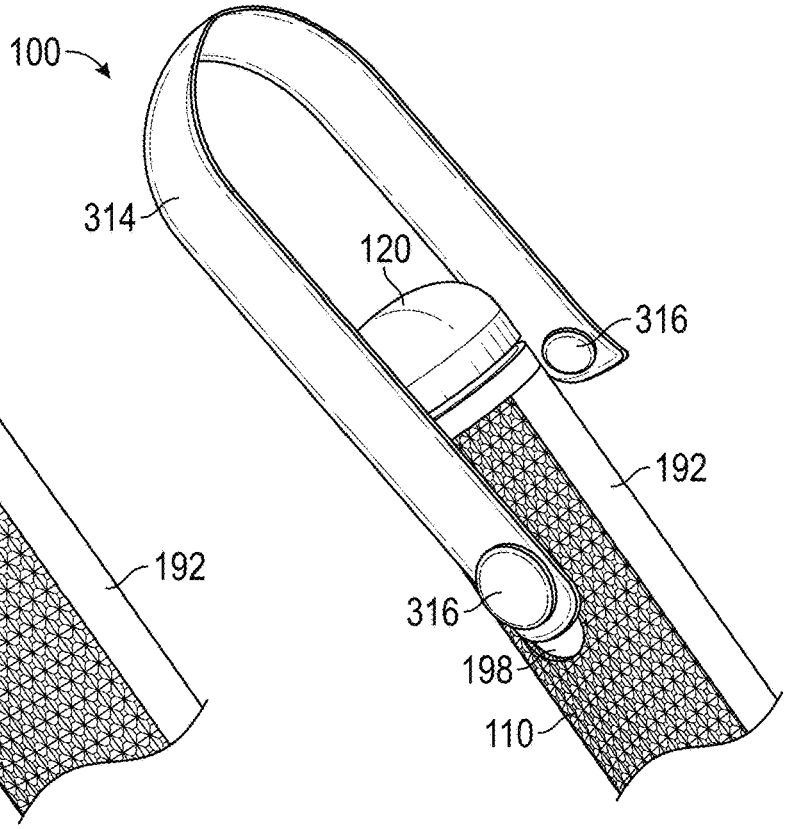
Figure 13C:
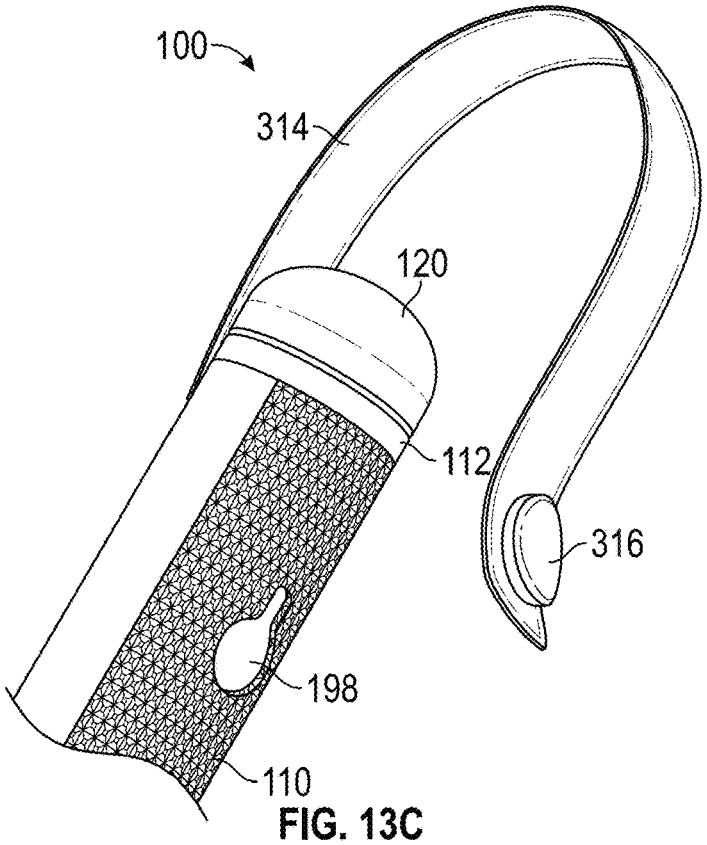

FIGS. 13A-13C illustrate another embodiment of the exercise device 100 that facilitates the addition of an attachment 314 to enable a user to couple the exercise device 100 to a sturdy surface or object to perform exercises having expansive longitudinal forces. FIG. 13A shows a portion of the exercise device 100, including the base 120 and the rigid rod 110 near the first end 112. The rigid rod 110 includes at least one attachment receptacle 198, which has a size and shape configured to accept a complementary fastener 316 of an attachment 314, as shown in FIG. 13B. As shown, the attachment receptacle 198 is the female portion of the fastening mechanism, and the attachment 314 includes the male portion of the fastening mechanism. The fastening mechanism comprising the attachment receptacle 198 and the complementary fastener 316 may be, for example, a SNAP™ fastener. As other examples, the attachment receptacle 198 may be a hole, a groove, a slot (e.g., a keyhole-shaped slot as shown in FIGS. 13A-13C), etc., and the fastener 316 may be a pin or post, mushroom-shaped post, T-shaped post or rod, hook and loop, ring, D-ring, eyelet, carabiner, clamp, clasp, etc.

The at least one attachment receptacle 198 is coupled, either directly or mechanically, to the at least one load sensor 130. In the embodiment illustrated in FIGS. 13A-13C, the exercise device 100 includes attachment receptacles 198 on opposite sides of the rigid rod 110, and the attachment 314 includes corresponding fasteners 316. The exercise device 100 shown in FIGS. 13A-13C may be attached to a sturdy surface or object either directly by the attachment 314 (e.g., the user may attach one of the fasteners 316 to one of the attachment receptacles 198, pass the attachment 314 around a pole or other object (e.g., a hook, a loop, etc.), and then attach the other fastener 316 to the other attachment receptacle 198), or through an intervening mechanism (e.g., the user may attach both fasteners 316 to both attachment receptacles 198 and then feed a belt, loop, carabiner, clip, etc. through, over, or around the attachment 314).

Figure 14A:
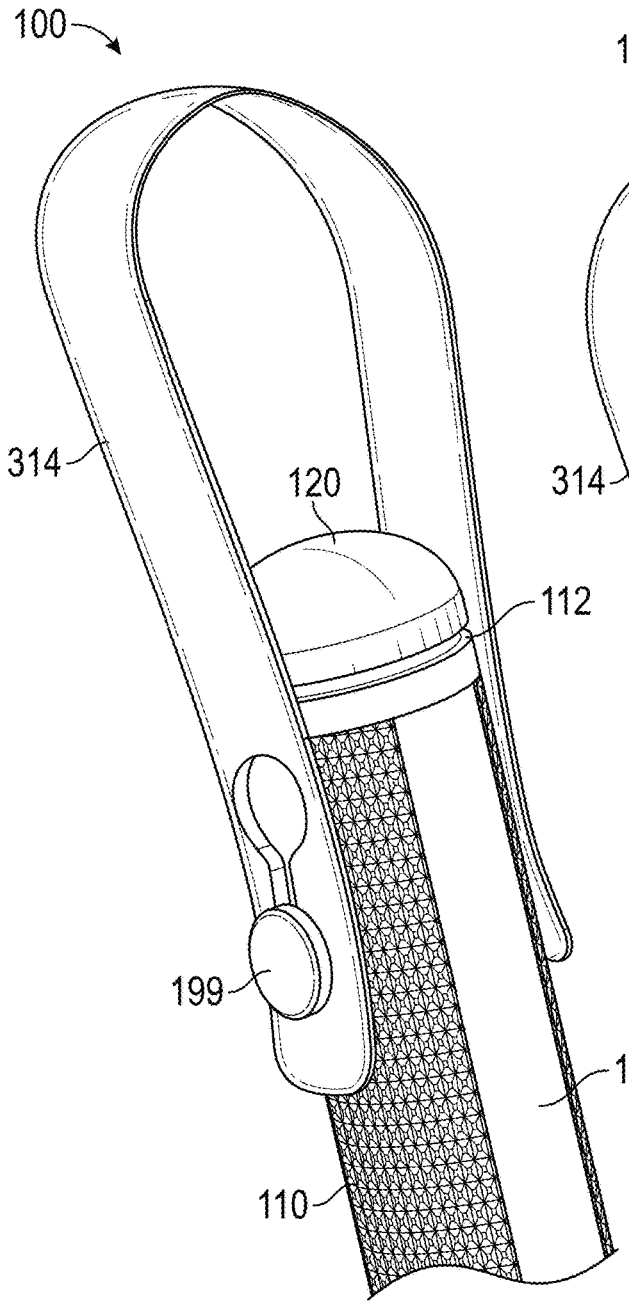
FIGS. 14A and 14B illustrate an exercise device that facilitates the addition of an attachment in accordance with some embodiments.
Figure 14B:
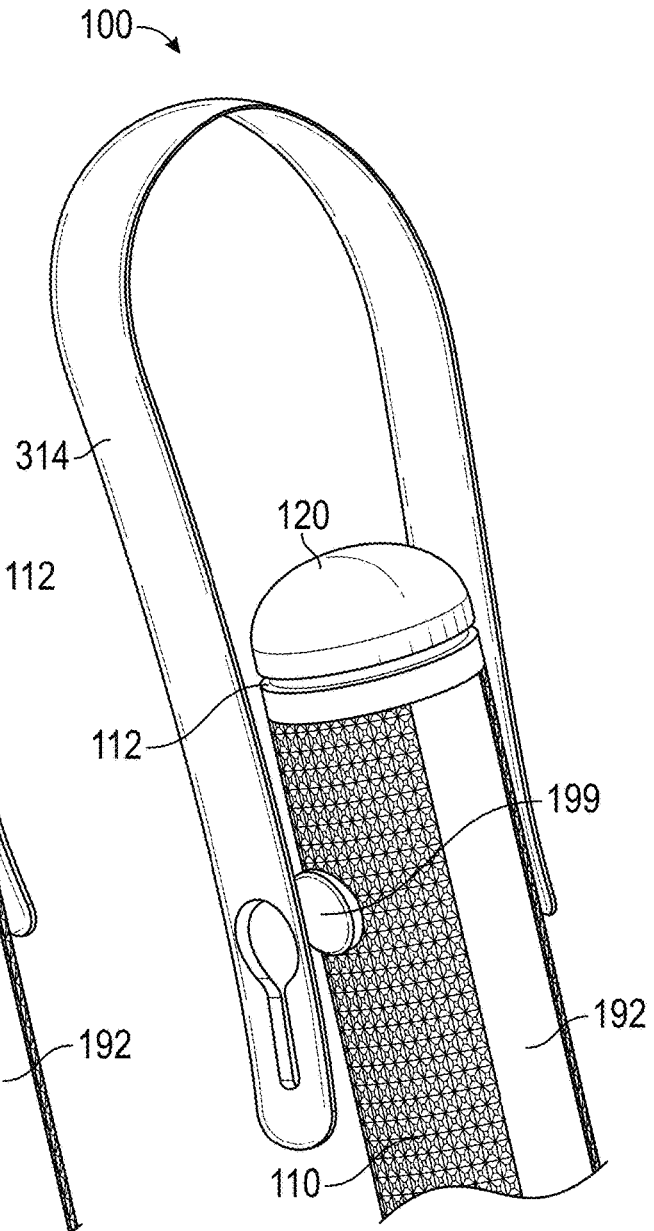

FIGS. 14A-14B illustrate yet another embodiment of the exercise device 100 that facilitates the addition of an attachment 314 to enable a user to couple the exercise device 100 to a sturdy surface or object to perform exercises having expansive longitudinal forces. In this embodiment, the exercise device 100 includes a protrusion 199 extending from the rigid rod 110. The protrusion 199 may have any convenient shape. For example, the protrusion 199 may be a pin or post, mushroom-shaped post, T-shaped post or rod, hook and loop, ring, D-ring, eyelet, carabiner, clamp, clasp, etc. FIGS. 14A and 14B illustrate a cylinder or button, which may be part of a T-shaped post or rod. When the exercise device 100 includes a protrusion 199, such as in the embodiment of FIGS. 14A and 14B, the attachment 314 includes a corresponding feature to enable the attachment 314 to be secured to the exercise device 100. For example, as shown in FIGS.

14A and 14B, the attachment 314 may include a hole, a groove, a slot, etc. through which the protrusion 199 may pass and be secured to the attachment 314. FIGS. 14A and 14B illustrate one particular type of protrusion 199 and corresponding feature of attachment 314, but it will be appreciated that there are many other ways to fasten the attachment 314 to a protrusion 199 (e.g., the attachment mechanism may comprise the male and female portions of a SNAP™ fastener, a snap, or any other suitable fastener). The embodiment shown in FIGS. 14A and 14B may be attached to a sturdy surface or object in the same manner as described above for the embodiment of FIGS. 13A-13C. It is to be understood that the exercise device 100 may include both a protrusion 199 and an attachment receptacle 198.

The attachment 314 may be flexible or rigid, and it may be made from any suitable material. Examples of suitable materials include nylon, webbing, paracord, leather, rope, metal, metal cabling, plastic, carbon fiber, silicone, rubber, TPU, TPE, foam, felt, elastomer, ebonite, PC-ABS, nylon, Delrin, glass-reinforced plastic, carbon-reinforced plastic, high-impact resin, polycarbonate, acrylic, polypropylene, PVC, cork, wood, bamboo, metal, aluminum, steel, etc.

Figure 15A:
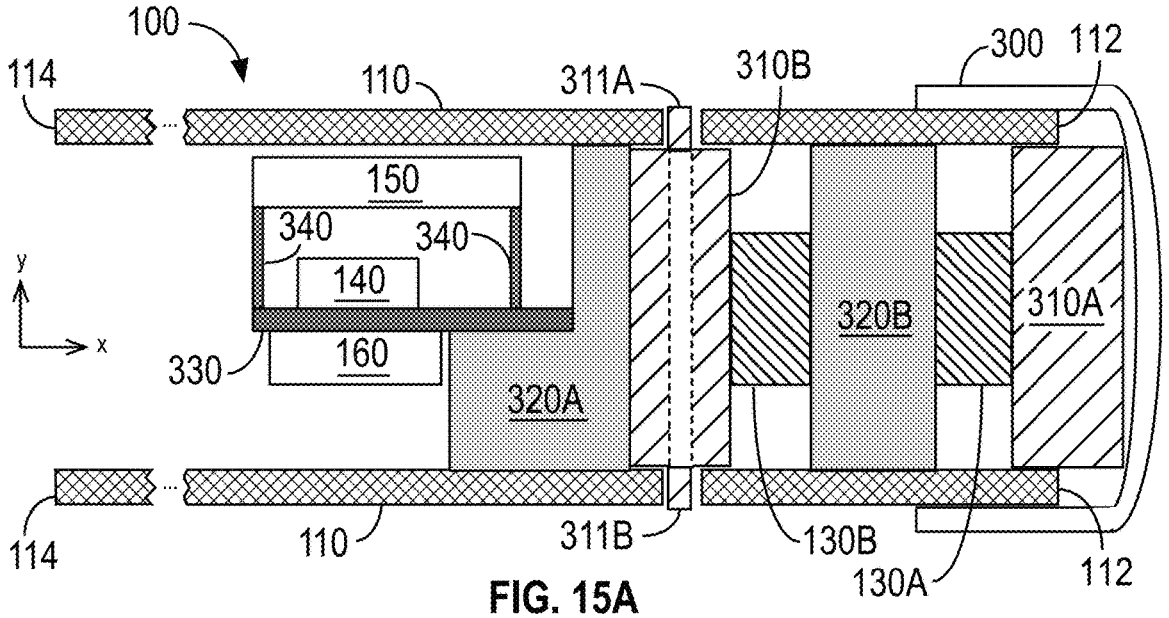
FIGS. 15A, 15B, and 15C illustrate an exemplary exercise device capable of detecting both compressive and expansive longitudinal forces in accordance with some embodiments.
Figure 15B:
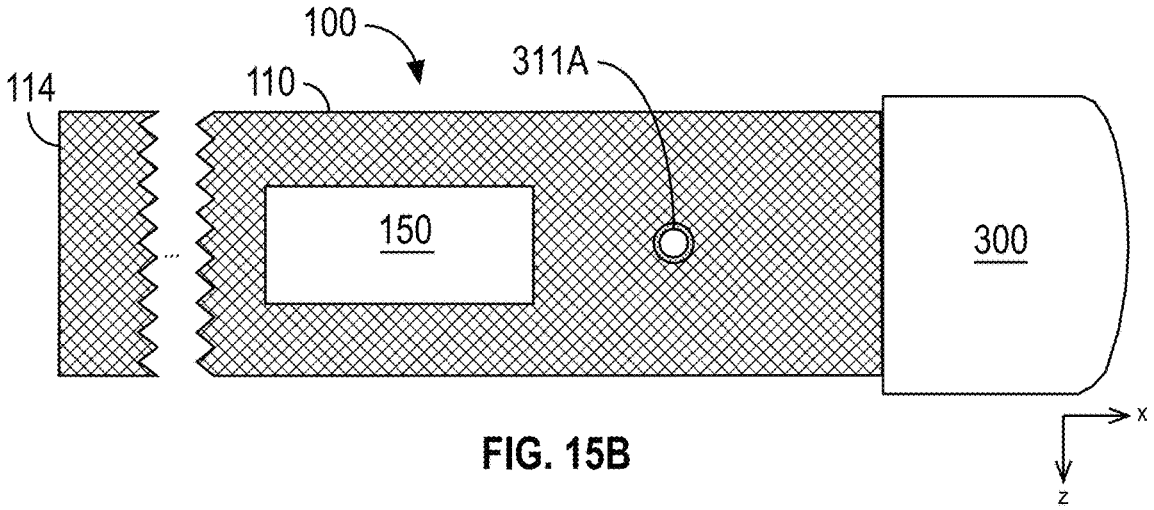
Figure 15C:
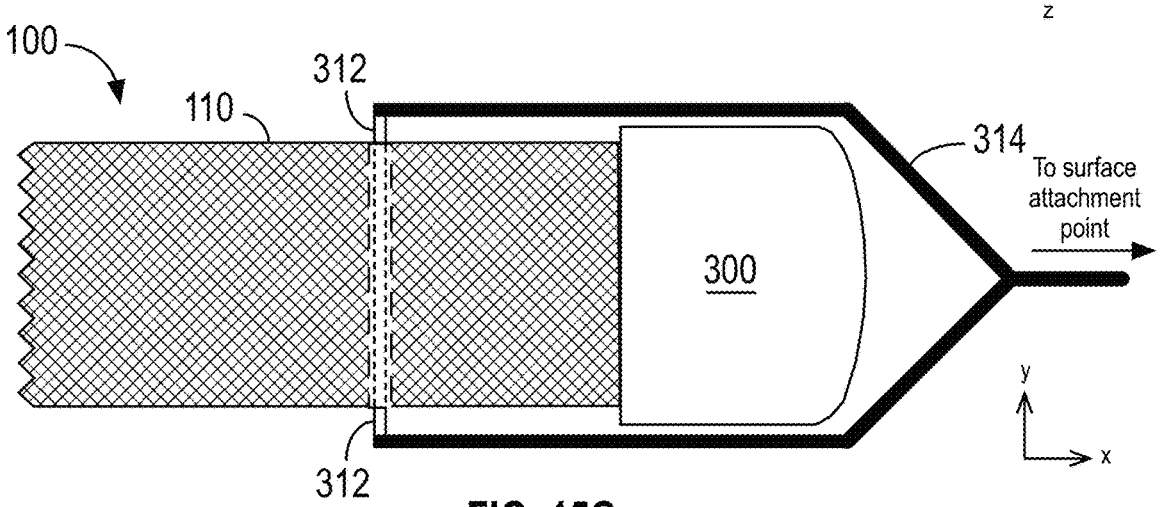

FIGS. 15A through 15C illustrate an exemplary embodiment of an exercise device 100 capable of detecting both compressive and expansive longitudinal forces. FIG. 15A shows a cut-away view in the x-y plane (with the z-axis pointing out of the page toward the reader) with a break in the longitudinal direction of the rigid rod 110 to enable the second end 114 of the rigid rod 110 to be shown. FIG. 15B shows a side view of the exemplary exercise device 100 in the x-z plane (with the y-axis pointing out of the page toward the reader) with a similar break in the rigid rod 110. FIG. 15C shows a side view of the exemplary exercise device 100 in the x-y plane with an attachment 314 enabling the exercise device 100 to be used in exercises involving expansive longitudinal forces.

The embodiment of the exercise device 100 shown in FIGS. 15A-15C includes several of the components already discussed, including a processor 140, a display 150, a power supply 160, a circuit board 330, one or more connectors 340, and an end cap 300 as the base 120 (which may be flexible or rigid as explained above). In addition, as discussed elsewhere, the exercise device 100 may include a different style of base 120 instead of the end cap 300. The exemplary exercise device 100 of FIGS. 15A-15C also includes two load sensors, 130A and 130B, two rigid plugs, 320A and 320B, and two pistons, 310A and 310B. The explanations above of the rigid plug 320, at least one load sensor 130, and piston 310 in the context of FIG. 10A apply, respectively, to the rigid plug 320B, the at least one load sensor 130A, and the piston 310A shown in FIG. 15A, except that in FIG. 15A, the rigid plug 320B does not support the circuit board 330. In the embodiment illustrated in FIG. 15A, the at least one load sensor 130A is disposed between the piston 310A and the rigid plug 320B and detects compressive longitudinal forces. The explanations above of the rigid plug 320B, at least one load sensor 130, piston 310, and piston collars 311A and 311B in the context of FIG. 11A apply, respectively, to the rigid plug 320B, load sensor 130B, piston 310B, and piston collars 311A and 311B of FIG. 15A. In the embodiment illustrated in FIG. 15A, the at least one load sensor 130B is disposed between the piston 310B and the rigid plug 320B and detects expansive longitudinal forces.

FIG. 15B is a side view in the x-z plane of the exemplary exercise device 100 of FIG. 15A without any attachment attached to the exercise device 100. The piston collar 311A and the display 150 are visible. FIG. 15C is a view in the x-y plane of the exemplary exercise device 100 of FIG. 15A with an attachment 314 attached to the exercise device 100. The attachment 314 includes a pin 312 that has been inserted through the piston collars 311A and 311B (not visible in FIG. 15C) and through the exercise device 100. The attachment 314 may then be attached to a surface (e.g., a wall, a door, a doorframe, a ceiling, a floor, a pipe, etc.) at an attachment point. As explained above, there are a number of ways that the attachment 314 may be attached an object or surface, including, by way of example and not limitation, a clip, a buckle, a belt, a carabiner, an anchor, or a tie.

Although many of the embodiments discussed herein illustrate the electronic components residing primarily or exclusively within the rigid rod 110, as discussed above, the components may reside entirely within the base 120, or the components may be distributed among both the rigid rod 110 and the base 120. As will be appreciated in light of the discussion herein, the location of any piston collars 311, attachment receptacle 198, or protrusions 199 may correspond to the location of the piston 310 involved in the sensing of expansive longitudinal forces. For example, if the piston 310 (or 310B) is within the base 120, the piston collars 311, attachment receptacle 198, or protrusion 199 (or any other mechanism used to allow the attachment 314 to be attached to the exercise device 100) may also be on or in the base 120.

Figure 16A:
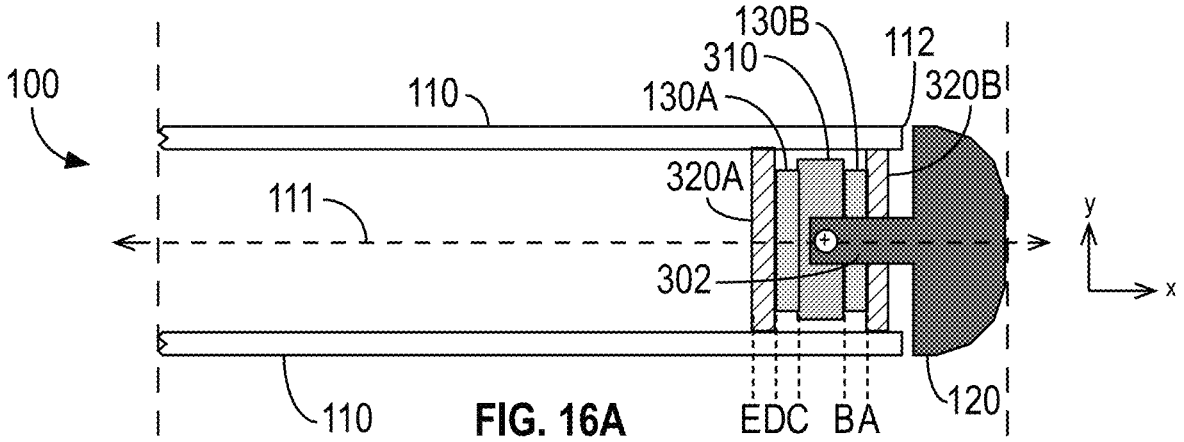
FIGS. 16A, 16B, 16C, and 16D illustrate an exemplary exercise device capable of detecting both compressive and expansive longitudinal forces in accordance with some embodiments.
Figure 16B:
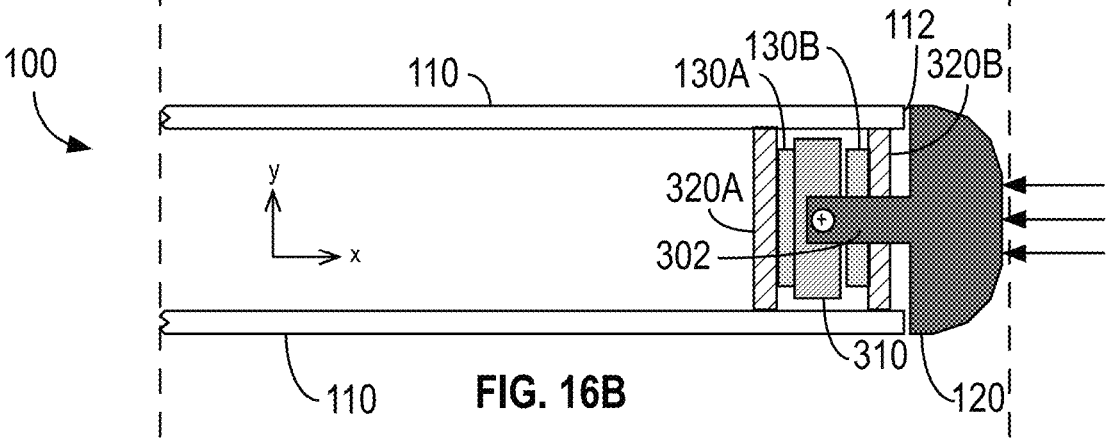
Figure 16C:
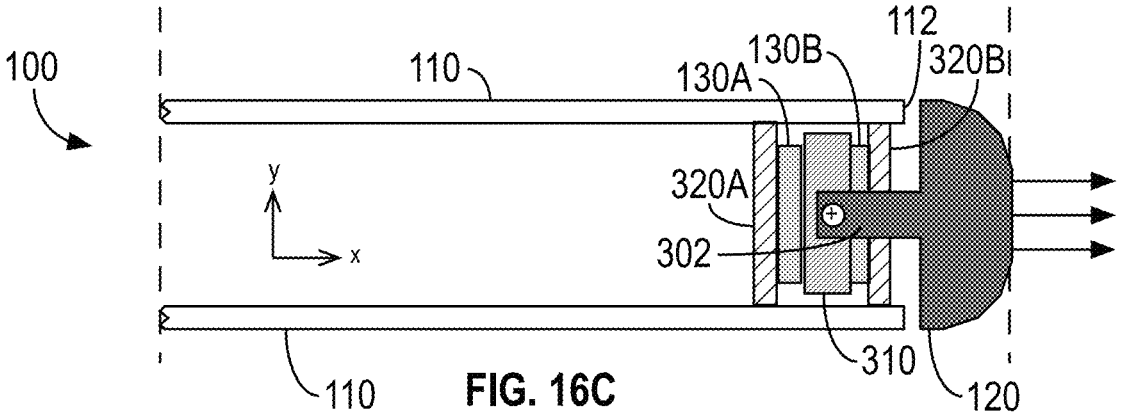
Figure 16D:
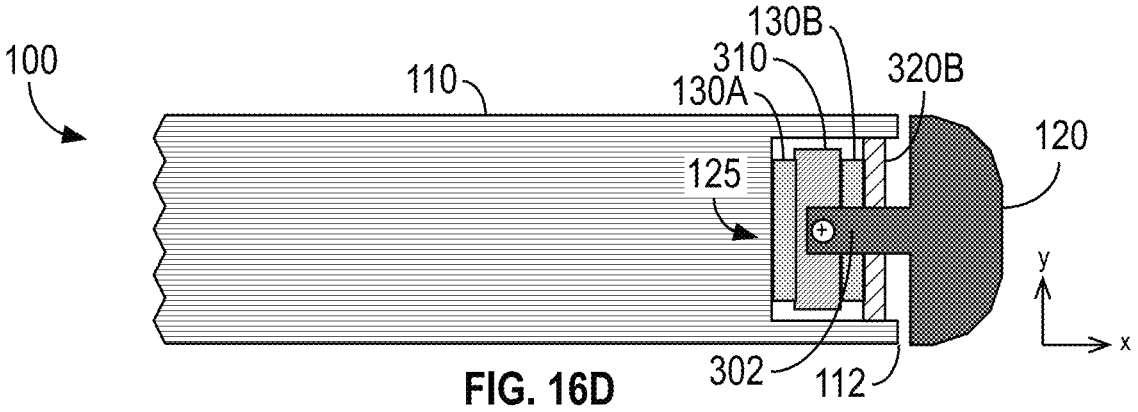

FIGS. 16A-16C show cross-sectional views of another embodiment of an exercise device 100 capable of detecting both compressive longitudinal forces and expansive longitudinal forces. In FIGS. 16A-16C, the rigid rod 110 is hollow. FIG. 16D shows a cross-sectional view of another embodiment capable of detecting both compressive and expansive longitudinal forces in which the rigid rod 110 is only partially hollow near the first end 112. In FIGS. 16A-16D, the cross-section is in the x-y plane, with the z-axis extending out of the page, toward the reader. The x-axis is in the direction of the longitudinal axis 111. The embodiment illustrated in FIGS. 16A-16C includes two plugs, 320A and 320B, which are affixed, either directly or through an intervening mechanism, to the rigid rod 110 so that the positions of the plugs 320A and 320B are fixed relative to the rigid rod 110. At least one load sensor 130A is sandwiched between the plug 320A and a piston 310. The at least one load sensor 130A detects compressive longitudinal forces. At least one load sensor 130B is sandwiched between the plug 320B and the piston 310. The at least one load sensor 130B detects expansive longitudinal forces. The piston 310 is attached, either directly or through an intervening mechanism, to at least one side arm 302 of the base 120. The piston 310 may be attached to the at least one side arm 302 by any suitable fastener (e.g., adhesive, a screw, a nail, a pin, etc.). As illustrated in FIG. 16A, the at least one side arm 302 may be attached to the piston 310 by screws. The base 120 and the at least one side arm 302 may be an integrated component, or the at least one side arm 302 may be a separate component that is coupled to the base 120 during assembly of the exercise device 100. In the embodiment illustrated in FIGS. 16A-16D, the base 120 and at least one side arm 302 are presumed to be substantially rigid (e.g., made of a material that does not deform substantially when subjected to forces, such as, by way of example and not limitation, hardened rubber, a strong elastomer, ebonite, polycarbonate acrylonitrile butadiene styrene (PC-ABS), nylon, Delrin, glass-reinforced plastic, carbon-reinforced plastic, high-impact resin, polycarbonate, acrylic, polypropylene, PVC, cork, wood, bamboo, metal, aluminum, steel, etc.). The base 120 and at least one side arm 302 may be made of the same material, or they may be made of different materials. In the embodiments shown in FIGS. 16A-16D, the base 120 is capable of being coupled to a sturdy object, such as a wall, a ceiling, a bar, a pole, etc. Mechanisms that may be used to attach the base 120 to a sturdy surface or object are described elsewhere herein, including in the discussions of FIGS. 12A-12B, 13A-13C, 14A-14B, and 15A-15C.

FIG. 16B illustrates the effect of the application of a compressive longitudinal force, represented by the left-pointing arrows, to the base 120 of the exercise device 100 illustrated in FIG. 16A. The piston 310, which is affixed to the base 120 by the at least one side arm 302, compresses the at least one load sensor 130A against the plug 320A. The at least one load sensor 130A senses the applied force and generates an electrical signal as described above. FIG. 16C illustrates the effect of the application of an expansive longitudinal force, represented by the right-pointing arrows, to the base 120 of the exercise device 100 illustrated in FIG. 16A. When a user has affixed the base 120 to a solid object and thereafter pulls on the rigid rod 110, the piston 310 compresses the at least one load sensor 130B against the plug 320B. The at least one load sensor 130B senses the applied force and generates an electrical signal as described above.

It is to be appreciated that if the rigid rod 110 is solid along part of its length and hollow near the first end 112, the interior surface of the rigid rod 110 may replace the plug 320A. FIG. 16D illustrates such an embodiment. As illustrated in FIG. 16D, the plug 320A has been removed, and the structure of the solid portion of the rigid rod 110 performs the function of the plug 320A. When the user applies a compressive longitudinal force, the at least one load sensor 130A is compressed between the solid portion of the rigid rod 110 and the piston 310. When the user applies an expansive longitudinal force, the exercise device 100 of FIG. 16D operates as described above in the context of FIG. 16C.

FIGS. 17A through 17E illustrate one way in which the plugs 320A and 320B, the at least one load sensors 130A and 130B, the piston 310, and the base 120 of the embodiment shown in FIGS. 16A through 16C may be assembled to allow the exercise device 100 to function as described. FIGS. 17A through 17E are cross-sectional views of the exercise device 100 in the y-z plane at the locations along the longitudinal axis 111 of the dashed lines A through E shown in FIG. 16A. In FIGS. 17A-17E, the x-axis shown in FIGS. 16A-16D points into the page, away from the reader. Thus, the views in FIGS. 17A-17E are from the second end 114 of the rigid rod 110 toward the first end 112 of the rigid rod 110, toward the base 120, at the dashed lines A through E of FIG. 16A.

Figure 17A:
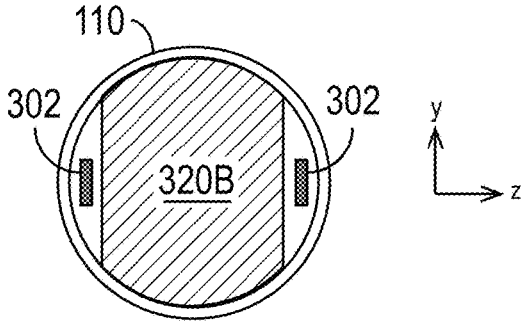
FIGS. 17A, 17B, 17C, 17D, and 17E illustrate one way in which certain components of an exercise device may be assembled in accordance with some embodiments.

As shown in FIG. 17A, at the location along the longitudinal axis labeled by the dashed line A of FIG. 16A, a surface of the plug 320B and side arms 302 of (or attached to) the base 120 are visible. The side arms 302 extend from the body of the base 120 around the plug 320 (and, as discussed below, around the at least one load sensor 130B) and attach to the piston 310. Thus, the plug 320B may be shaped to enable the side arms 302 to extend around the plug 320B (as illustrated, for example, in FIG. 17A), or the plug 320B may include holes or channels through which the side arms 302 pass. FIG. 17A illustrates the two side arms 302, but there may be more or fewer side arms 302, as long as the side arms 302 enable the piston 310 to be coupled securely to the base 120, and as long as the plug 320B may be securely affixed, directly or through an intervening mechanism, to the rigid rod 110.

Figure 17B:
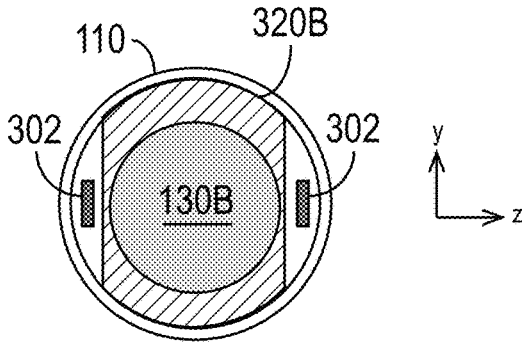
Figure 17C:
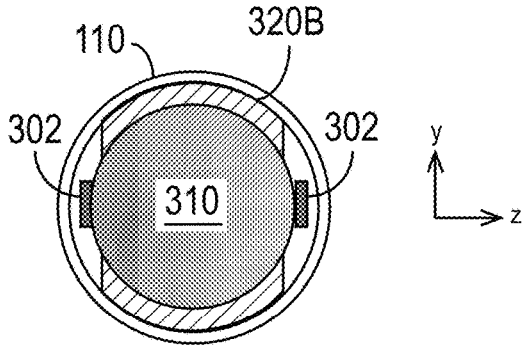
Figure 17D:
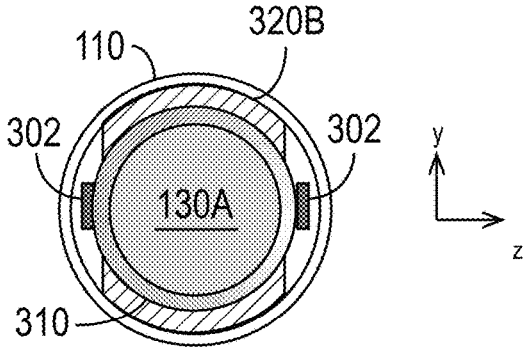
Figure 17E:
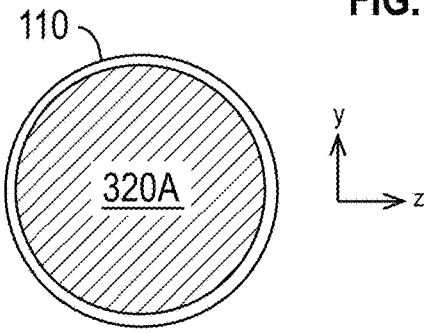

As shown in FIG. 17B, at the location along the longitudinal axis labeled by the dashed line B of FIG. 16A, the at least one load sensor 130B fits within the surface area of the plug 320B and is therefore clear of the side arms 302. FIG. 17C illustrates the cross-sectional view at the location along the longitudinal axis labeled by the dashed line C of FIG. 16A. A surface of the piston 310 is visible, as is the attachment of the side arms 302 to the piston 310. FIG. 17D illustrates the cross-sectional view at the location along the longitudinal axis 111 labeled by the dashed line D of FIG. 16A. The at least one load sensor 130A fits within the surface area of the piston 310. FIG. 17E illustrates the cross-sectional view at the location along the longitudinal axis labeled by the dashed line E of FIG. 16A. The surface of the plug 320A is visible. Because no component passes around the plug 320A, the plug 320A may, but is not required to, fill the inner circumference of the rigid rod 110 as shown in FIG. 17E. As discussed above in the context of FIG. 16D, if the rigid rod 110 is only partially hollow, the solid portion of the rigid rod 110 may take the place of the plug 320A.

Figure 18:
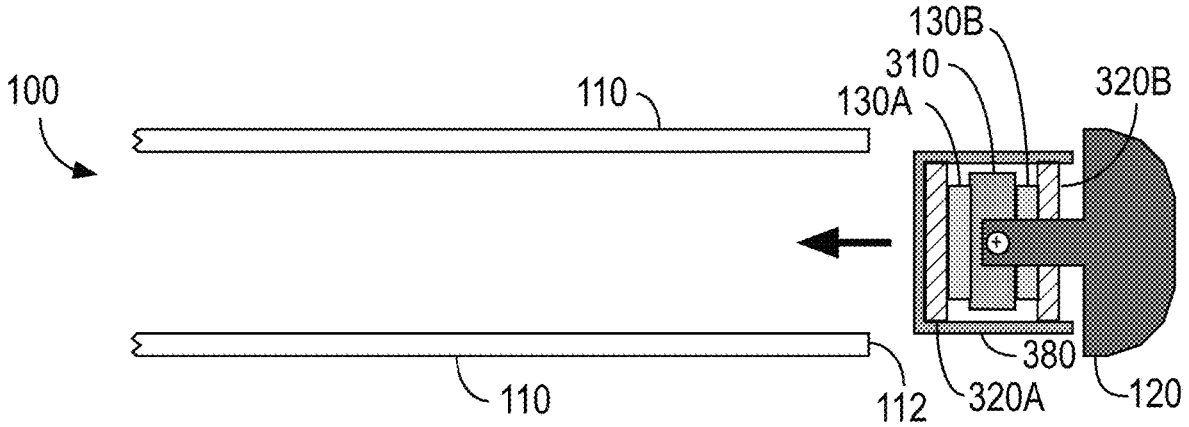
FIG. 18 illustrates a hardware sleeve that houses certain components of an exercise device in accordance with some embodiments.

Although FIGS. 16A-16D and 17A-17E illustrate the plugs 320B and (if applicable) 320A attached to the inner circumference of the rigid rod 110, it may be desirable to assemble the various components in a separate hardware container sized to fit within a hollow portion of the rigid rod 110, and then attach the hardware container to the inside of the rigid rod 110. For example, FIG. 18 illustrates a hardware sleeve 380 that houses the plugs 320A and 320B, the at least one load sensors 130A and 130B, and the piston 310. The hardware sleeve 380 may also house other components discussed elsewhere herein (e.g., the power supply 160, processor 140, etc.), or other components may be located outside of the hardware sleeve 380 but coupled to it through, for example, wiring. It is to be understood that the plug 320A may be eliminated if the hardware sleeve 380 has a sturdy end surface that can withstand the compressive longitudinal forces expected to compress the load sensor 130A, or if the rigid rod 110 is hollow only to the length of the hardware sleeve 380, in which case the end surface of the hardware sleeve 380 rests against the solid interior of the rigid rod 110. The plugs 320B and, if present, 320A may be attached directly to the hardware sleeve 380 by, for example, inserting the plugs 320B and (if present) 320A inside of the hardware sleeve, and then inserting fasteners (e.g., machine screws) from the outside of the hardware sleeve 380 into the sides of the plugs 320A and 320B. The hardware sleeve 380 may be inserted into a hollow portion of the rigid rod 110 and attached to the interior of the rigid rod 110 (e.g., by adhesive or any other fastener, such as, for example, a press fitting, latch, set screw, screw mechanism, pin, snap, bayonet mount, or expanding fastener). Such embodiments may have desirable cosmetic properties by allowing the plugs 320 to be securely attached to the hardware sleeve 380 without requiring a fastener to breach the outer surface of the rigid rod 110.

FIGS. 19A-19C illustrate an exemplary embodiment of an exercise device 100 capable of detecting a compressive longitudinal force similarly to the manner described in the context of FIGS. 10A and 10B, but in which the base 120 is separable from the rigid rod 110. FIG. 19A shows a cut-away view in the x-y plane (with the z-axis pointing out of the page toward the reader) with a break in the longitudinal direction of the rigid rod 110 to enable the second end 114 of the rigid rod 110 to be shown, and FIG. 19B shows a side view of the exemplary exercise device 100 in the x-z plane (with the y-axis pointing out of the page toward the reader) with a similar break in the rigid rod 110. FIG. 19C illustrates the separated rigid rod 110 and base 120 in the x-z plane.

In the embodiment illustrated in FIGS. 19A-19C, the base 120 is hollow and has inner and outer diameters that are substantially the same as those of the illustrated rigid rod 110, and it also includes an end cap 300. Thus, as this embodiment illustrates, the demarcation of what part of the exercise device 100 is the base 120 and which part is the rigid rod 110 may be somewhat arbitrary, and a portion of the rigid rod 110 may be considered part of the base 120. For example, when the rigid rod 110 is separable into a first portion 109A and a second portion 109B, one of which (e.g., the first portion 109A) houses the electronic components as discussed above in the context of FIG. 2A, whichever portion (e.g., the first portion 109A) houses the electronic components may be part of the base 120.

FIG. 19A illustrates the same components as discussed in the context of FIG. 10A, and the discussion of those components is not repeated here. In the embodiment shown in FIG. 19A, the base 120 includes the electronic components discussed previously, including the at least one load sensor 130, processor 140, display 150, and power supply 160, as well as the other components described in the discussion of FIG. 10A (e.g., the one or more connectors 340, circuit board 330, rigid plug 320, and piston 310). The base 120 may also include an amplifier 132 and ADC 134 as discussed in the context of FIG. 6B. Thus, the base 120 of FIG. 19A implements the block diagram 200F of FIG. 9E. The base 120 in the embodiment of FIG. 19A also includes an end cap 300, which may be flexible or rigid, and a base receptacle 430. In other embodiments, the base 120 does not include one or both of the end cap 300 or base receptacle 430. The base receptacle 430 may be made of the same material as the rigid rod 110 (e.g., if the rigid rod 110 is separable into multiple portions 109, the base receptacle 430 may be one of the portions 109), or it may be made of a different material. For example, if the rigid rod 110 is made of PVC, aluminum, or bamboo, the base receptacle 430 may also be made, respectively, of PVC, aluminum, or bamboo. Alternatively, the base receptacle 430 may be made of a different or convenient material.

FIG. 19B is a side view in the x-z plane (i.e., with the y-axis pointing out of the page toward the reader) of the exemplary exercise device 100 shown in FIG. 19A. The base receptacle 430 has a window (e.g., a transparent region) or a cutout through which the display 150 is visible. The discussion of FIG. 10B applies to FIG. 19B. FIG. 19C shows the exemplary exercise device 100 of FIGS. 19A and 19B in the x-z plane with the base 120 separated from the rigid rod 110. As illustrated in FIG. 19C, the rigid rod 110 includes a threaded portion 432 extending from a cylinder 434. The base 120 includes a complementary internal thread into which the cylinder 434 and threaded portion 432 may be rotatably fastened in the same way that a screw is fastened to a nut. Thus, the rigid rod 110 of FIG. 19C may be temporarily attached to the base 120 and removed from the base 120 at a later time.

As illustrated in the exemplary embodiment of FIGS. 19A-19C, when the base receptacle 430 is coupled to the rigid rod 110, the outer surfaces of the rigid rod 110 and base receptacle 430 are aligned, but it is to be appreciated that the base receptacle 430 outer surface need not align with the rigid rod 110 outer surface. It is also to be understood that the components illustrated in FIGS. 19A-19C are exemplary, and an exercise device 100 having a separable rigid rod 110 and base 120 need not include all of the illustrated components. For example, the base 120 may use a different mechanism than the piston 310 and rigid plug 320 to compress the at least one load sensor 130 (see, e.g., the discussion of FIGS. 20A-20C below), or the end cap 300 may be excluded from the base 120. The exercise device 100 may include more components than shown in FIGS. 19A-19C. Furthermore, although FIG. 19C illustrates a screw-like mechanism to couple the rigid rod 110 to the base 120, other mechanisms, such as those discussed previously in the context of FIGS. 2A and 2B, may be used instead. For example, the rigid rod 110 and base 120 may be coupled by one or more pins, or they may snap together, or they may be joined by a press fitting, a latch, or any other mechanism that firmly couples the base 120 to the rigid rod 110. Moreover, the rigid rod 110 and base 120 may be coupled by a sleeve, brace, scaffold, press-fitting, dowel rods, etc.

For simplicity, the embodiment illustrated in FIGS. 19A-19C does not include components to detect expansive longitudinal forces, but those components may be included, in which case the discussions above in the context of FIGS. 11A-11C, 12A-12B, 13A-13C, 14A-14B, 15A-15C, 16A-16D, and 17A-17E apply. Thus, it is to be appreciated that although FIGS. 19A-19C illustrate only those components used to detect compressive longitudinal forces, an exercise device 100 capable of detecting expansive longitudinal forces (either in addition to or instead of compressive longitudinal forces) may also have a separable rigid rod 110 and base 120. The hardware sleeve 380 described in the context of FIG. 18 may be a separable base 120.

As explained previously, the base 120 may be rigid or flexible, or the base 120 may simply be an end cap 300, such as shown in FIGS. 10A and 10B, among others. In some embodiments in which the base 120 is rigid, the base 120 is coupled to the rigid rod 110 so that the base 120 may move longitudinally (i.e., along the longitudinal axis 111) relative to the rigid rod 110 in response to a longitudinal force applied by a user. In some such embodiments, the exercise device 100 includes a separate compressible mechanism that holds the base 120 in a substantially fixed position when no longitudinal force is applied to the exercise device 100, but allows the base 120 to move longitudinally relative to the rigid rod 110 when a user applies a longitudinal force. For example, the base 120 may include a cavity that allows the first end 112 of the rigid rod 110 to be seated inside of, but move relative to, the base 120. When a user applies a compressive longitudinal force, the force compresses the compressible mechanism and thereby causes the rigid rod 110 to extend further into the base 120, thus reducing the overall length of the exercise device 100 while the user applies the longitudinal force. When the user removes the compressive longitudinal force, the compressible mechanism decompresses, and the overall length of the exercise device 100 returns to its original length.

Figure 20A:
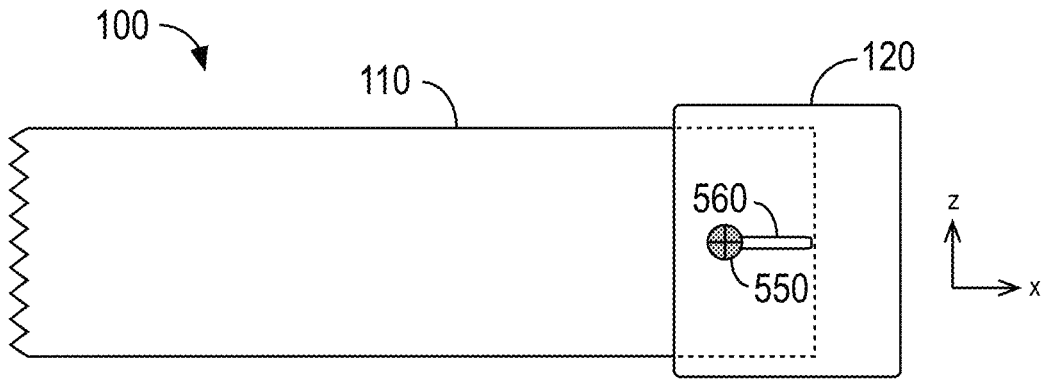
FIGS. 20A, 20B, and 20C illustrate an exemplary embodiment of an exercise device having a rigid base and a compressible mechanism in accordance with some embodiments.
Figure 20B:
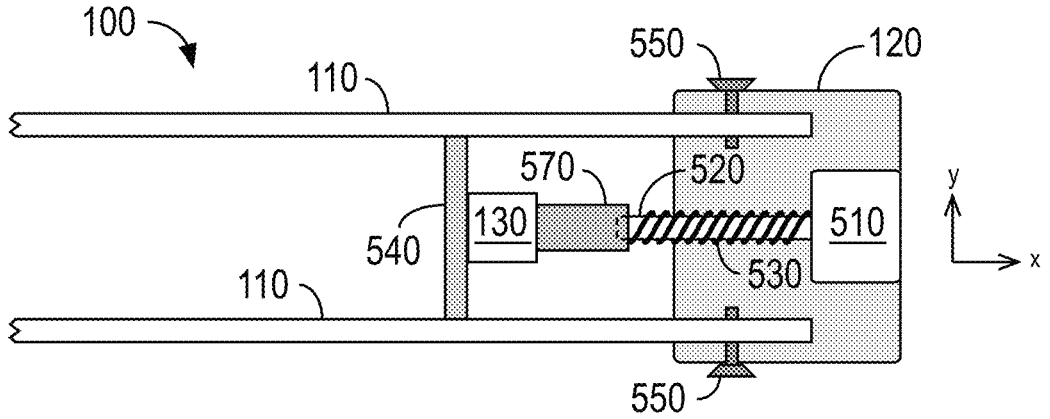
Figure 20C:
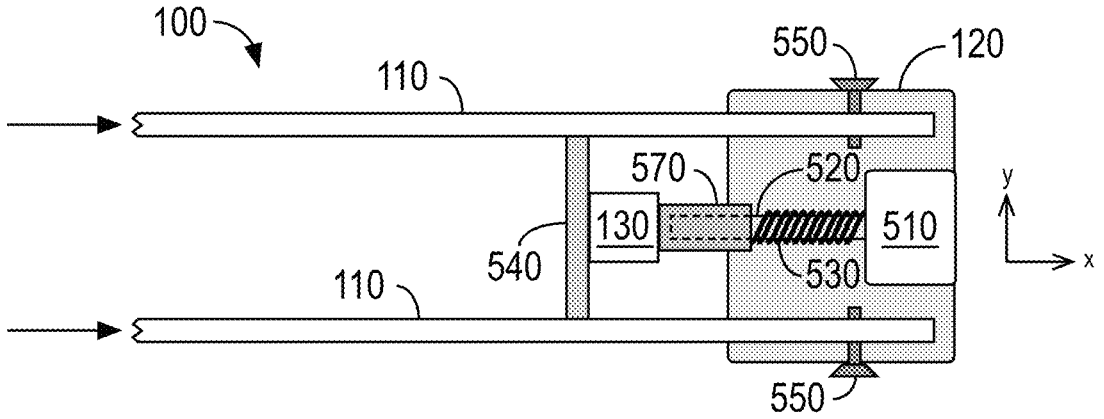

FIGS. 20A-20C illustrate an exemplary embodiment of an exercise device 100 having a rigid base 120 and a compressible mechanism. As illustrated in FIG. 20A, which shows a side view in the x-z plane of a portion of the exercise device 100 near the base 120, the rigid rod 110 extends into the base 120. The base 120 includes a slot 560. A fastener 550, shown in FIG. 20A as a screw but may be any suitable fastener, extends from the outside of the base 120 through the slot 560 and into the rigid rod 110 such that the fastener 550 is rigidly affixed to the rigid rod 110, and the rigid rod 110 is slidably engaged with the base 120. The slot 560 is small enough that the head of the fastener 550 cannot pass through the slot 560, but large enough that the body of the fastener 550 can slide along the length of the slot 560.

As shown in FIGS. 20B and 20C, which illustrate a cross-section in the x-y plane of the exemplary embodiment of the exercise device 100 shown in FIG. 20A, the compressible mechanism may include a spring 530 (e.g., an open-coil helical spring) wound or constructed to oppose compression along the axis of wind, that is, in the longitudinal direction. In the exemplary embodiment of FIGS. 20B and 20C, the spring 530 is placed over a spring rod 520 extending from a mount 510 in the base 120. The spring rod 520 is slidably engaged with a spring rod sleeve 570. The spring rod sleeve 570 includes a hole into which the spring rod 520 fits. The spring 530 is in contact with the spring rod sleeve 570 so that when a user applies a compressive longitudinal force to the exercise device 100, the spring rod sleeve 570 compresses the spring 530 as the spring rod 520 slides into the spring rod sleeve 570, as shown in FIG. 20C. The spring rod sleeve 570 is coupled to the at least one load sensor 130, which is coupled securely to the rigid rod 110 by a load sensor mount 540. It is to be appreciated that the spring rod 520 may alternatively be mounted to the rigid rod 110, and the positions of the mount 510 and spring rod sleeve 570 may be reversed so that the mount 510 is coupled to the rigid rod 110 (e.g., by the load sensor mount 540) and the spring rod sleeve 570 is coupled to the base 120. Likewise, the at least one load sensor 130 may be situated within the base 120 or within the rigid rod 110 (assuming the rigid rod 110 is hollow or includes a cavity 125 in which the at least one load sensor 130 may reside).

FIG. 20B illustrates the exemplary exercise device 100 with the compressible mechanism in the absence of a compressive longitudinal force applied by a user. As illustrated in FIG. 20C, when a user applies a compressive longitudinal force to the exercise device 100, he or she causes the rigid rod 110 to slide into the base 120, which causes the spring 530 to compress. The compressed spring 530 in turn presses on the spring rod sleeve 570, which presses on the at least one load sensor 130, which generates an electrical signal representing the applied compressive longitudinal force. This electrical signal may then be provided to a processor 140, as described above (e.g., potentially amplified by an amplifier 132 and converted from analog to digital format by ADC 134 before being provided to the processor 140).

Figure 21A:
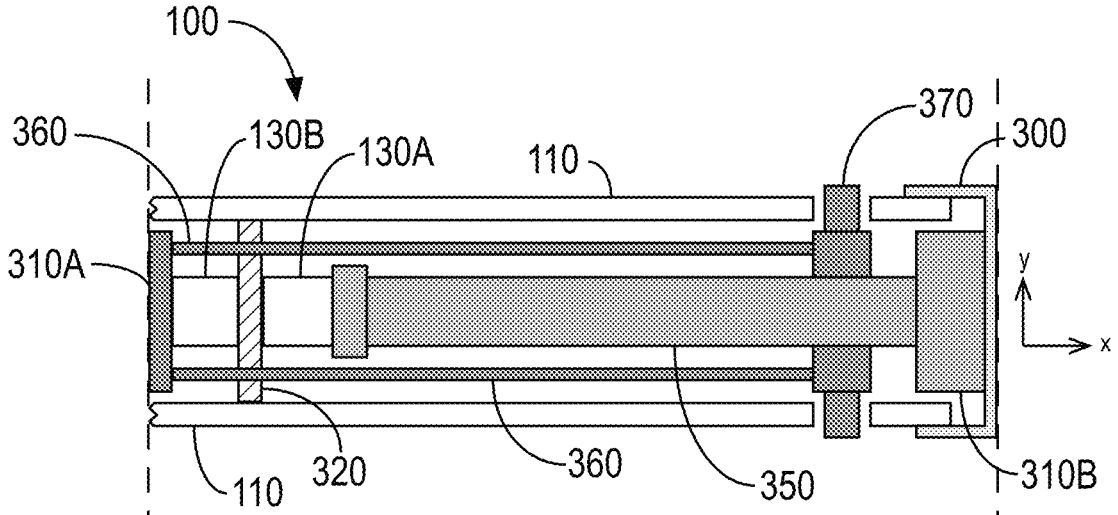
FIGS. 21A, 21B, and 21C illustrate an exercise device that allows electronic components to be situated at an arbitrary location within a rigid rod of the exercise device in accordance with some embodiments.

For ease of illustration, many of the exemplary embodiments illustrated herein (e.g., in FIGS. 10A, 10B, 11A-11C, 15A-15C, 16A-16D, 18, 19A-19C, and 20A-20C) show the electronic components situated near the first end 112 of the rigid rod 110, whether situated in the rigid rod 110 itself, in the base 120, or distributed among the rigid rod 110 and the base 120. As stated previously, some or all of the electronic components may be situated further away from the first end 112 of the rigid rod. For example, some or all of the electronic components may be situated closer to the midpoint of the rigid rod 110 (i.e., closer to the halfway point between the first end 112 and the second end 114). FIG. 21A illustrates one such embodiment that allows certain electronic components to be situated at an arbitrary location within a rigid rod 110 along the longitudinal axis. FIG. 21A is a cross-sectional view of an embodiment of the exercise device 100 in the x-y plane with the longitudinal axis 111 being the x-axis. As illustrated in FIG. 21A, the exercise device 100 includes at least one load sensor 130B, which detects expansive longitudinal forces, and at least one load sensor 130B, which detects compressive longitudinal forces. The at least one load sensors 130A and 130B are situated on either side of a plug 320, which is affixed to the rigid rod 110 either directly or through an intervening mechanism at a selected location along the longitudinal axis 111. The at least one load sensor 130B is sandwiched between the plug 320 and a piston 310A. FIG. 21A illustrates the at least one load sensor 130B in contact with both the plug 320 and the piston 310A, but other arrangements are possible, as long as the at least one load sensor 130B is able to detect expansive longitudinal forces. The piston 310A is coupled to at least one expansive force transfer rod 360. The at least one expansive transfer rod 360 is coupled to a attachment receptacle 198, which, as discussed elsewhere, allows a user to attach a attachment (e.g., attachment 314 illustrated in various forms in the drawings herein) to the exercise device 100. The attachment receptacle 198 may be any mechanism that enables a user to attach a desired attachment 314 to the exercise device 100. For example, the attachment receptacle 198 may be any of the attachment receptacles 198 discussed previously. Furthermore, although FIG. 21A illustrates an attachment receptacle 198, other attachment mechanisms may be used instead as discussed previously in the context of FIGS. 12A-12B, 13A-13C, 14A-14B, and 15A-15C.

The at least one load sensor 130A is sandwiched between the plug 320 and at least one compressive force transfer rod 350. FIG. 21A illustrates the at least one load sensor 130A in contact with both the plug 320 and the at least one compressive force transfer rod 350, but other arrangements are possible, as long as the at least one load sensor 130A is able to detect compressive longitudinal forces. The at least one compressive force transfer rod 350 is coupled to a piston 310B, which is coupled to an end cap 300 functioning as the base 120.

In some embodiments, the expansive-force-detection components of the exercise device 100 (i.e., the piston 310A, the at least one expansive force transfer rod 360, and the at least one load sensor 130B) operate independently of the compressive-force-detection components (i.e., the piston 310B, the at least one compressive force transfer rod 350, and the at least one load sensor 130A). In such embodiments, the at least one compressive force transfer rod 350 and the at least one expansive force transfer rod 360 move independently of each other. As illustrated in the embodiment of FIG. 21A, the at least one compressive force transfer rod 350 has a hole in the y-direction through which the attachment receptacle 198 passes, and the plug 320 has at least one hole in the x-direction through which the at least one expansive force transfer rod 360 passes. It is to be understood, of course, that the at least one compressive force transfer rod 350 could alternatively pass through the attachment receptacle 198. For example, if the attachment receptacle 198 did not need to accommodate a pin entering the attachment receptacle 198 on one side of the exercise device 100 and exiting the attachment receptacle 198 on the other side of the exercise device 100, the at least one compressive force transfer rod 350 could pass through the attachment receptacle. As yet another alternative, if the exercise device 100 includes another mechanism enabling an attachment 314 to be secured to the exercise device 100 (e.g., the attachment receptacle 198 or protrusion 199), the at least one compressive force transfer rod 350 need not interact with, and operates without interfering with, that mechanism. It will be appreciated in view of the disclosures herein that there are many ways to arrange the mechanical force transfer elements of the exercise device 100, and the examples provided herein are not intended to be limiting.

Figure 21B:
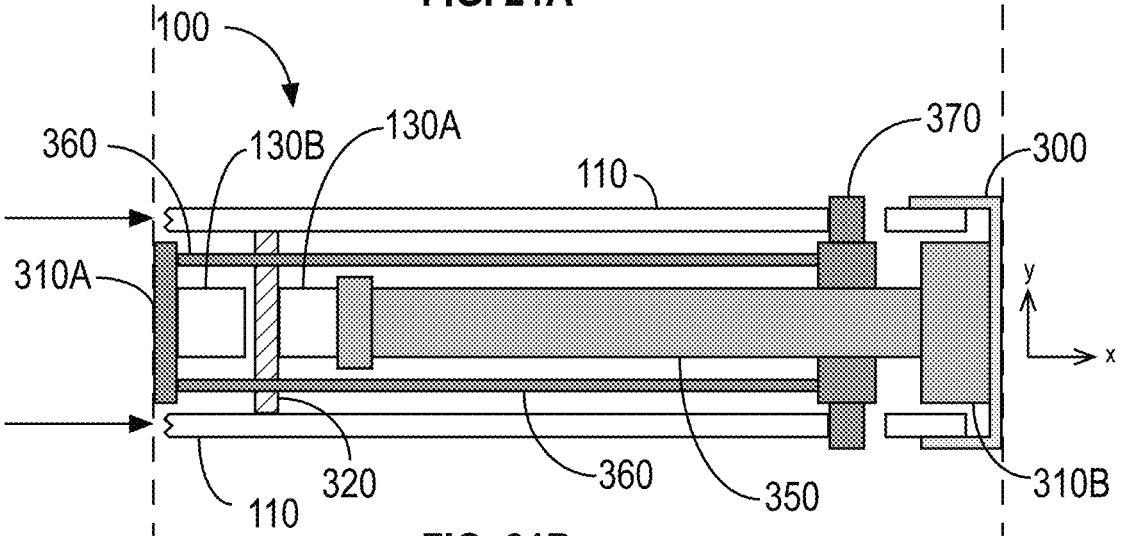

FIG. 21B illustrates how the various components of the exercise device 100 illustrated in FIG. 21A interact when a user applies a compressive longitudinal force to the exercise device (i.e., when the user pushes in the x-direction toward the end cap 300). For convenience, the location along the x-axis of the piston 310A in FIG. 21B is the same as in FIG. 21A, and the rigid rod 110 is illustrated as having moved toward the right side of the page because the user has applied a compressive longitudinal force. As shown in FIG. 21B, when the user applies a compressive longitudinal force, the rigid rod 110 moves slightly toward the piston 310A. Because the plug 320 is affixed to the rigid rod 110, the plug 320 moves with the rigid rod 110 and thereby compresses the at least one load sensor 130A between the plug 320 and the at least one compressive force transfer rod 350. Because the attachment receptacle 198 passes through a hole in the at least one compressive force transfer rod 350, the pull-detection components are not activated by the user's application of a compressive longitudinal force.

Figure 21C:
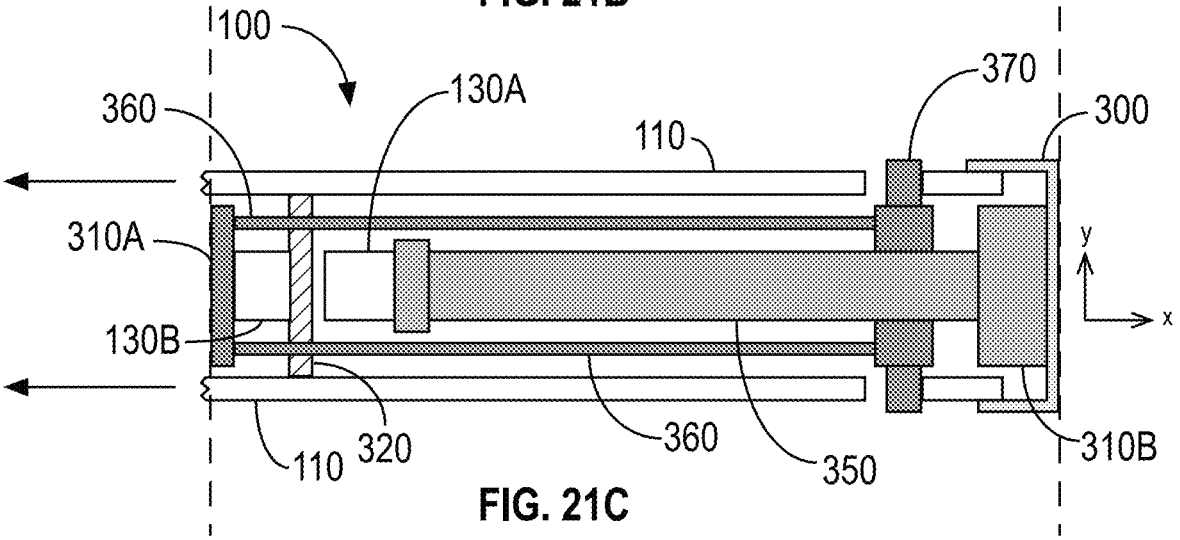

FIG. 21C illustrates how the various components of the exercise device 100 illustrated in FIG. 21A interact when a user applies an expansive longitudinal force to the exercise device (i.e., when the user attaches an attachment 314 using, for example, attachment receptacle 198, protrusion 199, or one of the mechanisms disclosed elsewhere herein and pulls on the exercise device 100 in the x-direction away from the end cap 300). Again, for convenience, the location along the x-axis of the piston 310B in FIG. 21C is the same as in FIGS. 21A and 21B. In FIG. 21C, the rigid rod 110 is illustrated as having moved toward the left side of the page because the user has applied an expansive longitudinal force. In this case, because the plug 320 is affixed to the rigid rod 110, the movement of the rigid rod 110 causes the at least one load sensor 130B to be compressed between the piston 310A and the plug 320. Because the means by which the attachment 314 is connected to the exercise device 100 (e.g., using the attachment receptacle 198) are decoupled from the push-detection components of the exercise device, the expansive longitudinal force does not activate the push-detection components.

By selecting suitable lengths for the at least one compressive force transfer rod 350 and the at least one expansive force transfer rod 360, a designer may situate the pistons 310A and 310B and the at least one load sensors 130A and 130B at a desired location along the longitudinal axis 111. It is to be understood that the lengths of the at least one compressive force transfer rod 350 and the at least one expansive force transfer rod 360 may also be selected to be smaller (e.g., minimized) to situate the pistons 310A and 310B and the at least one load sensors 130A and 130B closer to the first end 112 of the rigid rod 110. Thus, the configuration illustrated in FIGS. 21A-21C is suitable for many embodiments.

In some embodiments, the exercise device 100 includes at least one indicator to guide a user's workout and/or to provide feedback about an ongoing workout to the user of the exercise device 100. As used herein, a "force profile" specifies how a longitudinal force, whether compressive or expansive, varies with time. A user's workout with the exercise device 100 may be guided based on a target force profile, which specifies how much longitudinal force (compressive or expansive) the user should aim to apply to the exercise device 100 as a function of time. The exercise device 100 may provide feedback about the user's workout based on a comparison of an achieved force profile, which indicates how the longitudinal force actually applied by the user varies with time, to the target force profile. In other words, the exercise device 100 may provide feedback indicating whether the user's ongoing workout is meeting, exceeding, or falling short of the target workout represented by the target force profile. Similarly, the exercise device 100 may provide feedback regarding whether a previous workout met, exceeded, or fell short of an applicable target workout.

Figure 22:
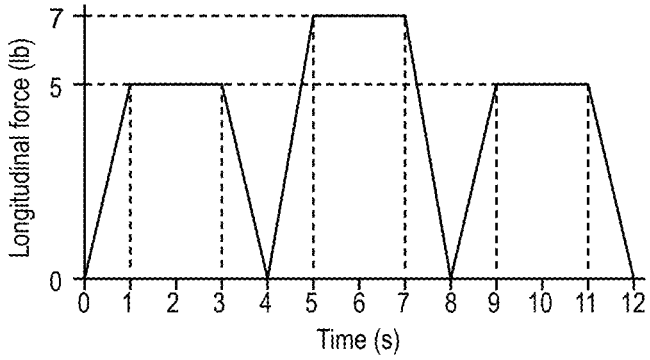
FIG. 22 illustrates an exemplary target force profile.

FIG. 22 illustrates a target force profile. In the example illustrated in FIG. 22, the target force profile specifies the target longitudinal force, in pounds, as a function of time, in seconds, for a set of exercises comprising three repetitions. The target force profile illustrated in FIG. 22 may have been configured by the user or by a third party (e.g., a personal trainer, doctor, physical therapist, etc.), or it may be a target force profile defined by the manufacturer of the exercise device 100.

With the convention that positive values of force represent compressive longitudinal forces and negative values of force represent expansive longitudinal forces, because FIG. 22 plots only positive values of longitudinal force, it represents a workout involving only compressive longitudinal forces (e.g., a workout comprising the lunge exercise discussed in the context of FIGS. 4A and 4B or any other exercise in which the user applies a compressive longitudinal force). Thus, the target force profile of FIG. 22 illustrates a set of three repetitions of an exercise in which the user is supposed to apply a compressive longitudinal force. During the first repetition, which is intended to take place from t=0 to 4 seconds, the user is supposed to apply an increasing longitudinal force for the first second, then hold a longitudinal force of five pounds for the next two seconds (from t=1 to 3 seconds), and then decrease the applied longitudinal force to zero during the next second (from t=3 to 4 seconds). During the second repetition, which is intended to take place from t=4 to 8 seconds, the user is supposed to apply an increasing longitudinal force from t=4 to 5 seconds, then hold a longitudinal force of seven pounds for the next two seconds (from t=5 to 7 seconds), and then decrease the applied longitudinal force to zero during the next second (from t=7 to 8 seconds). During the third repetition, which is intended to take place from t=8 to 12 seconds, the user is supposed to apply an increasing longitudinal force from t=8 to 9 seconds, then hold a longitudinal force of five pounds for the next two seconds (from t=9 to 11 seconds), and then decrease the applied longitudinal force to zero during the next second (from t=11 to 12 seconds).

As illustrated by the exemplary target force profile shown in FIG. 22, a target force profile may specify different target longitudinal forces for different repetitions in a set of exercises. Likewise, although not the case for the target force profile illustrated in FIG. 22, a target force profile may specify different amounts of time per repetition for different repetitions in a set or variable target forces during a single repetition (e.g., instead of the target force profile having a slope of zero between t=5 and 7 seconds, it could have an increasing or decreasing slope in that or any other interval). A force profile may also include rest periods between repetitions (i.e., periods in which the target longitudinal force is zero).

The target force profile may be represented in any convenient manner. For example, the target force profile may be represented by a table, e.g., with one row or column specifying times (absolute values or incremental) or time intervals, and another row or column specifying longitudinal force values (using a selected sign convention to distinguish between compressive and expansive longitudinal forces). As another example, the target force profile may be represented by a mathematical function representing how the longitudinal force applied by the user should vary as a function of time (e.g., by specifying the longitudinal force as a continuous or piece-wise function of time).

Figure 23A:
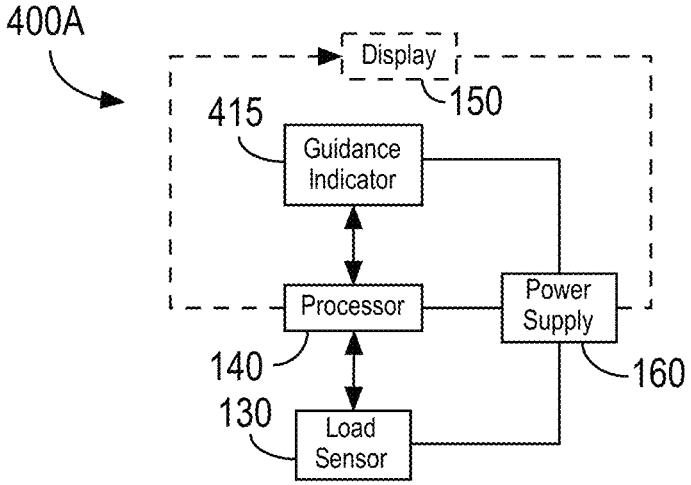
FIG. 23A is a block diagram illustrating some components of an exemplary exercise device having a guidance indicator in accordance with some embodiments.

FIG. 23A shows a block diagram 400A of various components in an exercise device 100 that provides workout guidance to a user of the exercise device 100 in accordance with some embodiments. In addition to various electronic components having functions and connections previously discussed, including a processor 140, at least one load sensor 130, a power supply 160, and, optionally, a display 150 (and, optionally, external memory 142, not shown in FIG. 23A), the exemplary exercise device 100 includes a guidance indicator 415 coupled to the processor 140 and the power supply 160. The processor 140 may send information or signals to the guidance indicator 415, which may then provide information to guide a user's workout. Such information may include, but is not limited to, any of the following information: an indication that the user should start a set of exercises or start a repetition of an exercise, a running total of repetitions performed, an indication of how many repetitions in a set are still to be performed, an indication of the timing of each repetition (e.g., that the user should take a first amount of time to lower her body into a down lunge position, hold that position for a second amount of time, and take a third amount of time to return to the original position), a target amount of compressive or expansive longitudinal force to apply during a repetition (e.g., based on a target force profile), a running total of applied longitudinal force (compressive, expansive, or both), and/or a running total of time under tension (compressive, expansive, or some combination of the two as discussed previously).

The processor 140 may provide information to the guidance indicator 415 based on a target force profile. If used, the target force profile may be stored within the exercise device 100 in, for example, the processor 140 memory or in external memory 142, if present, or it may be retrieved by the exercise device 100 from an external source (e.g., an external device, as discussed below, a website, a database, etc.).

The guidance indicator 415 may be any type of indicator that engages the user's senses to guide the user in his or her workout. For example, the guidance indicator 415 may be a visual indicator (e.g., the display 150, a set of one or more light sources, as discussed below, etc.), an auditory indicator (e.g., a speaker), or haptic indicator (e.g., a device that causes the exercise device 100 or some component of the exercise device 100 to vibrate).

In some embodiments, the guidance indicator 415 is an auditory indicator that provides the guidance as, for example, sounds. For example, the guidance indicator 415 may emit a first sound to instruct the user to begin a set of exercises, a second sound to instruct the user to increase the applied longitudinal force, a third sound to instruct the user to hold the applied longitudinal force, and fourth sound to instruct the user to decrease the applied longitudinal force. As another example, the guidance indicator 415 may be capable of emitting a synthesized or recorded human voice to provide guidance in words or sentences (e.g., "Get ready!," "GO!," "Push!," "Hold!," "Ease up!," "Two reps to go!," "You're done!," etc.). It is to be appreciated that there are many ways an auditory indicator could be configured to guide a user through a workout, and the examples given herein are not intended to be limiting.

In some embodiments, the guidance indicator 415 is a haptic device. For example, the guidance indicator 415 may use a first vibration pattern to instruct the user to begin a set of exercises, a second vibration pattern to instruct the user to increase the applied longitudinal force, a third vibration pattern to instruct the user to hold the applied longitudinal force, and fourth vibration pattern to instruct the user to decrease the applied longitudinal force. The selected vibration patterns may differ in any of frequency, intensity, duration, and/or any other characteristic of a haptic device. It is to be appreciated that there are many ways a haptic indicator could be configured to guide a user through a workout, and the examples given herein are not intended to be limiting.

In some embodiments, the guidance indicator 415 is a visual indicator that provides the guidance as, for example, numbers, characters, icons, graphics, charts, or graphs on the display 150. Although FIG. 23A illustrates the display 150 as separate from the guidance indicator 415, it is to be understood that the display 150, if present, may provide the guidance, thereby incorporating the function of the guidance indicator 415 and obviating the need for a separate device to provide guidance in the exercise device 100. In other words, the display 150 and guidance indicator 415 shown in FIG. 23A may be one and the same.

If the guidance indicator 415 is a visual indicator that is capable of rendering information in color, different colors may be used to convey the guidance information to the user. For example, if an icon conveys to a user how many repetitions remain in a set, the color or size of the icon may vary based on the number of repetitions remaining (e.g., the color of the icon may change from red to yellow to green as the user completes a specified number or percentage of repetitions, or the icon may shrink or grow as the user performs more repetitions in a set, etc.). As another example, the guidance indicator 415 may present a graph or bar that instructs the user on the timing of a repetition and/or the target amount of longitudinal force to be applied during a repetition (e.g., the visual indicator may plot, in real time, a target force on a graph having time and force axes to guide the user's application of longitudinal force over time, or the length of a bar can indicate the amount of longitudinal force the user should apply and/or the timing of a repetition, etc.). It is to be appreciated that there are many ways to present information to guide a user visually in a workout, and the examples provided herein are not intended to be limiting.

Figure 23B:
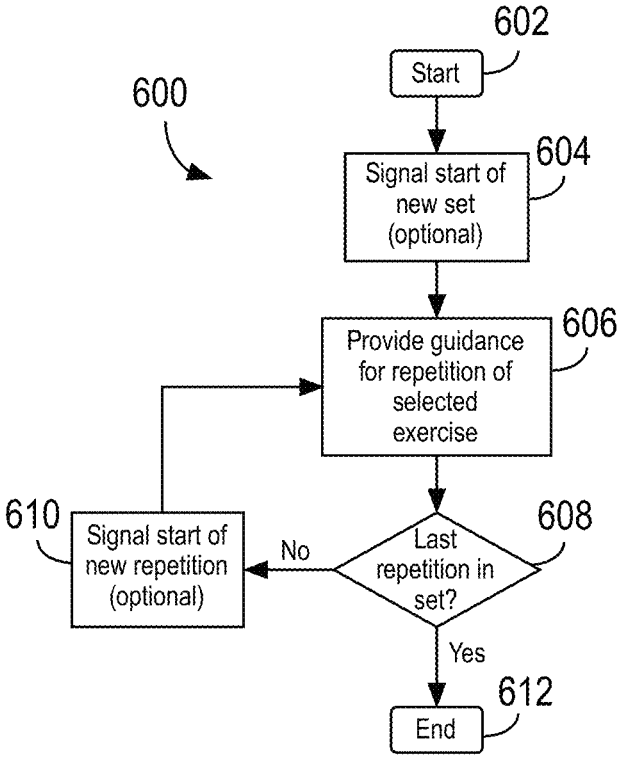
FIG. 23B is a flowchart illustrating a process to provide guidance for a user's workout in accordance with some embodiments.

FIG. 23B is a flowchart illustrating how the processor 140 controls the guidance indicator 415 in accordance with some embodiments. At 602, the process 600 begins. At 604, the processor 140 optionally causes the guidance indicator 415 to instruct the user to prepare to perform a new set of exercises (i.e., a collection of at least one repetition of an exercise). The guidance indicator 415 may, for example, cause a light source to blink or change color, cause a "READY" message to be presented, or cause the exercise device 100 to vibrate using a selected pattern or emit a selected sound. At 606, the processor 140 causes the guidance indicator 415 to provide guidance for a repetition of the selected exercise (e.g., by providing information (e.g., visually, aurally, or through a haptic mechanism) to assist the user to perform the exercise at a desired pace and/or to apply a target longitudinal force). As explained above, the guidance provided may be based on a target force profile, which may specify different target compressive and/or expansive longitudinal forces and/or different amounts of time per repetition for different repetitions in a set. After the guidance indicator 415 has provided guidance for the repetition, at 608, the processor 140 determines whether the repetition most recently performed was the last repetition in the set. If not, at 610, the processor 140 optionally causes the guidance indicator 415 to inform the user that a new repetition will start, or the processor 140 simply causes the guidance indicator 415 to provide guidance for the next repetition at 606. When, at 608, the processor 140 determines that the repetition most recently performed was the last repetition in the set, the process 600 ends at 612.

The processor 140 may adapt the target force profile, and, therefore, the guidance provided by the guidance indicator 415, based on the user's performance during a workout (i.e., based on the achieved force profile). For example, as described below, the processor 140 may monitor the amount of longitudinal force actually applied by the user during a repetition or during a set. Based on the monitored applied longitudinal force, the processor 140 may modify the target force profile and/or the guidance provided by the guidance indicator 415. As one example, if the processor 140 determines that the user is consistently applying less longitudinal force than specified by the target force profile, the processor 140 may adjust the target force profile and/or information provided to the guidance indicator 415 so that the maximum target longitudinal force is lower (e.g., using the target force profile of FIG. 22 as an example, the processor 140 may adjust the target force between 1 and 3 seconds to 4 pounds, the target force between 5 and 7 seconds to 6 pounds, and the target force between 9 and 11 seconds to 4 pounds). Likewise, if the processor 140 determines that the user is consistently applying more longitudinal force than specified by the target force profile, the processor 140 may adjust the target force profile and the guidance provided by the guidance indicator 415 so that the target longitudinal force is higher.

Figure 24A:
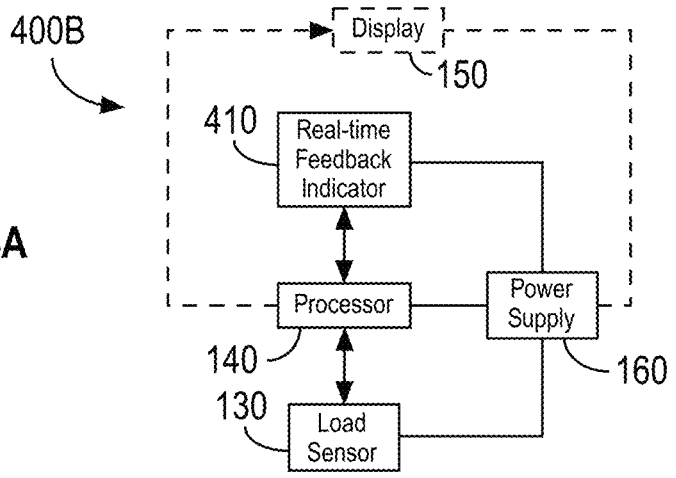
FIG. 24A is a block diagram illustrating some components of an exemplary exercise device having a real-time feedback indicator in accordance with some embodiments.

In addition to, or instead of, providing guidance to assist a user in performing a workout using the exercise device 100, the processor 140 may provide real-time feedback about an ongoing workout. FIG. 24A shows a block diagram 400B of various components in an exemplary exercise device 100 that provides real-time feedback to a user in accordance with some embodiments. As shown in the block diagram 400B, the exercise device 100 includes several of the electronic components having functions and connections previously described, including a processor 140, at least one load sensor 130, a power supply 160, and, optionally, a display 150. As explained previously, the exercise device 100 may also include external memory 142 (not shown in FIG. 24A). In addition, the exemplary exercise device 100 of FIG. 24A includes a real-time feedback indicator 410 coupled to the processor 140 and the power supply 160. The processor 140 may send information or signals to the real-time feedback indicator 410, which may then provide real-time (i.e., from the user's perspective, instantaneous or near-instantaneous) feedback about the user's ongoing workout. Such feedback may include, but is not limited to, any or all of the following information: an indication of whether the user is applying enough, too little, or too much longitudinal force (e.g., based on a comparison of the achieved force profile and a target force profile); an indication of a number of repetitions that have been performed; an indication of the number of the repetition that is being performed (e.g., the fourth repetition of ten is being performed); an indication of an amount of time over which a longitudinal force has been applied; an indication of an aggregate amount of longitudinal force that has been applied; an indication of whether a repetition is being performed too quickly, too slowly, or at a target speed (e.g., based on a comparison of the achieved force profile and a target force profile); an indication of a time under tension (e.g., an aggregate time under tension (compressive, expansive, or a combination) for the set, the time under tension (compressive, expansive, or a combination) for an in-progress repetition or for the last repetition, etc.).

The real-time feedback indicator 410 may be any type of indicator that engages the user's senses to convey feedback about the user's workout. For example, the real-time feedback indicator 410 may be a visual indicator (e.g., the display 150, a set of one or more light sources, as discussed below, etc.), an auditory indicator (e.g., a speaker), or an indicator that provides haptic feedback (e.g., by causing the exercise device 100 or some component of the exercise device 100 to vibrate).

In some embodiments, the real-time feedback indicator 410 is an auditory indicator that provides the feedback as, for example, sounds. For example, the real-time feedback indicator 410 may emit a first sound to inform the user that the amount of longitudinal force being applied is less than a target force, a second sound to inform the user that the applied longitudinal force is meeting the target force, and a third sound to inform the user that the applied longitudinal force exceeds the target force. Alternatively, the real-time feedback indicator 410 may not emit a sound if the applied longitudinal force meets the target force. As another example, the real-time feedback indicator 410 may be capable of emitting a synthesized or recorded human voice to provide feedback in words or sentences (e.g., "Good!," "You're doing great!," "Push harder!," "Pull harder!," "Ease up!," "10 pounds!," "You beat your goal!," "100 pound-seconds of time under tension!," "You did 50 reps today!," etc.). It is to be appreciated that there are many ways an auditory indicator could be configured to provide feedback about a workout, and the examples given herein are not intended to be limiting.

In some embodiments, the real-time feedback indicator 410 is a haptic device. For example, the real-time feedback indicator 410 may use a first vibration pattern to inform the user that the amount of longitudinal force being applied is less than a target force, a second vibration pattern to inform the user that the applied longitudinal force is meeting the target force, and a third vibration pattern to inform the user that the applied longitudinal force exceeds the target force. Alternatively, the real-time feedback indicator 410 may not emit a vibration pattern if the applied longitudinal force meets the target force. The selected vibration patterns may differ in any of frequency, intensity, duration, and/or any other characteristic of a haptic device. It is to be appreciated that there are many ways a haptic indicator could be configured to provide feedback about a workout, and the examples given herein are not intended to be limiting.

In some embodiments, the real-time feedback indicator 410 is a visual indicator that provides real-time feedback in the form of, for example, numbers, characters, icons, graphics, charts, or graphs on the display 150. Although FIG. 24A illustrates the display 150 as separate from the real-time feedback indicator 410, it is to be understood that the display 150, if present, may provide the real-time feedback, thereby incorporating the function of the real-time feedback indicator 410 and obviating the need for a separate real-time feedback indicator device in the exercise device 100. In other words, the display 150 and real-time feedback indicator 410 shown in FIG. 24A may be one and the same.

If the real-time feedback indicator 410 is a visual indicator that is capable of rendering information in color, different colors may be used to convey real-time feedback to the user. For example, if an icon conveys whether the user is applying a specified amount of longitudinal force (e.g., a target set by the user or a third party, such as a personal trainer, doctor, physical therapist, etc.), the color of the icon may vary based on the longitudinal force actually applied by the user (e.g., the icon may be red if the user is not applying enough longitudinal force, blue if the user is applying the target amount of longitudinal force, and green if the user is applying a longitudinal force greater than the target amount of longitudinal force). Likewise, if a chart conveys whether the user is performing repetitions of an exercise at a desired speed, the color of the chart may vary based on the rate at which the user is performing a repetition (e.g., the chart may be red if the user is performing repetitions too quickly, yellow if the user is performing repetitions too slowly, and green if the user is performing repetitions at the desired speed). It is to be appreciated that there are many ways the exercise device 100 may present real-time feedback, and the examples provided herein are not intended to be limiting.

Figure 24B:
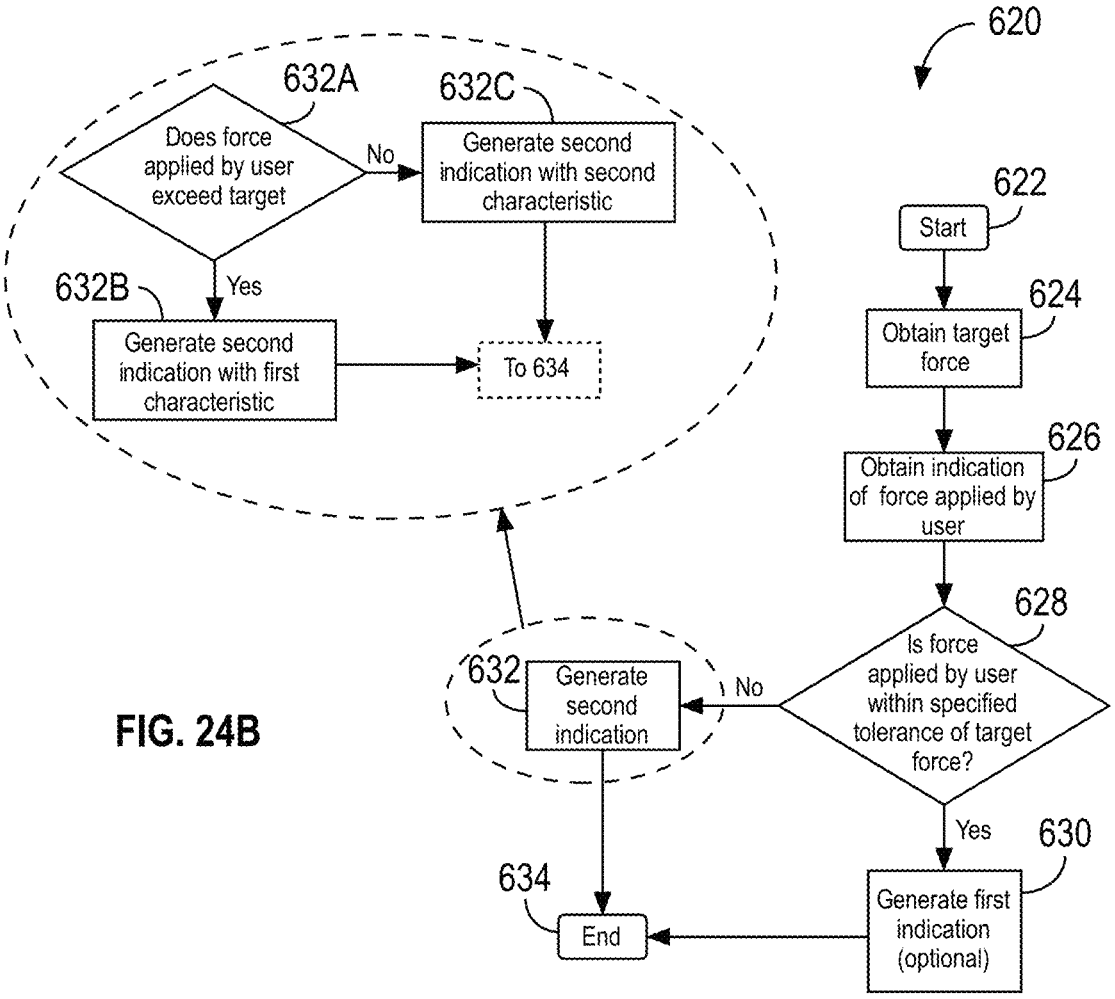
FIG. 24B is a flowchart illustrating a process to provide real-time feedback about a user's workout in accordance with some embodiments.

FIG. 24B is a flowchart illustrating how the processor 140 controls the real-time feedback indicator 410 in accordance with some embodiments. The flowchart illustrates a process 620 that the processor 140 may perform once or multiple times during each repetition of an exercise set in order to provide the user with timely feedback regarding the user's performance relative to a target performance, such as, for example, a target force profile. The processor 140 may perform the process 620 multiple times per second or at any rate that provides the user with timely feedback. It is to be appreciated that although it is preferred that the real-time feedback indicator 410 provide feedback perceived by the user as occurring in real time, the real-time feedback indicator 410 may in some embodiments provide feedback at a rate the user perceives as delayed. In other words, the feedback provided by the real-time feedback indicator 410 need not be real-time or near-real-time. Embodiments in which feedback is provided only after a repetition, set, or workout are specifically contemplated herein.

At 622, the process 620 begins. To provide feedback to the user regarding his or her performance at a selected time t, at 624, the processor 140 obtains a target force (i.e., an amount of longitudinal force the user is supposed to be applying) at time t for the repetition of the exercise being performed. The processor 140 may, for example, obtain the target force from a target force profile. At 626, the processor 140 obtains an indication of the longitudinal force applied by the user at the designated time t. For example, the processor 140 may retrieve from its internal memory, from the external memory 142 (if present), or directly from the at least one load sensor 130 (or, if present, the A/D converter 134) a recent or current signal or data representative of the longitudinal force applied by the user at time t. At 628, the processor 140 determines whether the longitudinal force applied by the user at time t is within a specified tolerance of the target longitudinal force. The specified tolerance may be useful to account for the fact that the user is unlikely to be able to apply consistently exactly the target amount of longitudinal force, and that the user should get credit for applied longitudinal forces that are within the specified tolerance of the target. The tolerance may be specified so that values of the applied longitudinal force that are close to the target are considered as meeting the target force. For example, the specified tolerance may be some percentage of the target force so that if the applied longitudinal force is within that percentage of the target longitudinal force, the user is considered to be meeting the target longitudinal force. Alternatively, the specified tolerance may be specified in units of force. For example, the specified tolerance may be 0.5 pounds, 2 pounds, or some other amount of force. The specified tolerance may differ for different exercises. For example, the specified tolerance may be 0.5 pounds for an exercise in which the user is expected to be able to apply only five pounds of longitudinal force, but the specified tolerance may be 2 pounds or more for an exercise in which the user is expected to be able to apply 30 pounds of longitudinal force. Similarly, if expressed as a percentage, the tolerance may be lower for an exercise having a smaller target force than for an exercise having a higher target force. The specified tolerance may be set by the user or a third party (e.g., a personal trainer, doctor, physical therapist, etc.), or it may be defined by the manufacturer of the exercise device 100. The specified tolerance may be zero.

Referring again to FIG. 24B, if, at 628, the processor 140 determines that the longitudinal force applied by the user at time t is within the specified tolerance of the target force, then at 630, the processor 140 optionally causes the real-time feedback indicator 410 to generate a first indication (e.g., a first sound, vibration pattern, or visual indicator). Alternatively, if the force applied by the user at time t is within the specified tolerance of the target force, the real-time feedback indicator 410 may not generate any indication (e.g., the processor 140 may only cause the real-time feedback indicator 410 to provide feedback to the user if the achieved longitudinal force is not within the tolerance of the target longitudinal force). If the longitudinal force applied by the user is not within the specified tolerance of the target force, at 632, the processor 140 causes the real-time feedback indicator 410 to generate a second indication. At 634, the process 620 ends.

When, at 628, the processor 140 determines that the longitudinal force applied by the user is not within the specified tolerance of the target longitudinal force, it may be desirable for the user to know whether he or she is exceeding or falling short of the target longitudinal force. Therefore, the second indication may optionally have a characteristic that depends on whether the achieved longitudinal force is greater than the target longitudinal force or less than the target longitudinal force. For example, FIG. 24B illustrates how the processor 140 may optionally cause the real-time feedback indicator 410 to vary a characteristic of the second indicator based on whether the applied longitudinal force exceeds or falls below the target longitudinal force. At 632A, the processor 140 determines whether the longitudinal force applied by the user exceeds the target longitudinal force. If so, then at 632B, the processor 140 causes the real-time feedback indicator 410 to generate the second indication with a first characteristic (e.g., a first color, size, intensity, volume, words, command, vibration pattern, etc.). If the longitudinal force applied by the user does not exceed the target longitudinal force, at 632C, the processor 140 causes the real-time feedback indicator 410 to generate the second indication having a second characteristic (e.g., a second color, size, intensity, volume, words, command, vibration pattern, etc.). The second characteristic may be the same type as the first characteristic (e.g., both are visual), or it may be different. For example, the first characteristic may be a sound, and the second characteristic may be a vibration. Alternatively, the second indication with the first characteristic may be a light source having a first color, and the second indication with the second characteristic may be that same light source having a second color, or it may be a second light source having the first, second, or even a third color. It is to be appreciated that there are many ways that the real-time feedback indicator 410 can indicate whether the applied force exceeds or falls short of a target, and the examples presented herein are not intended to be limiting.

Although FIG. 24B assumes that, in the exemplary process 620, the generation of the first indication at 630 is optional and the generation of the second indication at 632 is not optional, and thus that the processor 140 optionally notifies the user if the applied force is within the specified tolerance but always notifies the user if the applied force is not within the specified tolerance, it is to be appreciated that the generation of the first indication at 630 may be non-optional and the generation of the second indication at 632 may be optional, in which case the processor 140 optionally notifies the user if the applied force is not within the specified tolerance but always notifies the user when the applied force is within the specified tolerance. The processor 140 may, of course, cause the generation of both the first indication at 630 and the second indication at 632 (with the second indication potentially having first and second characteristics depending on whether the achieved longitudinal force exceeds or falls short of the target longitudinal force).

Figure 25:
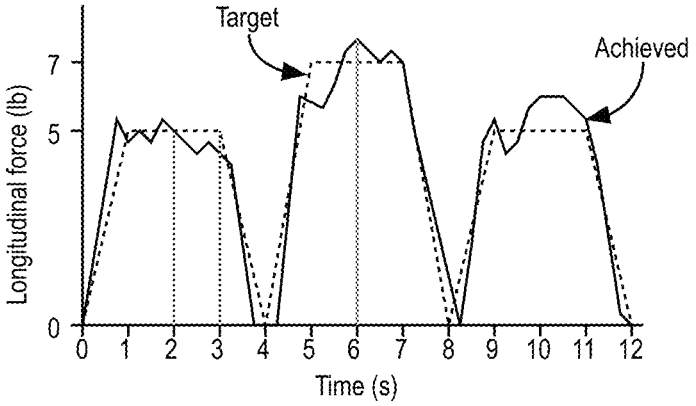
FIG. 25 illustrates an exemplary target force profile and an exemplary achieved force profile.

To provide a concrete example of how the processor 140 may use the real-time feedback indicator 410 to provide real-time feedback to the user, the process 620 illustrated in FIG. 24B is explained in the context of FIG. 25, which plots both a target force profile (dashed curve, identical to the target force profile shown in FIG. 22) and a user's achieved force profile (solid curve). First, assume the time at which the process 620 is executed is t=2 seconds. According to the target force profile of FIG. 25, the user should be applying 5 pounds of longitudinal force at t=2 seconds. Thus, at 624 of FIG. 24B, the target force obtained by the processor 140 is 5 pounds. At 626, the processor 140 obtains an indication of the longitudinal force actually applied by the user. According to the achieved force profile shown in FIG. 25, the user applied exactly 5 pounds of longitudinal force at t=2 seconds. Therefore, at 628, the processor determines that the longitudinal force applied by the user is within the specified tolerance of the target force. At 630, the processor 140 optionally generates a first indication, through the real-time feedback indicator 410, to inform the user that achieved longitudinal force is sufficient (i.e., meeting the target longitudinal force).

Now let the time at which the process 620 is executed be t=3 seconds. According to the target force profile of FIG. 25, the user should be applying 5 pounds of longitudinal force at t=3 seconds. Thus, at 624, the target force obtained by the processor 140 is 5 pounds. At 626, the processor 140 obtains an indication of the longitudinal force actually applied by the user. According to the achieved force profile shown in FIG. 25, the user applied less than 5 pounds of longitudinal force at t=3 seconds. Therefore, at 628, the processor determines whether the longitudinal force applied by the user is within the specified tolerance of the target force. If the specified tolerance is or evaluates to (e.g., if specified as a percentage) a small number, such as, for example, 0 or 0.1 pound, the processor 140 determines at 628 that the longitudinal force applied by the user is not within the specified tolerance of the target force and proceeds to 632. If, however, the specified tolerance is or evaluates to a larger number, such as, for example, 1 pound, the processor 140 determines at 628 that the longitudinal force applied by the user is within the specified tolerance of the target force and proceeds to 630.

As explained above, if the achieved longitudinal force is not within the specified tolerance of the target force, the processor 140 may optionally cause the real-time feedback indicator 410 to indicate whether the achieved force exceeds or falls short of the target force. Thus, at t=3 seconds, if the tolerance is such that the achieved force is not within the tolerance of the target force, the processor 140 may cause the real-time feedback indicator 410 to indicate that the applied longitudinal force is lower than the target longitudinal force. For example, if the real-time feedback indicator 410 comprises a light source, the processor 140 may cause the light source to blink, flash, or emit light of a particular color (e.g., red) to indicate that the applied longitudinal force is too low. As another example, if the real-time feedback indicator 410 comprises an auditory indicator capable of synthesizing a human voice, the processor 140 may cause the auditory indicator to say, for example, "Push harder!," "Tired today?," or "Almost there!"

Now let the time at which the process 620 is executed be t=6 seconds. According to the target force profile of FIG. 25, the user should be applying 7 pounds of longitudinal force at t=6 seconds. Thus, at 624, the target force obtained by the processor 140 is 7 pounds. At 626, the processor 140 obtains an indication of the longitudinal force actually applied by the user. According to the achieved force profile shown in FIG. 25, the user applied more than 7 pounds of longitudinal force at t=6 seconds. Therefore, at 628, the processor determines whether the longitudinal force applied by the user is within the specified tolerance of the target longitudinal force. If the specified tolerance is or evaluates to a small number, such as, for example, 0 or 0.1 pound, the processor 140 determines at 628 that the longitudinal force applied by the user is not within the specified tolerance of the target longitudinal force and proceeds to 632. If, however, the specified tolerance is or evaluates to a larger number, such as, for example, 1 pound, the processor 140 determines at 628 that the longitudinal force applied by the user is within the specified tolerance of the target force and proceeds to 630.

As explained above, when the achieved longitudinal force is not within the specified tolerance of the target longitudinal force, the processor 140 may optionally cause the real-time feedback indicator 410 to indicate whether the achieved force exceeds or falls short of the target force. Thus, at t=6 seconds, if the tolerance is such that the achieved longitudinal force is not within the tolerance of the target longitudinal force, the processor 140 may cause the real-time feedback indicator 410 to indicate that the applied longitudinal force exceeds the target longitudinal force. For example, if the real-time feedback indicator 410 comprises a light source, the processor 140 may cause the light source to blink, flash, or emit light of a particular color (e.g., green) to indicate that the applied force exceeds the target. If the processor 140 causes the light sources to blink or flash, the pattern may be different from when the applied longitudinal force falls short of the target to inform the user whether he or she is underachieving or overachieving. As another example, if the real-time feedback indicator 410 comprises an auditory indicator capable of synthesizing a human voice, the processor 140 may cause the auditory indicator to say, for example, "Ease up, Conan!," "You're killing it!," "New record!," or "Great job!"

The specified tolerance need not be symmetrical about the target longitudinal force. In other words, to perform step 628 of FIG. 24B, the processor 140 may determine whether the longitudinal force actually applied by the user is greater than the target longitudinal force by a first specified tolerance or less than the target longitudinal force by a second specified tolerance that differs from the first specified tolerance. The use of asymmetrical tolerances about the target longitudinal force may be desirable to encourage users to achieve better performance in their workouts. For example, if the first specified tolerance is or evaluates to a larger value than the second specified tolerance, users will have to work harder to obtain the feedback that they have exceeded the target longitudinal force, but they will be alerted if the applied longitudinal force falls short of the target longitudinal force by a smaller number.

Figure 26:
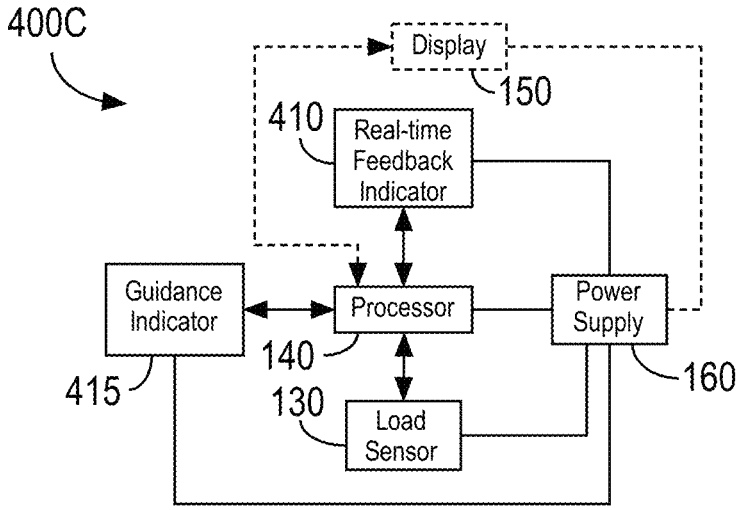
FIG. 26 is a block diagram illustrating some components of an exemplary exercise device having a guidance indicator and a real-time feedback indicator in accordance with some embodiments.

The exercise device 100 may include both a real-time feedback indicator 410 and a guidance indicator 415, as illustrated in the exemplary block diagram 400C of FIG. 26. In the embodiment of FIG. 26, both the real-time feedback indicator 410 and the guidance indicator 415 are coupled to and in communication with the processor 140, and both are powered by the power supply 160. Although FIG. 26 illustrates the real-time feedback indicator 410 and the guidance indicator 415 as separate blocks, the real-time feedback indicator 410 and the guidance indicator 415 may be combined (e.g., as explained below, a single set of one or more light sources may serve as both the real-time feedback indicator 410 and the guidance indicator 415, or a single auditory or haptic device may serve as both the real-time feedback indicator 410 and the guidance indicator 415). Moreover, although FIG. 26 illustrates the display 150 as separate from the real-time feedback indicator 410 and the guidance indicator 415, it is to be understood that the display 150, if present, may provide the guidance and/or the real-time feedback, thereby incorporating the functions of one or both of the guidance indicator 415 and the real-time feedback indicator 410 and obviating the need for separate guidance and real-time feedback devices in the exercise device 100. In other words, the display 150, real-time feedback indicator 410, and guidance indicator 415 shown in FIG. 26 may be one and the same, or the display 150 may provide the functionalities of the real-time feedback indicator 410 and/or the guidance indicator 415.

In some embodiments, the real-time feedback indicator 410 and/or the guidance indicator 415 comprises one or more light sources. The one or more light sources may be, for example, light-emitting diodes (LEDs). The one or more light sources may be attached to the outside of the exercise device 100 (e.g., to the outside of the rigid rod 110 or to the outside of the base 120), or they may be mounted inside of the rigid rod 110 or the base 120 in a manner that enables the user of the exercise device 100 to see the one or more light sources (e.g., the rigid rod 110 or base 120 may be transparent or translucent, or it may have windows or holes through which light from the one or more light sources may emerge, etc.). As another alternative, described below, the one or more light sources may reside in a housing attached to the outside of the rigid rod 110 or the base 120. For example, as explained below, the rigid rod 110 may include a groove or channel into which a strip fits, and the one or more light sources may reside within or under the strip.

Figure 27A:
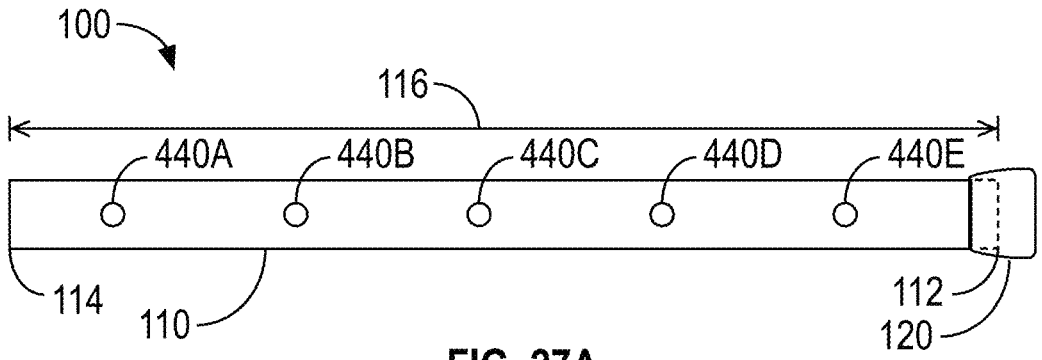
FIGS. 27A, 27B, 27C, and 27D illustrate exemplary exercise devices that include one or more light sources to provide guidance and/or real-time feedback to users.

FIG. 27A illustrates an exemplary exercise device 100 having an array of light sources 440A through 400E as the real-time feedback indicator 410 and/or the guidance indicator 415. FIG. 27A illustrates the exercise device 100 having five light sources 440 spaced along the rigid rod 110 between the first end 112 and the second end 114, but more or fewer than five light sources 440 may be used and may be arranged differently than shown (e.g., nonuniformly, closer to one end of the rigid rod 110 than the other, on the base 120, around the circumference of the rigid rod 110 rather than longitudinally, etc.). The light sources 440 may be individual, non-connected lights, or they may be part of a connected array of light sources 440, such as, for example, a strip of LEDs, which may be individually controllable (e.g., part number NFLS-RGBX2-LC4, available at https://www.superbrightleds.com). The processor 140 may control the light sources 440A through 400E individually (e.g., by turning on different light sources 440 at different times or in different colors) or as a group (e.g., by turning on all light sources 440A through 400E together in a selected color). The processor 140 may also be able to control the intensity of the light emitted by some or all of the light sources 440.

The one or more light sources 440 may be mounted on the surface of the rigid rod 110. If the one or more light sources 440 are mounted on the surface of the rigid rod 110, they may be mounted at locations where the user is unlikely to grasp the rigid rod 110, and/or the one or more light sources 440 may have a low profile (e.g., they do not protrude significantly from the outer surface of the rigid rod 110) so that their presence does not create discomfort or difficulty in exercising for a user who grasps the rigid rod 110 in a location where a light source 440 resides.

Figure 28A:
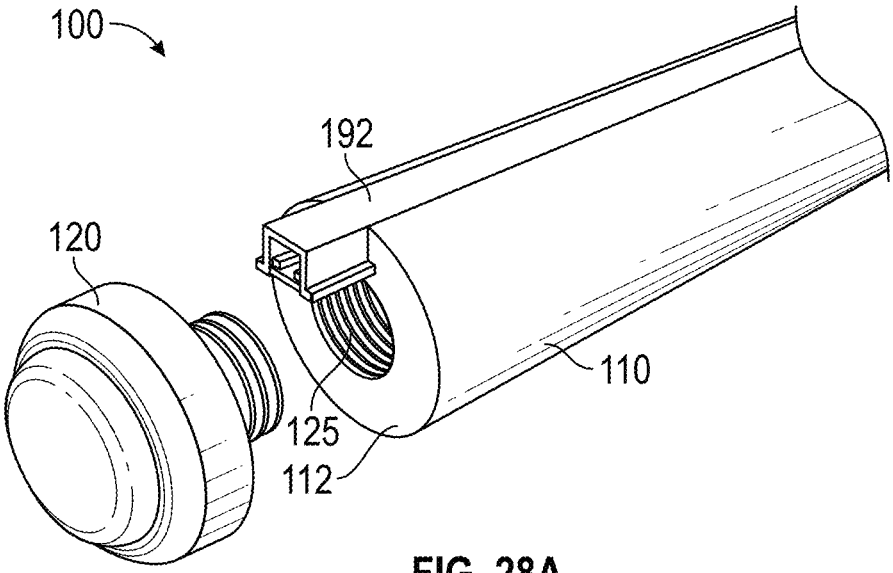
FIGS. 28A and 28B illustrate a rigid rod with a channel in its outer surface in which one or more light sources are mounted in accordance with some embodiments.
Figure 28B:
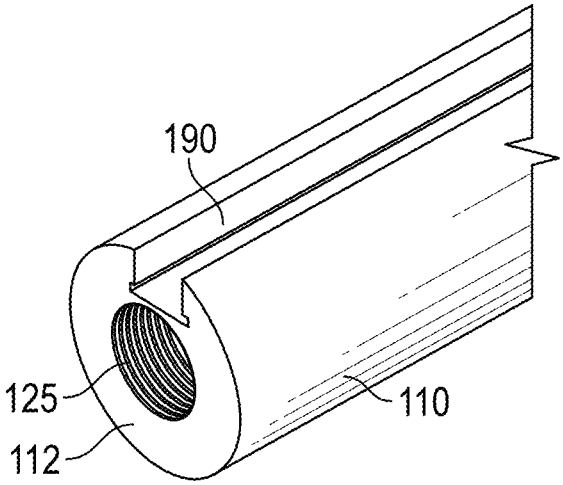

If the rigid rod 110 is solid, or if the rigid rod 110 is partially or fully hollow but has a suitably large wall thickness, or if the rigid rod 110 is manufactured to include a channel, the rigid rod 110 may have a channel in its outer surface in which the one or more light sources 440 are mounted. FIGS. 28A and 28B illustrate such an embodiment. As shown in FIG. 28B, the outer surface of the rigid rod 110 includes a channel 190. The channel 190 may extend the entire length 116 of the rigid rod 110, or it may be shorter than the length 116 of the rigid rod 110. The dimensions of the channel 190 are such that the channel 190 does not intrude into the hollow cavity 125, which may be used to house electronic components as discussed herein, at the first end 112 of the rigid rod 110. In such embodiments, the one or more light sources 440 are disposed within the channel 190. In some embodiments, the one or more light sources 440 are disposed within a strip 192 that slides into or is otherwise configured to be disposed within the channel 190, as illustrated in FIG. 28A. The strip 192 may be transparent or translucent. The strip 192 may be made from a light-diffusing material. The strip 192 may be made of plastic. Alternatively, the strip 192 may be opaque with holes, slits, or the like to allow light emitted from the one or more light sources 440 to emerge from the strip 192. For example, the strip 192 may be made of metal or another opaque material but have holes, slits, or the like. As shown in FIG. 28A, the strip 192 may have a shape such that when the strip 192 is in place in the channel 190, the rigid rod 110 has the same shape that it would have had absent the channel 190 and strip 192 (e.g., if the rigid rod 110 is cylindrical, the rigid rod 110 with the strip 192 inserted is also cylindrical). In some embodiments, as illustrated in FIG. 28A, the base 120 is inserted into the hollow cavity 125 after the strip 192 is in place, which mitigates movement of the strip 192 after final assembly of the exercise device 100. Although FIGS. 28A and 28B illustrate the channel 190 extending longitudinally along the rigid rod 110, the channel 190 may alternatively extend transversally, around the circumference 115 of the rigid rod 110. Moreover, the exercise device 100 may include more than one strip 192.

If the rigid rod 110 is partially or entirely hollow, the one or more light sources 440 may be mounted inside of the rigid rod 110. If the rigid rod 110 is made of an opaque material that would otherwise prevent the one or more light sources 440 from being visible to a user, one or more holes, slits, or the like may be made in the rigid rod 110 to allow a user to see light from the one or more light sources 440. The dimensions of the one or more holes, slits, or the like may be selected so that the one or more light sources 440 fit within the one or more holes, slits, or the like. The dimensions of the one or more holes, slits, or the like may also be selected so that the rigid rod 110 retains its structural integrity (i.e., remains capable of withstanding the maximum compressive and expansive longitudinal forces the user is expected to be able to apply).

Figure 29:
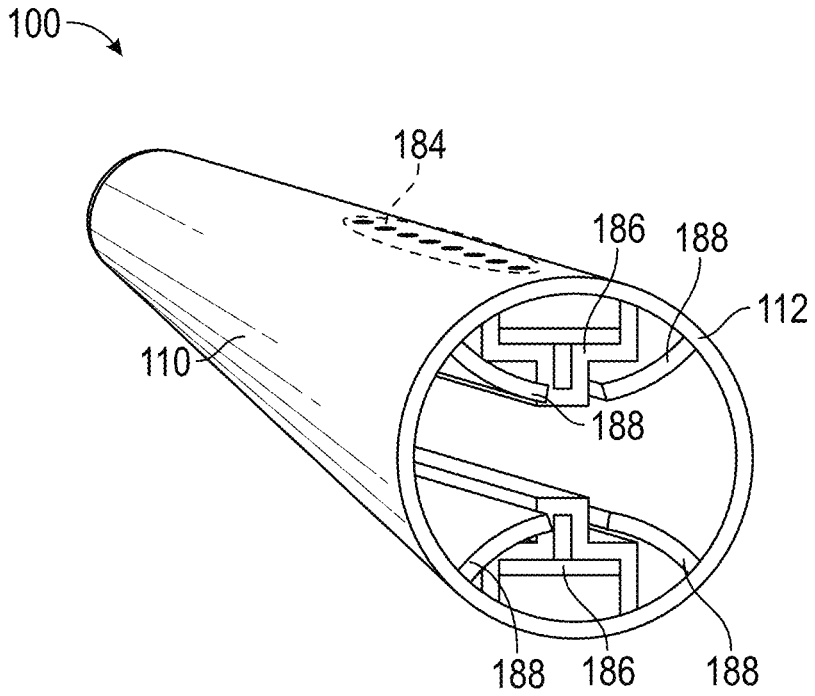
FIGS. 29 and 30 illustrate an exercise device with a hollow rigid rod that includes ribs to support at least one rigid rod insert in accordance with some embodiments.
Figure 30:
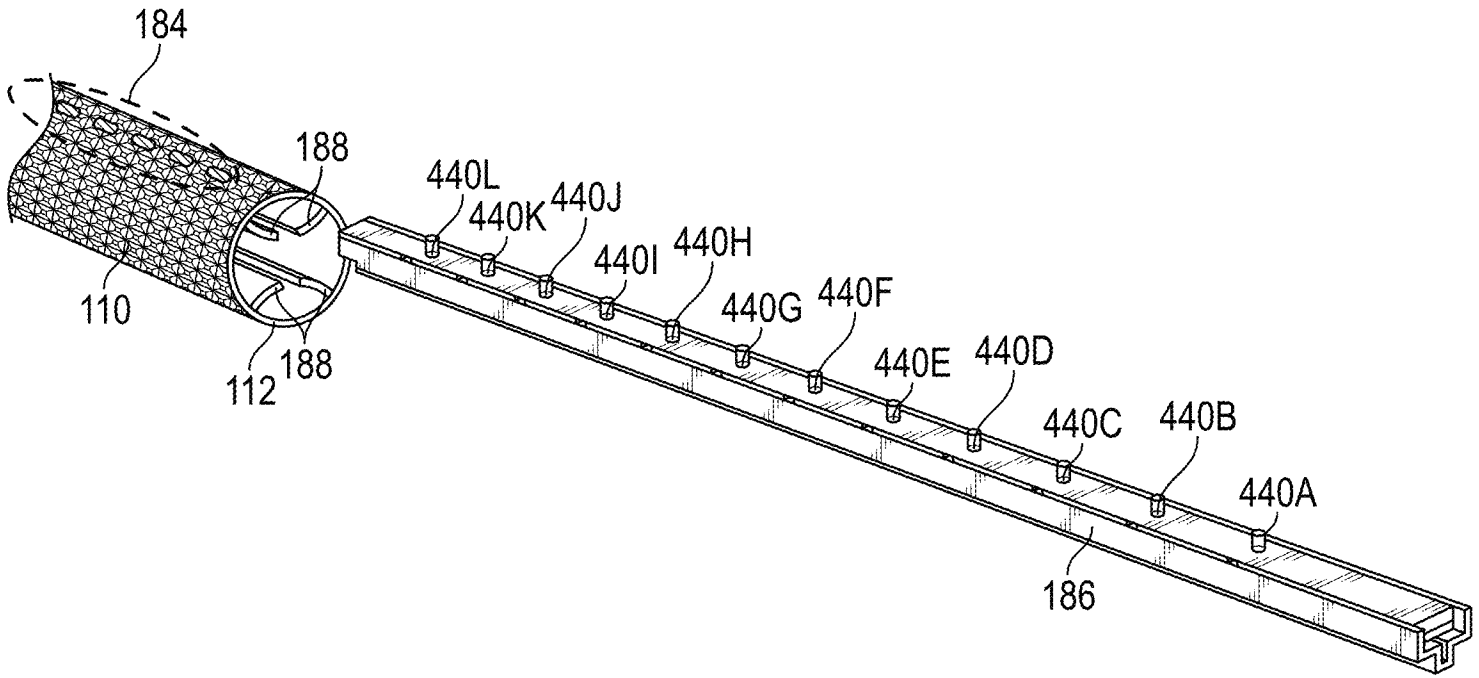

FIGS. 29 and 30 illustrate embodiments in which the rigid rod 110 is hollow and includes ribs 188 that support at least one rigid rod insert 186. The rigid rod insert 186 is coupled to the one or more light sources 440. The rigid rod 110 in the embodiments of FIGS. 29 and 30 includes a set of holes, slits, or windows 184 that align with the one or more light sources 440 when the at least one rigid rod insert 186 is inserted in the rigid rod 110. The rigid rod 110 shown in the embodiments of FIGS. 29 and 30 may be fabricated by, for example, extrusion, casting, CNC machining, vacuum forming, thermo-forming, weaving (e.g., for carbon fiber), injection molding, or any other suitable manufacturing process. The rigid rod 110 may be fabricated without the holes, slits, or windows 184, which may be created in a separate manufacturing step. Alternatively, the rigid rod 110 may be fabricated with the holes, slits, or windows 184.

A rigid rod 110 made of a transparent or translucent material may allow light from the one or more light sources 440 to be visible to a user without the need for holes, slits, or the like in the rigid rod 110. In some embodiments, the rigid rod 110 is translucent and at least partially hollow, and one or more light sources 440 are mounted inside of the rigid rod 110. For example, the one or more light sources 440 may be mounted to the inner surface of the rigid rod 110, or they may be mounted or coupled to a structure (e.g., a circuit board, a skeleton structure, ribs 188, etc.) situated within the rigid rod 110, such as the rigid rod insert 186 illustrated in FIGS. 29 and 30.

If the rigid rod 110 comprises clear PVC or clear plastic, a portion or all of the clear PVC or clear plastic may be subjected to a process that causes the rigid rod 110 to have a frosted appearance to cause light from the one or more light sources 440 to diffuse, which may make the light easier for a user to see. Examples of processes that may be used to give clear PVC a frosted appearance include, but are not limited to, sanding the PVC with sandpaper, sandblasting the PVC, applying a frost spray (e.g., Rust-Oleum® Specialty Frosted Glass Spray) to the inner or outer surface of the PVC, or applying an adhesive film to the inner or outer surface of the PVC.

When the exercise device 100 includes one or more light sources 440, those one or more light sources 440 may be used as the real-time feedback indicator 410 and/or the guidance indicator 415, and the processor 140 may control the one or more light sources 440 to provide guidance and/or real-time feedback to a user. As one example of using the one or more light sources 440 as the guidance indicator 415, referring again to FIG. 27A, the processor 140 may count down to the beginning of a set of exercises by turning on all light sources 440, and then turning off the light sources 440, one by one (e.g., first turning off light source 440E, then 440D, etc., or first turning off light source 440A, then 440B, etc., or vice versa), until all light sources 440 are off. Alternatively, the processor 140 may count down to the beginning of a set by turning on the light sources 440 one by one (e.g., first turning on light source 440A, then 440B, etc.) until all light sources 440 are on. As yet another example, the processor 140 may also, or alternatively, cause the light sources 440 to blink or flash a designated number of times to indicate to the user that the beginning of a set is imminent.

As an example of using the one or more light sources 440 as the real-time feedback indicator 410, the processor 140 may indicate how many repetitions the user has performed, or how many repetitions remain, by turning on various of the one or more light sources 440 at different times. For example, the processor 140 may indicate how many repetitions the user has performed by turning on a different one of the one or more light sources 440 for each repetition performed. Referring to FIG. 27A, the processor 140 may turn on light source 440A after the user has completed the first repetition, then turn on light source 440B after the user has completed the second repetition, etc. FIG. 27A shows only five light sources 440, but the exercise device 100 may include more or fewer light sources 440, and if the number of one or more light sources 440 is at least as large as the number of repetitions in a set, different light sources 440 may be used to count up or down the number of repetitions.

The processor 140 may use subsets of the one or more light sources 440, such as those shown in FIG. 27A, to implement the real-time feedback indicator 410 and the guidance indicator 415. For example, the light sources 440A through 400C may be used as the guidance indicator 415, and the light sources 440D and 400E may be used as the real-time feedback indicator 410 to provide real-time feedback to a user performing a set of exercises. To assist the user in distinguishing which set of light sources 440 provides guidance and which provides real-time feedback, the exercise device 100 may include an indication (e.g., a label, a stamp, a mark, etc.) on the surface of the exercise device 100 to indicate which light sources 440 provide guidance and which provide real-time feedback.

As an example of how the processor 140 may implement the guidance indicator 415 using light sources 440A through 440C, the processor 140 may turn on the light source 440A to instruct the user to perform a first phase of an exercise (e.g., lower his body into the down lunge position of FIG. 4B while applying a longitudinal force, or pull herself into the position shown in FIG. 5B). The processor 140 may turn on the light source 440B (either instead of or in addition to light source 440A) to instruct the user to perform a second phase of the exercise (e.g., to hold the current position while continuing to apply a longitudinal force). The processor 140 may turn on the light source 440C (either instead of or in addition to one or both of light sources 440A and 440B) to instruct the user to perform a third phase of the exercise (e.g., to return to the position shown in FIG. 4A if the user is performing the exemplary lunge exercise or the position shown in FIG. 5A if the user is performing the exemplary pull-up exercise). The processor 140 may cause one or more of the light sources 440A through 400C to blink to indicate that the next phase is near or imminent. Alternatively, or in addition, the processor 140 may change the intensity of one or more of the light sources 440A through 400C to indicate the user's progress through the current phase of the exercise (e.g., the intensity of the light sources 440A through 400C can increase (or decrease) to indicate the user's progress through a phase of the exercise).

Continuing the example, the processor 140 may provide real-time feedback using the light sources 440D and 440E. For example, the processor 140 may turn on the light source 440D to inform the user that the amount of longitudinal force being applied is lower than a target longitudinal force (or less than the target longitudinal force by more than a specified tolerance), and the processor 140 may turn on the light source 440E to inform the user that the amount of longitudinal force being applied is higher than the target longitudinal force (or higher than the target longitudinal force by more than the specified tolerance). Alternatively, or in addition, the processor 140 may cause one or both of the light sources 440D and 440E to blink to indicate that the amount of longitudinal force being applied is higher or lower than a specified target longitudinal force. The processor 140 may also (or alternatively) change the intensity of one or both of the light sources 440D and 440E to indicate that the amount of longitudinal force being applied is higher or lower than the specified target longitudinal force. It is to be appreciated that there are many ways the processor 140 may control the light sources 440 shown in FIG. 27A to provide guidance and/or real-time feedback to a user of the exercise device 100, and the examples provided herein are not intended to be limiting.

In some embodiments, the one or more light sources 440 are capable of providing light in at least two colors, and the processor 140 controls the color(s) of the light emitted by the one or more light sources 440 to provide real-time feedback and/or guidance to the user of the exercise device 100. For example, referring to the exemplary embodiment illustrated in FIG. 27A, if each of the light sources 440A through 440E is capable of producing light in two colors, a first color and a second color, and the processor 140 is capable of controlling each light source 440 separately, the processor 140 may implement the guidance indicator 415 and the real-time feedback indicator 410 in a variety of ways.

As one example, the light sources 440A through 440D may provide guidance, and the light source 440E may provide real-time feedback. The processor 140 may turn on the light sources 440A through 440D, one by one, in a first color to indicate that the user should perform a first phase of an exercise (e.g., lowering his body into the lunge position of FIG. 4B while applying a longitudinal force, or pulling her body from the position shown in FIG. 5A to the position shown in FIG. 5B) and the timing of that first phase (e.g., by turning on the light sources 440 at a selected rate to guide the user to take a desired amount of time to perform the first phase of the exercise). The processor 140 may then change the color of the light sources 440A through 440D to a second color to indicate that the user should hold his or her position during a second phase of the exercise. The processor 140 may then change the color of the light sources 440A through 440D back to the first color and sequentially turn off the light sources 440A through 440D to instruct the user to perform a third phase of the exercise according to the specified timing (e.g., to return to the position shown in FIG. 4A or in FIG. 5A, as applicable, at a rate such that by the time the last light source 440 in the sequence turns off, the user has returned to the starting position). Alternatively, the processor 140 need not change the color of the light sources 440A through 440D back to the first color before turning off the light sources 440; instead, the processor 140 may leave the light sources 440 in the second color and turn off the light sources 440A through 440D in a predetermined order to guide the user in performing the third phase of the exercise.

Continuing the example, the light source 440E may be used to provide real-time feedback about the user's workout. For example, the processor 140 may turn on the light source 440E in a Color A to indicate that the user is applying more than a target amount of longitudinal force (possibly taking into account a specified tolerance) and Color B to indicate that the user is applying less than a target amount of longitudinal force (possibly taking into account the specified tolerance or a different tolerance). The processor 140 may also cause the light source 440E to blink or flicker to indicate, for example, that the user is performing the current phase of the exercise too quickly or too slowly. Alternatively, or in addition, the processor 140 may change the intensity of light emitted by the light source 440E based on, for example, the amount by which the longitudinal force applied by the user exceeds or falls short of the target or desired force. For example, if Color A is green, and Color B is red, the processor 140 may cause the light source 440E to emit a low-intensity green when the amount of longitudinal force applied by the user exceeds the target value by less than 10 percent, a mid-intensity green when the amount of longitudinal force applied by the user exceeds the target value by between 10 percent and 20 percent, and the most intense green possible when the amount of longitudinal force applied by the user exceeds the target value by more than 20 percent. As another example, the processor 140 may cause the light source 440E to emit a low-intensity red when the amount of longitudinal force applied by the user falls short of the target value by less than 5 percent, a mid-intensity red when the amount of longitudinal force applied by the user falls short of the target by between 5 and 10 percent, and the highest-intensity red when the amount of longitudinal force applied by the user falls short of the target value by more than 10 percent.

There are many other ways the processor 140 may use the one or more light sources 440, such as those shown in FIG. 27A, to implement the real-time feedback indicator 410 and/or the guidance indicator 415. In some embodiments, the processor 140 uses one of the one or more light sources 440 to guide the user and then uses other of the one or more light sources 440 to provide feedback. For example, referring to FIG. 27A, the processor 140 may use the light source 440B to represent the target force. As the user applies a longitudinal force to the exercise device 100, the processor 140 may cause the light sources 440C, 440D, and/or 440E to emit light based on the force applied by the user. For example, the processor 140 may cause the light source 440E to emit light when the user has applied at least 25 percent of the target force but less than 50 percent. The processor 140 may cause both light source 440E and 440D to emit light when the user has applied at least 50 percent of the target force, but less than 75 percent. The processor 140 may cause all of light sources 440E, 440D, and 440C to emit light when the user has applied at least 75 percent of the target force, but less than 100 percent. Finally, the processor 140 may cause all of light sources 440E, 440D, 440C, and 440B to emit light when the user is meeting the target force (taking into account any defined tolerance), perhaps in a different color to indicate that the user has met the target. The processor 140 may cause the light source 440A to emit light (e.g., green or red) to indicate that the user has exceeded the target force.

As another example, referring again to FIG. 27A, the processor 140 may use the light source 440A to represent the target force. As the user applies a longitudinal force to the exercise device 100, the processor 140 may cause the light sources 440B, 440C, 440D, and/or 440E to emit light based on the force applied by the user. For example, the processor 140 may cause the light source 440E to emit light when the user has applied at least 20 percent of the target force but less than 40 percent. The processor 140 may cause both light source 440E and 440D to emit light when the user has applied at least 40 percent of the target force, but less than 60 percent. The processor 140 may cause light sources 440E, 440D, and 440C to emit light when the user has applied at least 60 percent of the target force, but less than 80 percent. Finally, the processor 140 may cause all of light sources 440E, 440D, 440C, 440B, and 440A to emit light when the user is meeting the target force (taking into account any defined tolerance), perhaps in a different color to indicate that the user has met the target. Likewise, the processor 140 may cause all of the light sources 440E, 440D, 440C, 440B, and 440A to emit light of another color to indicate that the user has exceeded the target.

In a sense, the approaches described immediately above encourage the user to "chase" and possibly "pass" the guidance light source by applying longitudinal force. It is to be appreciated that the processor 140 may manipulate the light sources 440 in many ways to encourage the user to apply the target longitudinal force and to provide feedback to the user regarding the applied force, and the examples provided herein are not meant to be limiting. Moreover, the exercise device 100 may include more than one type of guidance or feedback mechanism. For example, the exercise device 100 may include a visual indicator (e.g., one or more light sources 440) and either a haptic or auditory device. Different types of mechanisms may be used for guidance and feedback. For example, a visual indicator may provide guidance, and a haptic or auditory indicator may provide feedback. The availability of multiple feedback and guidance delivery mechanisms creates additional opportunities for feedback and/or guidance. The delivery to users of feedback and/or guidance delivered using different delivery mechanisms is explicitly contemplated herein.

To prevent user confusion, some or all of the light sources 440 may be capable of emitting light in different colors. In the context of the examples above, the processor 140 may cause the selected guidance light source (e.g., 440B in the first example above or 440A in the second example) to emit light in a different color from the feedback light sources (e.g., 440C, 440D, and 440E (and, in the second example, 440B)). As just one example, the processor 140 may cause the guidance light source 440 to emit orange light, and then as the user applies force, the processor 140 may cause the feedback light sources 440 to emit white light when they are on.

As another example, instead of using a particular selected light source 440 (e.g., the light source 440B or 440A) to indicate the target force to the user, the processor 140 may use different light sources 440 depending on the magnitude of the target force the user is supposed to apply. In such embodiments, the user has an idea, based on which light source 440 is emitting light as guidance, how much longitudinal force the user will need to apply to reach the target. As one example, if the processor 140 causes the light source 440B to emit light as the guidance, this may instruct the user that he or she will need to apply more or less force than when the processor 140 causes the light source 440D to emit light as the guidance. As the user applies force, the processor 140 may cause the light sources 440 between the selected guidance light source 440 and the base 120 to emit light in sequence to indicate whether the user is achieving the target force. To prevent user confusion, the light sources 440 may be capable of emitting light in different colors, in which case the processor 140 may cause the light source 440 selected as the guidance light source to emit light in a different color from the light sources 440 that are indicating how much force the user is actually applying. For example, the processor 140 may cause the guidance light source 440 to emit orange light, and then as the user applies force, the processor 140 may cause the feedback light sources 440 to emit white light.

Figure 31:
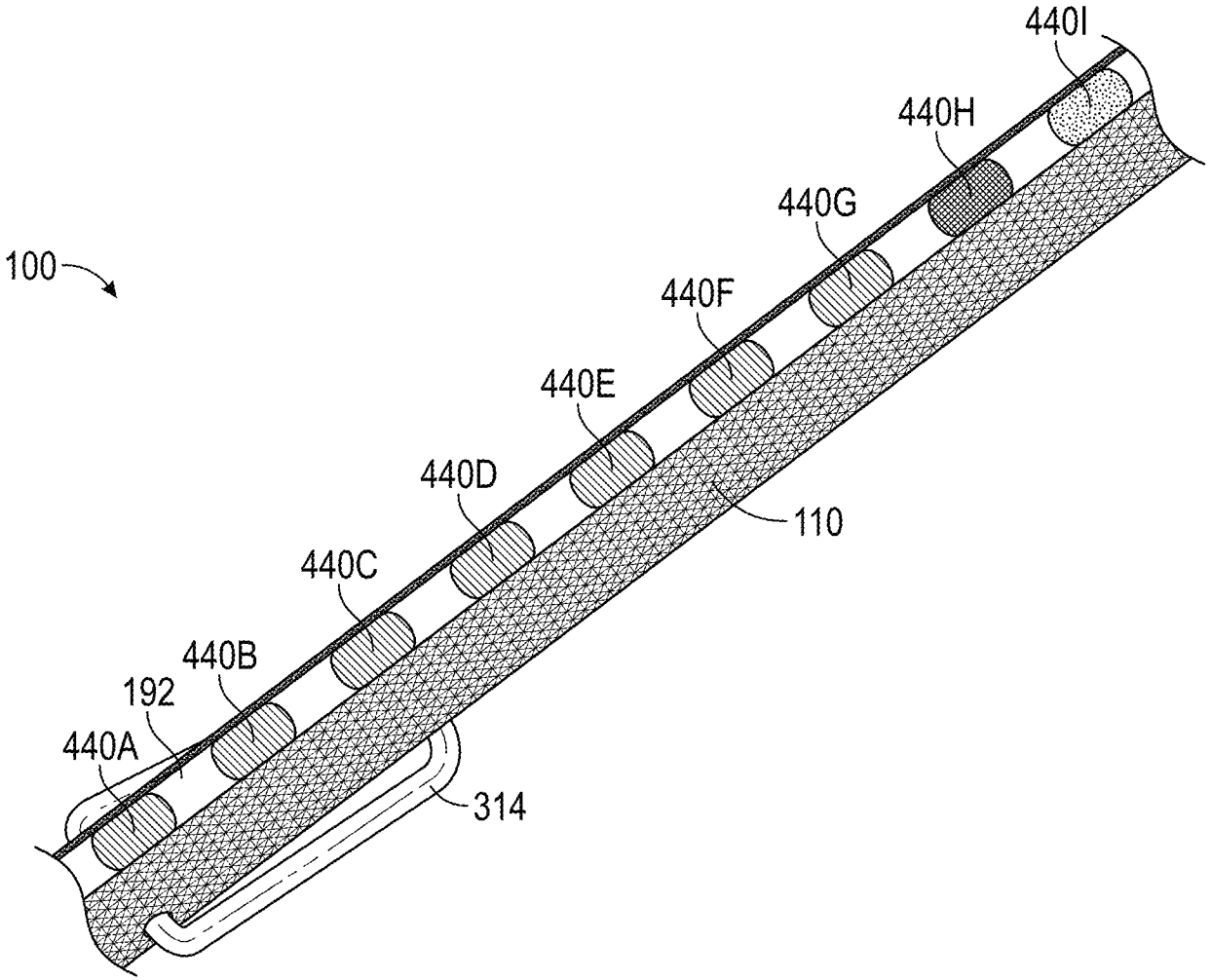
FIG. 31 illustrates an exercise device that includes several light sources in accordance with some embodiments.

FIG. 31 illustrates an exemplary embodiment in which the exercise device 100 includes at least 9 light sources 440 (though, as explained above, there may be more or fewer than 9 light sources 440). In the embodiment of FIG. 31, the processor 140 may cause the light 440H to emit light of a first color (e.g., orange) to provide guidance (e.g., a force target) to the user. As the user applies a longitudinal force, the processor 140 may cause some or all of the light sources 440A-440G to emit light of a second color (e.g., white), possibly in a sequence, to provide real-time feedback to the user regarding whether the applied longitudinal force is less than the target force (e.g., by causing only a subset of the light sources 440A-440G to emit light). If the applied longitudinal force is within a tolerance (which may be zero) of the target force, the processor 140 may cause the light source 440H to emit light in a third color (e.g., green) to indicate that the user has met the force target. The processor 140 may cause the light source 440I to emit light of a fourth color (e.g., red) to indicate that the user has exceeded the force target.

It should be clear in view of the disclosures herein that there are many ways the processor 140 can control the one or more light sources 440 to guide a user's workout and/or to provide real-time feedback regarding that workout (e.g., to indicate whether the user is meeting, falling short of, or exceeding a target amount of longitudinal force, to indicate whether the user is performing an exercise at a desired or target speed, etc.). It should also be clear that if the one or more light sources 440 are capable of emitting light of two or more colors, even more sophisticated guidance and/or feedback mechanisms may be defined (e.g., different colors may be used to indicate different amounts of target or applied longitudinal force, different phases of an exercise, different repetitions within a set of exercises, etc.). Depending on the capabilities of the light sources 440, the processor 140 may be able to provide guidance and/or feedback by controlling one or more of the following: whether a particular light source 440 is on or off, the intensity of light emitted by a light source 440 when it is on, the color of light emitted by a light source 440, whether a particular light source blinks or flickers, or any other controllable property of a light source 440. The examples provided herein are not intended to be limiting.

Figure 27B:
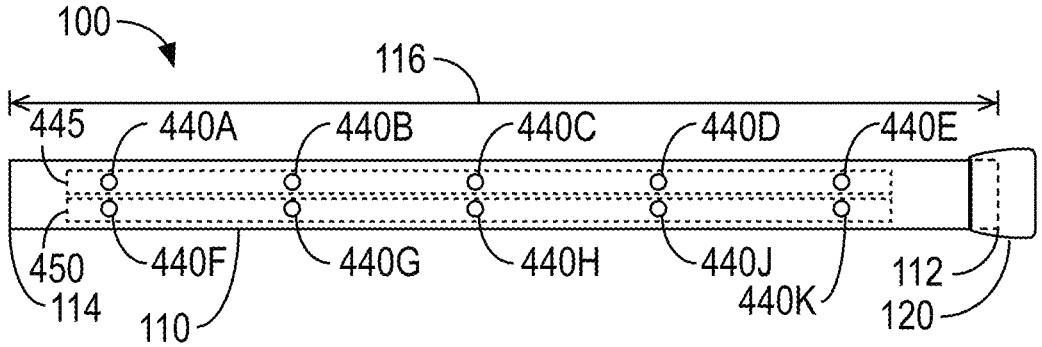

As discussed in the context of FIG. 27A, the processor 140 may control a single array of light sources 440 to provide guidance and/or feedback to the user. FIG. 27B illustrates that the exercise device 100 may include both a guidance indicator 410, implemented using a first set of one or more light sources 445, and a real-time feedback indicator 415, implemented using a second set of one or more light sources 450. As illustrated in FIG. 27B, each of the first and second sets of one or more light sources 445 and 450 includes one or more light sources 440, which may be, as previously explained, any suitable light source, including, for example, one or more LEDs. FIG. 27B illustrates the first and second sets of one or more light sources 445 and 450 aligned with each other, but it is to be appreciated that they may be arranged in any way that is convenient or helpful to users of the exercise device 100. For example, the first and second sets of one or more light sources 445 and 450 may be situated end-to-end along the longitudinal axis 111 of the exercise device 100.

To enable a user of the exercise device 100 to see both the workout guidance provided by the first set of one or more light sources 445 and the real-time feedback provided by the second set of one or more light sources 450, the first and second sets of one or more light sources 445 and 450 may be positioned on or within the rigid rod 110 or the base 120 so that the user can orient the exercise device 100 so that both the first and second sets of one or more light sources 445 and 450 are visible simultaneously. For example, the first and second sets of one or more light sources 445 and 450 may be mounted adjacent to each other on or within the rigid rod 110 as shown in FIG. 27B. The first and second sets of one or more light sources 445 and 450 may be mounted on or within the exercise device 100 as described in the discussion of FIGS. 27A and 28, and the processor 140 may control any available aspects of the individual light sources 440 to provide guidance and/or real-time feedback. To assist the user in distinguishing which set of light sources provides guidance and which provides real-time feedback, the exercise device 100 may include an indication (e.g., a label, a stamp, a mark, etc.) on the surface of the exercise device 100 to indicate which set of one or more light sources, 445 or 450, provides guidance and which provides real-time feedback.

The processor 140 may control the first set of one or more light sources 445 to provide guidance as discussed above in the explanation of FIG. 27A (e.g., the processor 140 may control whether a particular light source 440 is on or off, the timing of different light sources 440 turning on or off in relation to other light sources 440, the color and intensity of light produced by the light sources 440, whether the light sources 440 blink or flicker, etc.). Simultaneously, the processor 140 may control the second set of one or more light sources 450 to provide real-time feedback, also as discussed above in the explanation of FIG. 27A (e.g., the processor 140 may control whether a particular light source 440 is on or off, the timing of different light sources 440 turning on or off in relation to other light sources 440, the color and intensity of light produced by the light sources 440, whether the light sources blink or flicker, etc.). Although FIG. 27B presents an exemplary embodiment in which the number of light sources 440 in the first set of one or more light sources 445 is the same as the number of light sources 440 in the second set of one or more light sources 450, the first and second sets of one or more light sources 445 and 450 may use different numbers of lights. For example, as explained above in the context of FIG. 27A, the real-time feedback indicator 410 may include only one light source 440.

As an example of how the processor 140 may implement the guidance indicator 415 in the context of the embodiment of FIG. 27B, if the user is performing the lunge exercise described in the context of FIGS. 4A and 4B, the processor 140 may control the first set of one or more light sources 445 to provide workout guidance as follows. First, the processor 140 may instruct the user to prepare to perform a set of lunges by causing one or more of the light sources 440A, 440B, 440C, 440D, and 440E to produce light of a first color, Color 1. The processor 140 may also cause the one or more of the light sources 440A through 440E to blink, and/or sequentially turn off the light sources 440A through 440E to communicate a countdown to the start of the first lunge in the set. As a concrete example, the processor 140 may cause all of the light sources 440A through 440E to produce orange light and to blink three times, and then sequentially turn off each light source 440 in an order that conveys a countdown to the user (e.g., after the light sources 440A through 440E have all flashed three times, the processor 140 may turn off light source 440A, then light source 440B, etc. until all light sources 440A through 400E are off).

The processor 140 may then guide the user through a single repetition of the lunge exercise in three phases. To guide the user through the first phase, in which the user moves from the position shown in FIG. 4A to the position shown in FIG. 4B, the processor 140 may sequentially turn on the light sources 440A through 440E in a selected color, which may be Color 1 or a different color, at a rate that encourages the user to perform the first phase of the lunge at a prescribed pace (e.g., if the user should take three seconds to move from the position shown in FIG. 4A to the position shown in FIG. 4B, the processor 140 may turn on light source 440B 0.75 seconds after turning on light source 440A, light source 440C 0.75 seconds after turning on light source 440B, etc.). If it is desirable for the user to modify the magnitude of the compressive longitudinal force applied during the first phase, the processor 140 may vary the intensities of the light sources 440A through 440E to reflect the desired magnitude of the compressive longitudinal force (e.g., the processor 140 may cause the light sources 440 to produce more intense light when the user should apply more longitudinal force and less intense light when the user should apply less longitudinal force).

The processor 140 may then guide the user through the second phase of the lunge exercise, in which the user holds the position illustrated in FIG. 4B while applying a compressive longitudinal force to the exercise device 100. The processor 140 may, for example, cause the light sources 440A through 440E to continue to produce light of Color 1, but blink for the duration of the second phase (e.g., if the second phase is three seconds long, the processor 140 may cause the light sources 440A through 440E to blink three times at one-second intervals, or six times at half-second intervals). Alternatively, the processor 140 may sequentially turn off the light sources 440A through 440E, which continue to produce light of Color 1, to count down the duration of the second phase (e.g., if the second phase is five seconds long, the processor 140 may turn off light source 440E after one second, turn off light source 440D after two seconds, etc.). As another example, the processor 140 may cause the light sources 440A through 440E to produce light of a different color, Color 2, and sequentially turn off the light sources 440A through 440E to count down the duration of the second phase (e.g., if the second phase is five seconds long, the processor 140 may turn off light source 440E after one second, turn off light source 440D after two seconds, etc.). However the processor 140 uses the light sources 440A through 440E to signal the duration of the second phase, the processor 140 may vary the intensity of the light produced by the light sources 440A through 440E to convey whether the user should increase or decrease the amount of longitudinal force applied during the second phase. For example, if the user should simply attempt to maintain the same longitudinal force during the second phase (e.g., as illustrated in the target force profiles shown in FIGS. 22 and 25), the processor 140 may cause the light sources 440A through 440E to produce light at a constant intensity (e.g., the maximum intensity or any other selected intensity). On the other hand, if the user should attempt to increase the applied longitudinal force, the processor 140 may cause the intensity of the light produced by the light sources 440A through 440E to increase at a rate corresponding to the rate at which the user should increase the applied force.

The processor 140 may then guide the user through the third phase of the exercise in which the user moves from the position illustrated in FIG. 4B back to the position shown in FIG. 4A while applying a compressive longitudinal force to the exercise device 100. The processor 140 may sequentially turn on the light sources 440A through 440E in a selected color, which may be Color 1 or a different color, at a rate that encourages the user to perform the third phase of the lunge at a prescribed pace (e.g., if the user should take three seconds to move from the position shown in FIG. 4B to the position shown in FIG. 4A, the processor 140 may turn on light source 440B 0.75 seconds after turning on light source 440A, light source 440C 0.75 seconds after turning on light source 440B, etc.). Alternatively, the processor 140 may turn on all light sources 440A through 400E in a selected color, which may be Color 1 or a different color, and then turn off the light sources 440A through 400E, one by one, at a rate that encourages the user to perform the third phase of the lunge at a prescribed pace. If it is desirable for the user to modify the magnitude of the compressive longitudinal force applied during the third phase, the processor 140 may vary the intensities of the light sources 440A through 440E to reflect the desired magnitude of the compressive longitudinal force (e.g., the processor 140 may cause the light sources 440 to produce more intense light when the user should apply more longitudinal force and less intense light when the user should apply less longitudinal force).

The processor 140 may then use the set of one or more light sources 445 to instruct the user to prepare to perform the next lunge exercise in the set by causing one or more of the light sources 440A, 440B, 440C, 440D, and 440E to produce light of a selected color, which may be Color 1 or a different color. The processor 140 may also cause one or more of the light sources 440A through 440E to flash, and/or sequentially turn off the light sources 440A through 440E to communicate a countdown to the start of the next lunge in the set. To prevent the user from being confused about whether a new set or another repetition is being signaled, the processor 140 may control the light sources 440A through 440E differently to instruct the user to prepare for an additional repetition than to instruct the user to prepare for a new set. For example, the amount of time the processor 140 takes to signal the start of a new repetition may be shorter than the amount of time the processor 140 takes to signal the start of a new set, or the colors of the light sources 440A through 440E may be different to signal the start of a new repetition versus to signal the start of a new set. As a concrete example, to instruct the user to prepare to perform another repetition, the processor 140 may cause all of the light sources 440A through 440E to produce white light (instead of light of Color 1) and to flash twice in one second, and then the processor 140 may repeat the guidance for phases one through three of the lunge exercise to guide the user in performing another repetition, possibly in accordance with a target force profile (e.g., as illustrated in FIG. 22).

Continuing with the example of the lunge exercise described in the context of FIGS. 4A and 4B, the processor 140 may control the second set of one or more light sources 450 to provide real-time feedback regarding the user's workout as follows. During each phase of a repetition, the processor 140 may turn on the second set of one or more light sources 450 in a color that reflects whether the amount of force applied by the user falls short of, meets, or exceeds a target longitudinal force. For example, the processor 140 may cause the second set of one or more light sources 450 to emit red light if the longitudinal force applied by the user falls short of the target longitudinal force by more than a first threshold (which may be zero). The processor 140 may cause the second set of one or more light sources 450 to emit blue light if the amount of longitudinal force applied by the user falls within a (possibly asymmetrical) tolerance of the target longitudinal force, and the processor 140 may cause the second set of one or more light sources 450 to emit green light if the amount of longitudinal force applied by the user exceeds the target longitudinal force by more than a second threshold (which may be zero and may be the same as or different from the first threshold).

When the achieved longitudinal force falls short of or exceeds the target longitudinal force, the processor 140 may give the user an indication of by how much by controlling the intensity of the light emitted by the second set of one or more light sources 450. For example, the processor 140 may cause all of the light sources in the second set of one or more light sources 450 to emit a low-intensity green when the amount of longitudinal force applied by the user exceeds the target value by less than 5 percent, a mid-intensity green when the amount of longitudinal force applied by the user exceeds the target value by between 5 percent and 20 percent, and the most intense green possible when the amount of longitudinal force applied by the user exceeds the target value by more than 20 percent. Similarly, the processor 140 may cause the second set of one or more light sources 450 to emit a low-intensity red when the amount of longitudinal force applied by the user falls short of the target value by less than 5 percent, a mid-intensity red when the amount of longitudinal force applied by the user falls short of the target by between 5 and 15 percent, and the highest-intensity red when the amount of longitudinal force applied by the user falls short of the target value by more than 15 percent.

Alternatively, when the achieved longitudinal force falls short of or exceeds the target longitudinal force, the processor 140 may give the user an indication of by how much by causing different ones of the one or more light sources 450 to emit light in selected colors. For example, when the amount of longitudinal force applied by the user exceeds the target value by less than 5 percent, the processor 140 may turn on only the light source 440F in green, and when the amount of longitudinal force applied by the user exceeds the target value by between 5 percent and 20 percent, the processor 140 may turn on the light sources 440F, 440G, and 440H in green, and when the amount of longitudinal force applied by the user exceeds the target value by more than 20 percent, the processor 140 may cause all of the light sources in the second set of one or more light sources 450 to emit green light. As another example, when the amount of longitudinal force applied by the user falls short of the target value by less than 5 percent, the processor 140 may turn on only the light source 440F in red, and when the amount of longitudinal force applied by the user falls short of the target value by between 5 percent and 20 percent, the processor 140 may turn on the light sources 440F, 440G, and 440H in red, and when the amount of longitudinal force applied by the user falls short of the target value by more than 20 percent, the processor 140 may turn on all of the light sources in the second set of one or more light sources 450 in red.

If the individual light sources 440 in the first and second sets of one or more light sources 445 and 450 are capable of producing light in multiple colors, more sophisticated feedback signaling may be implemented. For example, in the example above, the processor 140 may use a first color to indicate that the amount of longitudinal force applied by the user exceeds the target value by less than 5 percent, a second color to indicate that the amount of longitudinal force applied by the user exceeds the target value by between 5 percent and 20 percent, and a third color to indicate that the amount of longitudinal force applied by the user exceeds the target value by more than 20 percent. The processor 140 may also cause the second set of one or more light sources 450 to blink or flicker to indicate, for example, that the user is performing the current phase of the exercise too quickly or too slowly.

As explained above, depending on the capabilities of the light sources 440 in the first and second sets of one or more light sources 445 and 450, the processor 140 may be able to provide guidance and/or feedback by controlling one or more of the following: whether a particular light source 440 is on or off, the intensity of light emitted by a light source 440 when it is on, the color of light emitted by a light source 440, whether a particular light source blinks or flickers, or any other controllable property of a light source 440. The examples provided herein are not intended to be limiting. Furthermore, although FIG. 27B illustrates the first and second sets of one or more light sources 445 and 450 as being parallel to each other and distributed along the length 116 of the rigid rod 110, the first and second sets of one or more light sources 445 and 450 may be arranged differently (e.g., closer to one end of the rigid rod 110 than the other, end-to-end rather than parallel, etc.). It is to be appreciated that there are many ways to arrange the first and second sets of one or more light sources 445 and 450, and the examples provided herein are not intended to be limiting.

Figure 27C:
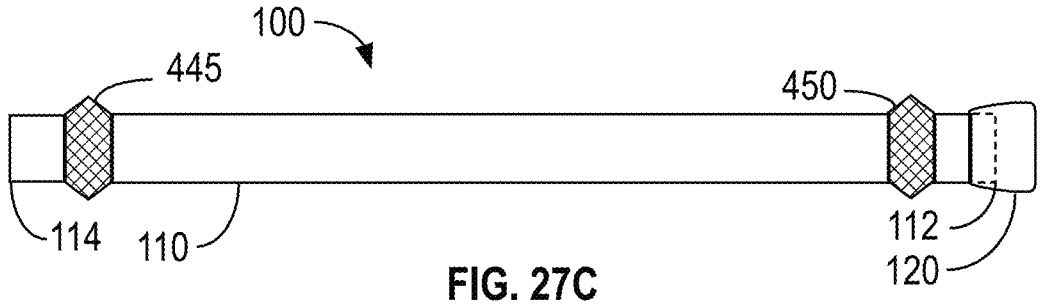

FIG. 27C illustrates an alternative arrangement of the first and second sets of one or more light sources 445 and 450 in accordance with some embodiments. As shown in FIG. 27C, the first and second sets of one or more light sources 445 and 450 are annular rings protruding from the rigid rod 110, but the first and second sets of one or more light sources 445 and 450 may take a different shape, may not extend all the way around the rigid rod 110, may be flush with the surface of the rigid rod 110, or, as described previously, may be situated within the rigid rod 110 and visible to the user through the rigid rod 110 (e.g., the rigid rod 110 may be transparent or translucent, or it may include a window, cutout, or channel). As explained above, the first and second sets of one or more light sources 445 and 450 may reside within a strip 192 that is attached to the outside of the rigid rod 110 (either longitudinally, as shown in at least FIGS. 3A-3D, 8, 12A, 12B, 13A-13C, 14A, 14B, 28A, 28B, and 31-33, or around the rigid rod 110, similarly to FIG. 27C). Alternatively, or in addition, the first and second sets of one or more light sources 445 and 450 may reside within the rigid rod 110 (e.g., as shown in FIGS. 29-30). Moreover, one or both of the first and second sets of one or more light sources 445 and 450 may be attached to, on, or within the base 120.

Figure 27D:
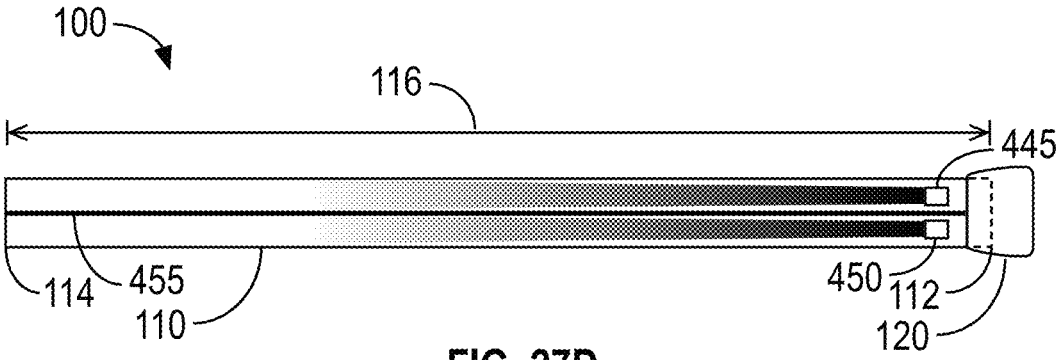

FIG. 27D illustrates yet another arrangement of the first and second sets of one or more light sources 445 and 450 in accordance with some embodiments. As shown in FIG. 27D, the first and second sets of one or more light sources 445 and 450 are mounted within the rigid rod 110, which, in the embodiment of FIG. 27D is hollow and at least partially transparent or translucent. A solid (i.e., impermeable to light) barrier 455 divides (e.g., bisects) the interior of the rigid rod 110. Although FIG. 27D shows the barrier 455 extending in the longitudinal direction, it may alternatively extend in the transverse direction (i.e., perpendicular to the longitudinal axis 111). The first set of one or more light sources 445 is situated on one side of the barrier 455, and the second set of one or more light sources 450 is situated on the other side of the barrier 455. Although FIG. 27D shows the first and second sets of one or more light sources 445 and 450 situated near the base of the exercise device 100, the first and second sets of one or more light sources 445 and 450 may be located elsewhere within the rigid rod 110 (e.g., they may be distributed, uniformly or nonuniformly, along the length of the rigid rod 110). In the exemplary embodiment of FIG. 27D, the processor 140 may control the first and second sets of one or more light sources 445 and 450 as described previously to provide guidance and/or real-time feedback to the user of the exercise device 100 (e.g., by varying the timing, color, and/or intensity of emitted light, by causing the one or more light sources 440 making up the first and second sets of one or more light sources 445 and 450 to blink or flash, etc.).

It is to be appreciated based on the disclosures herein that certain information that may be provided by the exercise device 100 to guide a user's workout is similar to certain information that may be provided by the exercise device 100 to provide real-time feedback information to the user. For example, a number of repetitions may be provided as guidance (e.g., a number of repetitions remaining) or as real-time feedback (e.g., a number of repetitions performed). Similarly, an indication of longitudinal force may be provided as guidance (e.g., to instruct the user to apply more, less, or a consistent amount of force) or as real-time feedback (e.g., to instruct the user that the amount of force he or she is applying is less than a specified target or more than a specified target). The guidance indicator 415 and real-time feedback indicator 410 may use similar or the same mechanisms to convey such similar information. Thus, it is to be appreciated that descriptions herein of how the guidance indicator 415 may provide guidance information to the user may also be applicable to enable the real-time feedback indicator 410 to provide feedback information to the user. Likewise, descriptions herein of how the real-time feedback indicator 410 may provide feedback information to the user may also be applicable to enable the guidance indicator 415 to provide guidance information to the user.

Figure 32:
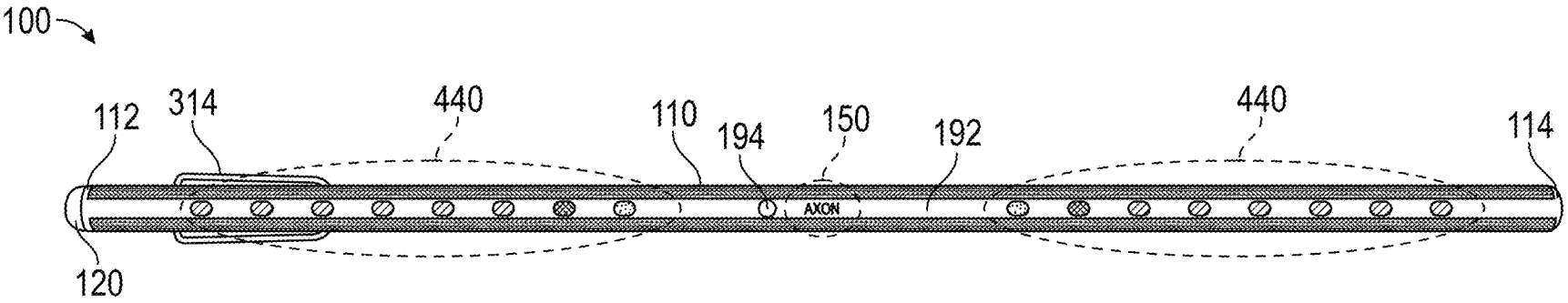
FIG. 32 illustrates an exercise device that includes two sets of one or more light sources in accordance with some embodiments.

FIG. 32 illustrates an embodiment of the exercise device 100 that includes, within a strip 192, two sets of one or more light sources 440, which, as shown, may be (but are not necessarily) mirror images of each other. Embodiments such as the one shown in FIG. 32 may be particularly advantageous to enable users to receive guidance and/or feedback regardless of whether they are facing the first end 112 or the second end 114 of the rigid rod 110. The embodiment of FIG. 32 also includes an attachment 314, shown as a rotatable hoop (previously illustrated in FIGS. 12A-12B). The exercise device 100 of FIG. 32 also includes a display 150, shown as capable of displaying alphanumeric characters, and a power button 194. The power button 194 is coupled to the power supply 160 and controls whether the power supply 160 provides power to the electronic components of the exercise device 100. The power button 194 may be recessed from the outer surface of the rigid rod 110 and/or it may have a shape that reduces the likelihood that a user accidentally presses the power button 194 while exercising. Although FIGS. 32 and 33 show the power button 194 along the length 116 of the rigid rod 110, the power button 194 may be located elsewhere (e.g., closer to or on/in the base 120 or at the second end of the rigid rod 110).

Figure 33:
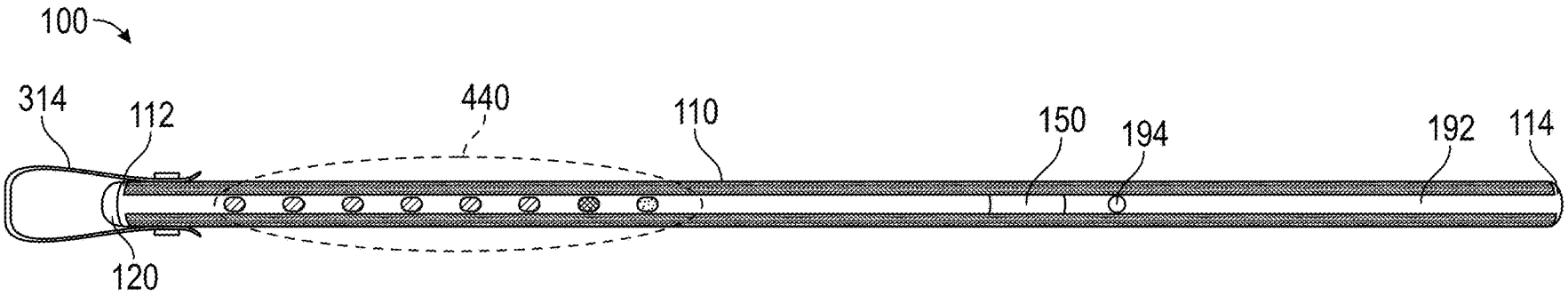
FIG. 33 illustrates an exercise device that includes a single set of one or more light sources disposed within a strip in accordance with some embodiments.

FIG. 33 illustrates another embodiment of the exercise device 100 that includes a single set of one or more light sources 440 disposed within a strip 192. The exercise device 100 of FIG. 33 also includes a display 150, a power button 194, and an attachment 314 that is similar to those shown in FIG. 13A-13C or 14A-14B. The one or more light sources 440 may provide guidance and/or feedback in many of the ways previously discussed, including by using different colors for different ones of the one or more light sources 440 to provide guidance and/or feedback to the user.

Many of the drawings herein, including FIGS. 15A-15C, 16A-16D, 18, and 21A-21C, illustrate the components for detecting expansive longitudinal forces at the same end of the rigid rod 110 (i.e., the first end 112) as the components for detecting compressive longitudinal forces. In such embodiments, the other end of the rigid rod 110 (e.g., the second end 114) may have a shape or cap (e.g., as shown in FIGS. 32 and 33) that indicates it is not the end of the exercise device 100 that will capture longitudinal force information during a workout. It is to be appreciated that the components for detecting expansive longitudinal forces need not be collocated with the components for detecting compressive longitudinal forces. Components for detecting compressive longitudinal forces (e.g., some or all of the components shown in FIGS. 10A, 19A, and 20) may be located at the first end 112 of the rigid rod 110 (e.g., partially or completely within the rigid rod 110 or partially or completely within the base 120), and components for detecting expansive longitudinal forces (e.g., some or all of the components shown in FIG. 11A) may be located at the second end 114 of the rigid rod 110 (e.g., partially or completely within the rigid rod 110 or partially or completely within a second base 120), or vice versa. In such embodiments, the user would perform exercises involving compressive longitudinal forces using one end of the exercise device 100 and exercises involving expansive longitudinal forces using the other end of the exercise device 100. FIG. 32 illustrates an embodiment that could situate components for detecting expansive longitudinal forces at the first end 112 of the rigid rod 110 and components for detecting compressive longitudinal forces at the second end 114 of the rigid rod 110, with a second base 120 added to the second end 114. It is to be understood that the embodiment of FIG. 32 accommodates, but does not require, such a distribution of components. Although it may be advantageous to collocate components for detecting compressive longitudinal forces with components for detecting expansive longitudinal forces, collocation is not required. Moreover, an exercise device 100 need not be capable of detecting both compressive and expansive longitudinal forces. It may be desirable in some circumstances for the exercise device 100 to be capable of detecting only compressive longitudinal forces or only expansive longitudinal forces. Such embodiments are expressly contemplated herein, and FIGS. 10A, 10B, 11A-11C, 19A-19C, and 20A-20C illustrate ways in which such embodiments may be achieved.

Although many of the drawings herein, including FIGS. 6A, 8, 9A-9F, 10A-10B, 11A-11C, 15A-15C, 19A-19C, 32, and 33, illustrate the display 150 as a component of the exercise device 100, as stated previously, the exercise device 100 need not include a display. For example, as shown in the exemplary block diagram 200H illustrated in FIG. 34, a display 152, which is either in addition to or instead of the optional display 150 in the exercise device 100, may be included in an external device 170 with which the exercise device 100 communicates over a communication link 180. In some embodiments, the external device 170 is a mobile device, such as, for example, a cellular phone, a tablet, a laptop, a smart phone, etc., or a wearable device (e.g., made by Fitbit™, Mio™, Apple™, Garmin™, etc.), or any other external device having the basic capabilities described herein for the external device 170. In some embodiments, the exercise device 100 includes a display 150 (not shown in FIG. 34, but illustrated in other drawings herein), and the external device 170 includes a separate display 152.

In embodiments in which the external device 170 includes a display 152, the external device 170 also includes a processor 145 that is capable of causing the display 152 to present information associated with the exercise device 100 to the user of the external device 170. The display 152 may be, for example, a graphical display or an alphanumeric display. The display 152 may be, for example, an LCD or LED display, or an array of light sources 196 (e.g., LEDs). The information presented to the user through the display 152 may include any information that might be of interest to the user, including the same type of information the display 150 might present to the user (e.g., information about a type of exercise, a number of repetitions performed or to be performed, an amount of longitudinal force applied or to be applied, an amount of time during which a longitudinal force was applied by the user, a time under tension (compressive, expansive, or a combination of the two), a status of the exercise device 100 (e.g., battery level if the power supply 160 is a battery, memory status), etc.).

Figure 34:
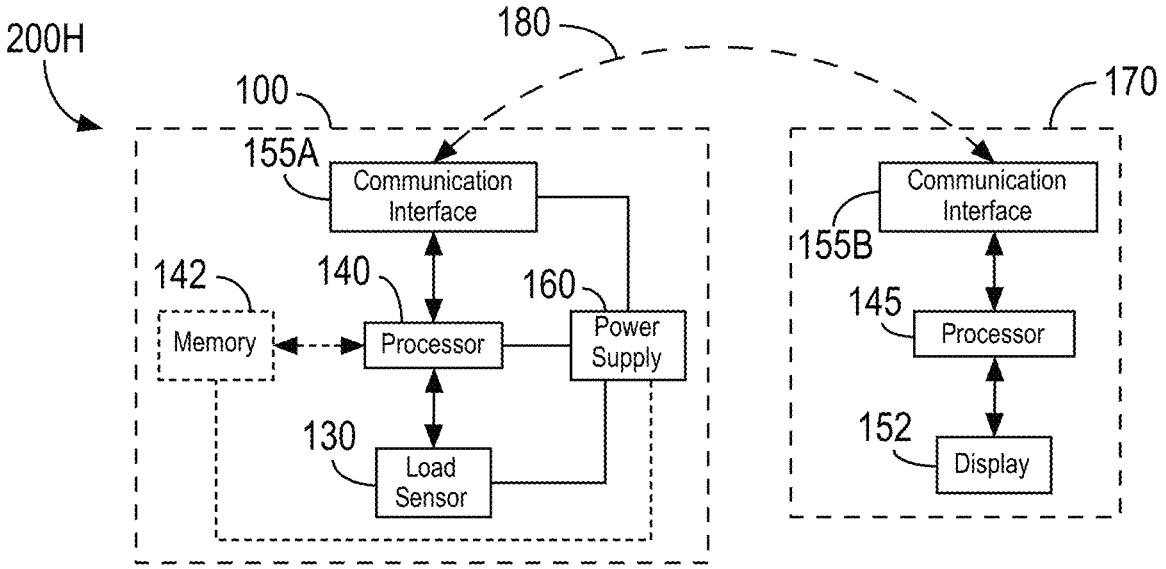
FIG. 34 is a block diagram of some components of an exemplary exercise device capable of communicating with an external device in accordance with some embodiments.

As shown in FIG. 34, in embodiments in which the exercise device 100 communicates with an external device 170, the exercise device 100 includes a communication interface 155A that is capable of establishing the communication link 180 with a corresponding communication interface 155B of the external device 170. The communication link 180 may be a wired or wireless link, and the communication interfaces 155A and 155B may support any suitable protocol for transferring information between the exercise device 100 and the external device 170. Exemplary suitable wired-medium protocols include, but are not limited to, serial, USB, FireWire, Ethernet, and Thunderbolt. Exemplary suitable wireless protocols include, but are not limited to, Wi-Fi (i.e., compliant with one or more of the IEEE 802.11 standards), Li-Fi (a type of optical wireless communication), cellular, Bluetooth™, ZigBee (i.e., IEEE 802.15.4), and near-field communication.

The information transferred from the exercise device 100 to the external device 170 over the communication link 180 may include information about a previous or ongoing workout, including, for example, the date of the workout, the beginning, ending, and/or total time of the workout, the number of repetitions, the amount of time per repetition (e.g., either raw or average values), the amount of longitudinal force applied by the user during each repetition (e.g., an average over all repetitions, a total amount of force over all repetitions, or a measure of the longitudinal force during each repetition), whether the longitudinal force was compressive or expansive, the time under tension (e.g., expansive, compressive, or a combination; per repetition, per set, or per workout), the number of sets, the type of exercise(s) performed, or any other information of interest to the user or to a third party, such as, for example, the user's personal trainer, doctor, coach, social network, insurance company, etc.

In some embodiments, the external device 170 is able to provide information over the communication link 180 to the exercise device 100. For example, through the communication interfaces 155B and 155A, the external device 170 may be able to provide information about an upcoming workout to the exercise device 100. Such information may identify, for example, an exercise to be performed, a time of day, a day of the week, a target number of repetitions, a target amount of time (e.g., per repetition, per set, per workout), a target amount of longitudinal force for the user to apply, a target time under tension (compressive, expansive, or a combination), information about a previous workout or a goal previously established or achieved, configuration information for the exercise device 100, or any other information that might be useful to the exercise device 100 or the user. Configuration information for the exercise device 100 may include information enabling the exercise device 100 to connect to a network, such as, for example, a Wi-Fi network. Configuration information for the exercise device 100 may include, for example, one or more settings indicating whether a visual indicator of the exercise device 100 (e.g., the guidance indicator 415) should guide the user's workout by presenting a target for the user to follow (e.g., instruct the user to apply a force for a particular period of time, instruct the user to increase the applied force, etc.), or provide real-time feedback (e.g., through the real-time feedback indicator 410) regarding the in-progress workout (e.g., indicate to the user that the amount of force being applied at the moment is too low, too high, or adequate, etc.). The exercise device 100 may use information received from the external device 170 to configure one or more aspects of the exercise device 100, such as, for example, properties of the real-time feedback indicator 410 and/or the guidance indicator 415 (e.g., colors or brightness of light sources 440 comprising the real-time feedback indicator 410 and/or the guidance indicator 415, whether to enable a haptic device or an auditory device such as a speaker to provide guidance or feedback, configuration settings (e.g., language, sound, volume, haptic pattern, etc.) for the guidance or feedback indicators 415, 410, etc.).

The display 152 may be part of a user interface of the external device 170 that enables the user or another person (e.g., the user's personal trainer, doctor, physical therapist, etc.) to view and enter information. The user interface may be capable of accepting a variety of information useful to the user or another person, or to the exercise device 100, including the information described above. For example, the information may include a password (e.g., for a Wi-Fi network, to access data stored in the exercise device 100 or in a database accessible to the external device 170, etc.) or information that allows the exercise device 100 to be configured (e.g., for a desired number of exercises or a particular type of exercise, for a target time under tension, for a target longitudinal force, etc.) or customized (e.g., based on the user's name, age, height, weight, gender, level of fitness, location, time since last workout, etc.; properties of the guidance indicator 415 and/or real-time feedback indicator 410, if present).

In addition or alternatively, the external device 170 may be able to send information about a past workout to the exercise device 100. Such information may include, for example, an indication of the time or date of a previous workout, an amount of longitudinal force applied, an exercise performed, an amount of time under tension achieved (compressive, expansive, or a combination), an amount of time during which an exercise was performed, or any other information about a past workout. In some embodiments, the processor 140 of the exercise device 100 uses the information about a past workout to configure the exercise device 100 for an imminent or future workout. As just one example, if the external device 170 informs the exercise device 100 that during the user's last workout, the user performed ten repetitions of an isometric lunge (e.g., FIGS. 4A-4B) and applied an average of ten pounds of compressive longitudinal force per repetition, the processor 140 may configure the exercise device 100 to encourage the user to perform more than ten repetitions of that same exercise at a compressive longitudinal force averaging more than ten pounds per repetition. Alternatively, the processor 140 may present information about the previous workout to the user through the display 150, if present, so that the user can decide, for example, whether to perform more or fewer repetitions, apply more or less longitudinal force, perform a different or additional exercise, or make any other decision about the workout.

In embodiments in which the exercise device 100 is in communication with an external device 170, as illustrated in FIG. 34, the external device 170 may be capable of providing workout guidance and/or real-time feedback to the user. For example, the display 152 shown in FIG. 34 may act as the real-time feedback indicator 410 shown in FIGS. 23A and 26, in which case the real-time feedback indicator 410 may, but need not, be omitted from the exercise device 100. Similarly, the display 152 may act as the guidance indicator 415 shown in FIGS. 24A and 26, and the guidance indicator 415 may, but need not, be removed from the exercise device 100. Likewise, if the exercise device 100 is in communication with an external device 170, other existing hardware in the external device 170 may be used as the real-time feedback indicator 410 and/or the guidance indicator 415. For example, the external device 170 may provide workout guidance and/or real-time feedback using a speaker. As another example, many candidate external devices 170 (e.g., mobile devices, wearable devices, etc.) include mechanisms that cause the external device 170 to vibrate when a specified condition has been met (e.g., the user has taken a specified number of steps or burned a specified number of calories, etc.). These mechanisms can be used to provide real-time feedback and/or guidance to the user. For example, if the external device 170 is a wearable device capable of vibrating, a first vibration pattern may be used to indicate that the user is applying too little force to the exercise device 100, and a second vibration pattern, different from the first, may be used to indicate that the user is exceeding the force target.

Alternatively, both the exercise device 100 and the external device 170 can include separate real-time feedback indicators 410 and/or guidance indicators 415. Such a configuration may be useful when a third party (e.g., personal trainer, coach, doctor, physical therapist, etc.) wishes to view the target workout indications offered by the guidance indicator 415 and/or the real-time feedback provided by the real-time feedback indicator 410 but is not in a position to see those indicators on the exercise device 100 because, for example, the user is holding the exercise device 100 such that the guidance indicator 415 and real-time feedback indicator 410 are not facing the third party, or they are moving, along with the exercise device 100, as the user performs an exercise, and they may be difficult for a third party to see clearly. The exercise device 100 may send information to the external device 170 over the communication link 180, and the external device 170 may then present that information through its own guidance indicator 415 and/or real-time feedback indicator 410. As explained previously, the display 152 of the external device 170 may function as either or both of the real-time feedback indicator 410 and guidance indicator 415, thus obviating any need for separate hardware for the real-time feedback indicator 410 and guidance indicator 415.

In the foregoing description and in the accompanying drawings, specific terminology has been set forth to provide a thorough understanding of the disclosed embodiments. In some instances, the terminology or drawings may imply specific details that are not required to practice the invention. To avoid obscuring the present disclosure unnecessarily, certain components (e.g., processors, memory, displays) are shown in block diagram form and/or are not discussed in extensive detail.

Unless otherwise specifically defined herein, all terms are to be given their broadest possible interpretation, including meanings implied from the specification and drawings and meanings understood by those skilled in the art and/or as defined in dictionaries, treatises, etc. As set forth explicitly herein, some terms may not comport with their ordinary or customary meanings.

As used in the specification and the appended claims, the singular forms "a," "an" and "the" do not exclude plural referents unless otherwise specified. The word "or" is to be interpreted as inclusive unless otherwise specified. Thus, the phrase "A or B" is to be interpreted as meaning all of the following: "both A and B," "A but not B," and "B but not A." Any use of "and/or" herein does not mean that the word "or" alone connotes exclusivity.

Whether followed by a conjunctive list having the form "A, B, and C," or a disjunctive list having the form "A, B, or C," the phrases "one or more of" and "at least one of" as used herein encompass all of the following combinations: (1) A only, (2) B only, (3) C only, (4) both A and B, (5) both A and C, (6) both B and C, (7) all of A, B, and C. Likewise, the phrase "one or both of A and B" means "A but not B," "B but not A," and "both A and B."

The term "coupled" is used herein to express a direct connection as well as a connection through one or more intervening parts or structures (e.g., hardware, wiring, etc.). Parts that are communicatively coupled are capable of communicating with each other either directly or through an intervening part or structure (e.g., wiring, a network, etc.). To the extent that the terms "include(s)," "having," "has," "with," and variants thereof are used herein, such terms are intended to be inclusive in a manner similar to the term "comprising," i.e., meaning "including but not limited to." The terms "exemplary" and "embodiment" are used to express examples, not preferences or requirements.

The terms "over," "under," "between," and "on" are used herein refer to a relative position of one feature with respect to other features. For example, one feature disposed "over" or "under" another feature may be directly in contact with the other feature or may have intervening parts. Moreover, one feature disposed "between" two features may be directly in contact with or connected to the two features or may have one or more intervening features or parts. In contrast, a first feature "on" a second feature is in contact with that second feature.

The abbreviation "e.g." is used herein to mean "for example." Examples provided are explicitly not intended to be limiting. The abbreviation "i.e." is used herein to mean "that is."

The drawings are not necessarily to scale, and the dimensions, shapes, and sizes of the features may differ substantially from how they are depicted in the drawings.

Although the invention has been described with respect to certain embodiments, various variations and modifications may be effected without departing from the spirit and scope of the novel concepts of the disclosure. Unless explicitly stated herein, features and functions of different embodiments disclosed and discussed herein may be combined. Multiple exemplary configurations have been illustrated and discussed, but they are by no means a complete set of embodiments enabled by the inventive concepts disclosed herein. The invention is not to be limited by the disclosed embodiments, as changes and modifications can be made that are within the full intended scope of the invention as defined by the following claims.

The invention claimed is:

1. A system, comprising:
- an exercise device, comprising:
  - a rigid rod having a first end and a second end;
  - a plurality of light sources arranged in a row along at least a portion of an axis extending between the first end and the second end of the rigid rod;
  - at least one load sensor for detecting an applied longitudinal force;
  - a first processor coupled to the at least one load sensor and to the plurality of light sources, the first processor configured to:
    - obtain a first signal indicating a magnitude of the applied longitudinal force, and
    - cause a subset of the plurality of light sources to emit light, wherein a ratio of a number of light sources in the subset to a total number of the plurality of light sources represents the magnitude of the applied longitudinal force relative to a reference longitudinal force value; and
- an external device, comprising:
  - a communication interface;
  - a display; and
  - a second processor coupled to the communication interface and to the display, wherein the second processor is configured to:
    - establish a communication link with the exercise device using the communication interface,
    - obtain data from the exercise device over the communication link, and
    - cause the display to present information associated with the exercise device.

2. The system recited in claim 1, wherein the information is first information, and wherein the second processor is further configured to provide second information to the exercise device over the communication link.

3. The exercise device recited in claim 2, wherein the second information comprises information about the reference longitudinal force value.

4. The exercise device recited in claim 3, wherein the information about the reference longitudinal force value comprises a plurality of parameters defining a target force profile.

5. The exercise device recited in claim 4, wherein the plurality of parameters comprises at least one of an amount of time, a time interval, or a force magnitude.

6. The exercise device recited in claim 3, wherein the information about the reference longitudinal force value comprises a mathematical function defining a target force profile.

7. The system recited in claim 2, wherein the second information comprises configuration information for the exercise device.

8. The system recited in claim 7, wherein the first processor is further configured to use the configuration information to cause a visual indicator of the exercise device to present a target for a user to follow and/or indicate to the user that the applied longitudinal force is too low, too high, or adequate.

9. The system recited in claim 7, wherein the configuration information indicates a color and/or a brightness of at least one of the plurality of light sources.

10. The system recited in claim 7, wherein the configuration information provides at least one configuration setting for the plurality of light sources, a haptic device, or an auditory device.

11. The system recited in claim 2, wherein the second information comprises information about a previous workout or information about a goal previously established or achieved.

12. The system recited in claim 11, wherein the first processor is further configured to use the second information to configure the exercise device for a workout.

13. The system recited in claim 2, wherein the second information identifies at least one of: an exercise, a time of day, a day of a week, a target number of repetitions, a target amount of time per repetition, a target amount of time per set, a target amount of time per workout, a target amount of longitudinal force, or a target time under tension.

14. The system recited in claim 1, wherein the display is configured to provide workout guidance and/or real-time workout feedback.

15. The system recited in claim 14, wherein the workout guidance and/or real-time workout feedback comprises a plot or graph.

16. The system recited in claim 1, wherein the external device comprises a mobile device.

17. The system recited in claim 1, wherein the information associated with the exercise device comprises information about at least one of: a type of exercise, a number of repetitions, a number of sets, the magnitude of the applied longitudinal force, the reference longitudinal force value, an amount of time during which the applied longitudinal force was applied, a time under tension, a status of the exercise device, a battery level, or a memory status.

18. The system recited in claim 1, wherein the information associated with the exercise device comprises at least one of: a date of a workout, a start time of the workout, an end time of the workout, a total time of the workout, an amount of time per repetition, an average magnitude of the applied longitudinal force, a total amount of force applied over all repetitions, a measure of the applied longitudinal force during each repetition, or an indication of whether the applied longitudinal force was compressive or expansive.

19. The system recited in claim 1, wherein the communication link is a wireless link.

20. The system recited in claim 1, wherein the display is configured to provide workout guidance by displaying a first plot or graph, and wherein the data from the exercise device comprises the magnitude of the applied longitudinal force, and wherein the information associated with the exercise device comprises a second plot or graph overlaying the first plot or graph and representing the magnitude of the applied longitudinal force.

* * * * *